US008213648B2

(12) United States Patent
Kimijima

(10) Patent No.: US 8,213,648 B2
(45) Date of Patent: Jul. 3, 2012

(54) AUDIO SIGNAL PROCESSING APPARATUS, AUDIO SIGNAL PROCESSING METHOD, AND AUDIO SIGNAL PROCESSING PROGRAM

(75) Inventor: Tadaaki Kimijima, Kanagawa (JP)

(73) Assignee: Sony Corporation, Tokyo (JP)

( * ) Notice: Subject to any disclaimer, the term of this patent is extended or adjusted under 35 U.S.C. 154(b) by 1199 days.

(21) Appl. No.: 11/657,567

(22) Filed: Jan. 25, 2007

(65) Prior Publication Data

US 2007/0189551 A1 Aug. 16, 2007

(30) Foreign Application Priority Data

Jan. 26, 2006 (JP) ..... 2006-017977

(51) Int. Cl.
*H04R 5/02* (2006.01)

(52) U.S. Cl. ..... 381/310; 381/98; 381/17

(58) Field of Classification Search ..... 381/2, 98, 381/101, 102, 103, 119, 306, 309, 310, 307, 381/7–28, 1, 86, 63, 316, 320, 317, 94.3, 381/94.2, 97, 120
See application file for complete search history.

(56) References Cited

U.S. PATENT DOCUMENTS

| | | | | |
|---|---|---|---|---|
| 3,825,684 | A * | 7/1974 | Ito et al. | 381/22 |
| 4,121,059 | A * | 10/1978 | Nakabayashi | 369/88 |
| 4,941,177 | A * | 7/1990 | Mandell et al. | 381/22 |
| 5,164,840 | A * | 11/1992 | Kawamura et al. | 386/107 |
| 5,440,639 | A * | 8/1995 | Suzuki et al. | 381/17 |
| 5,727,068 | A * | 3/1998 | Karagosian et al. | 381/22 |
| 6,130,949 | A | 10/2000 | Aoki et al. | |
| 2003/0152236 | A1 * | 8/2003 | Morikawa | 381/17 |
| 2005/0275913 | A1 * | 12/2005 | Vesely et al. | 359/13 |
| 2007/0110258 | A1 * | 5/2007 | Kimijima | 381/97 |

FOREIGN PATENT DOCUMENTS

| | | |
|---|---|---|
| JP | 3-272280 | 12/1991 |
| JP | 4-296200 | 10/1992 |
| JP | 6-113392 | 4/1994 |
| JP | 08-146974 | 6/1996 |
| JP | 8-146974 | 6/1996 |

(Continued)

OTHER PUBLICATIONS

Communication pursuant to Article 94 (3) EPC issued Jun. 22, 2011, from the European Patent Office in corresponding European Patent Office application No. 07 101 142.3-1224.

(Continued)

*Primary Examiner* — Vivian Chin
*Assistant Examiner* — Leshui Zhang
(74) *Attorney, Agent, or Firm* — Finnegan Henderson Farabow Garrett & Dunner LLP

(57) ABSTRACT

An audio signal processing apparatus includes: a division section that divides at least two or more channel audio signals into components in a plurality of frequency bands; a phase difference calculation section that calculates a phase difference between the two or more channel audio signals at each the frequency band; a level ratio calculation section that calculates a level ratio between the two or more channel audio signals at each the frequency band; a sound image localization estimation section that estimates, based on the level ratio or the phase difference, sound image localization at each the frequency band; and a control section that controls the estimated sound image localization at each the frequency band by adjusting the level ratio or the phase difference.

15 Claims, 29 Drawing Sheets

FOREIGN PATENT DOCUMENTS

| | | |
|---|---|---|
| JP | 09-251534 | 9/1997 |
| JP | 2002-78100 | 3/2002 |
| JP | 2003-264900 | 9/2003 |
| JP | 2004-325284 | 11/2004 |
| JP | 2005-151042 | 6/2005 |
| JP | 2005-244293 | 9/2005 |
| JP | 2005-295133 | 10/2005 |

OTHER PUBLICATIONS

European Search Report issued Sep. 7, 2010, from the Hague in corresponding European patent application No. EP 07 10 1142.

* cited by examiner

SOUND IMAGE LOCALIZATION BEFORE ZOOM CHANGE OPERATION

SOUND IMAGE LOCALIZATION AFTER ZOOM CHANGE OPERATION

AUDIO SIGNAL PROCESSING APPARATUS, AUDIO SIGNAL PROCESSING METHOD, AND AUDIO SIGNAL PROCESSING PROGRAM

CROSS REFERENCES TO RELATED APPLICATIONS

The present invention contains subject matter related to Japanese Patent Application JP2006-017977 filed in the Japanese Patent Office on Jan. 26, 2006, the entire contents of which being incorporated herein by reference.

BACKGROUND OF THE INVENTION

1. Field of the Invention

The present invention relates to an audio signal processing apparatus, audio signal processing method and audio processing program, and is preferably applied to the control of the spread of sound image by arbitrarily changing the position of sound image localization that a listener feels makes a predetermined angle inside a room or other acoustic spaces, for example.

2. Description of the Related Art

Usually, various audio sources are included in content recorded on Compact Disc (CD), Digital Versatile Disc (DVD) and the like, and audio signals such as TV broadcasting content. For instance, the music content may include voice and sound of instruments and the like. The TV broadcasting content may include voice of performers, effective sound, laughing voice, handclap sound and the like.

Those audio sources are usually recoded by separate microphones at the site. They are finally converted into audio signals with a predetermined number of channels, such as two-channel audio signals.

There are methods of Virtual Surround to make the listener feel bigger acoustic space than usual as for two-channel audio signals: a method in which a surround speaker outputs a waved signal of a difference between a right-channel audio signal and a left-channel audio signal; and a sound image and acoustic space control device with the capability of crosstalk canceller (see Jpn. Pat. Laid-open Publication No. H8-146974, for example) that outputs sound to cancel improper sound to allow the listener to locate a virtual audio source (the listener may not be able to locate the virtual audio source if the sound for a left ear reaches his/her right ear).

SUMMARY OF THE INVENTION

By the way, with the sound image and acoustic space control device with the capability of crosstalk canceller, because location of speakers and shape of rooms and the like are important, the Virtual Surround characteristics vary according to where the listener is listening to.

In addition, with the above method in which a surround speaker outputs a waved signal of a difference between a right-channel audio signal and a left-channel audio signal, because the effect of Virtual Surround is obtained by adding lots of reverb with delay times to the difference signal of the right- and left channel audio signals, the obtained sound may be different from the original sound, or may become hazy.

The present invention has been made in view of the above points and is intended to provide an audio signal processing apparatus, audio signal processing method and audio signal processing program that can provide the user with his/her desired acoustic space by controlling sound image without changing the quality of original sound of an audio source.

In one aspect of the present invention, an audio signal processing apparatus, an audio signal processing method and an audio signal processing program perform the processes of: dividing at least two or more channel audio signals into components in a plurality of frequency bands; calculating a phase difference between the two or more channel audio signals at each the frequency band; calculating a level ratio between the two or more channel audio signals at each the frequency band; estimating, based on the level ratio or the phase difference, sound image localization at each the frequency band; and controlling the estimated sound image localization at each the frequency band by adjusting the level ratio or the phase difference.

Accordingly, the localization position of the sound image localization at each frequency band can be placed more outward than the estimation to enlarge the sound images, or the localization position of the sound image localization at each frequency band can be placed more inward to narrow the sound images. That can produce an acoustic space in line with the user's preference.

According to the present invention, the localization position of the sound image localization at each frequency band can be placed more outward than the estimation to enlarge the sound images, or the localization position of the sound image localization at each frequency band can be placed more inward to narrow the sound images. That can produce an acoustic space in line with the user's preference. Thus, the audio signal processing apparatus, the audio signal processing method and the audio signal processing program can provide the user with his/her desired acoustic space by controlling sound image without changing the quality of original sound of an audio source.

The nature, principle and utility of the invention will become more apparent from the following detailed description when read in conjunction with the accompanying drawings in which like parts are designate by like reference numerals or characters.

DETAILED DESCRIPTION OF THE PREFERRED EMBODIMENTS

Figure 1:
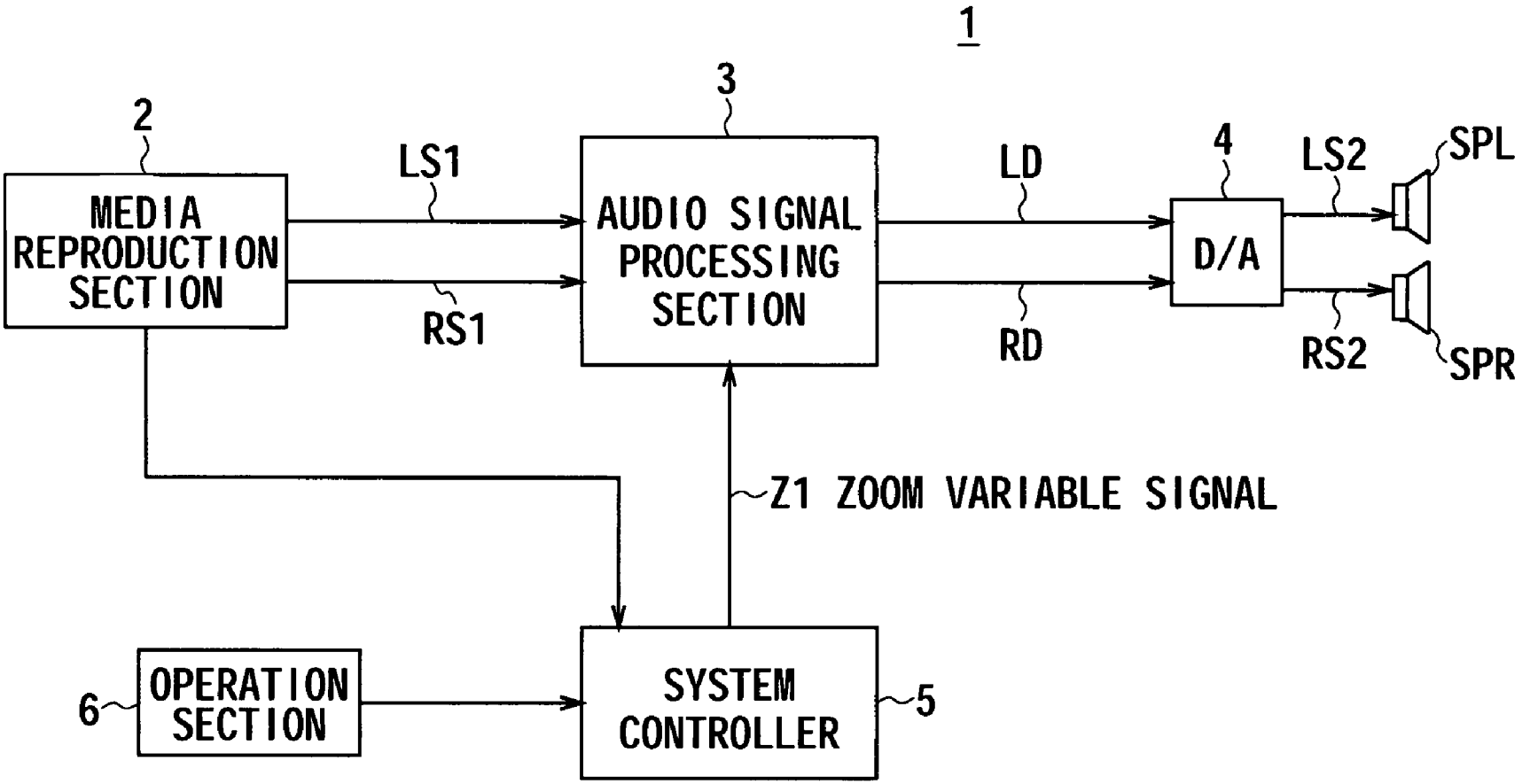
FIG. 1 is a schematic block diagram illustrating the configuration of a playback device according to a first embodiment of the present invention.

An embodiment of the present invention will be described in detail with reference to the accompanying drawings.

(1) Basic Concept

In one aspect of the present invention, the effect of Virtual Surround is enhanced in the following manner: the sound image of various sources included in audio signals with more than two channels can be enlarged or narrowed in accordance with the user's preference; and the spread of sound image is controlled without changing the quality of original sound of the audio signals.

Generally, because the sound image localization attributes to listener's feeling, it may not be expressed by mathematical formulas. If the stereo audio signals of Lch and Rch are the same, the listener may feel like its audio source (sound image) is at the middle point between a left speaker and a right speaker. If the audio signals are only included in Lch, the listener may feel like its audio source (sound image) is close to the left speaker.

The location of sound image, which is recognized or felt by the listener, will be also referred to as "sound image localization". The angle of the sound image localization with respect to a certain point (where the listener is listening to, for example) will be also referred to as "localization angle".

There are various methods on sound image localization. For example, there is a method to make the listener feel that an audio source is at a particular point (in a particular direction) in an acoustic space based on phase difference (time difference) of audio signals that will reach the listener's ears and ratio of levels (ratio of sound pressure levels). This performs the Fourier transformation process on the audio signals from the audio source, and adds frequency-dependent level ratios and phase differences to each channel of the audio signals on a frequency axis to place the sound image in a particular direction.

On the contrary, in an embodiment of the present invention, the phase differences and level ratios of each channel (Lch and Rch) of the audio signals are used as information to indicate an angle of an audio source located. Accordingly, the localization angle of the audio source (or a point where the audio source is located (localization point)) can be estimated from analyzing the phase differences of each channel of the audio signals and the level ratios of each channel of the audio signals.

In addition to which, adjusting the phase differences and level ratios of each channel of the audio signals arbitrarily changes the estimated localization angle of the audio source, and re-mapping of the sound image is performed to place the sound image beyond an expected localization point (this process will be referred to as "zoom up"), or re-mapping of the sound image is performed to place the sound image inside (this process will be referred to as "zoom down"). This can provide the listener with the sound image localization where the localization angle is adjusted in line with his/her preference without changing the quality of original sound, and provide a three-dimensional acoustic space he/she desires.

(2) First Embodiment

(2-1) Configuration of Playback Device

In FIG. 1, the reference numeral 1 denotes a playback device according to a first embodiment of the present invention. A system controller 5, or a microcomputer, performs a predetermined audio signal processing program to take overall control of the device 1. A media reproduction section 2, for example, reproduces a Lch audio signal LS1 and a Rch audio signal RS1 from various storage media, such as an optical disc storage media (CD, DVD, "Blue-Ray Disc (Registered Trademark)", and the like), "Mini Disc (Registered Trademark of Sony Corporation)", magnetic disks (hard disk and the like) or semiconductor memories. The media reproduction section 2 then supplies the Lch audio signal LS1 and the Rch audio signal RS1 to an audio signal processing section 3.

The audio signal processing section 3 performs, in accordance with a zoom variable signal Z1 that is supplied from an operation section 6 via the system controller 5 to perform zoom-up or zoom-down, a signal processing on the Lch audio signal LS1 and Rch audio signal RS1 supplied from the media reproduction section 2 to control the sound image localization. The audio signal processing section 3 then supplies resulting Lch audio data LD and Rch audio data RD to a digital-to-analog converter 4.

The digital-to-analog converter 4 performs a digital-to-analog conversion process on the audio data LD and RD to obtain an Lch audio signal LS2 and a Rch audio signal RS2. A left speaker SPL and a right speaker SPR output sound based on the Lch audio signal LS2 and the Rch audio signal RS2.

The system controller 5 is, for example, equivalent to a microcomputer including Central Processing Unit (CPU), Read Only Memory (ROM) and Random Access Memory (RAM). The system controller 5 performs a predetermined audio signal processing program to take overall control of the playback device 1.

The system controller 5 controls the media reproduction section 2 and the audio signal processing section 3 to perform various process based on a command signal input from the operation section 6, such as playback command, stop command or zoom variable command.

(2-2) Circuit Configuration of Audio Signal Processing Section

Figure 2:
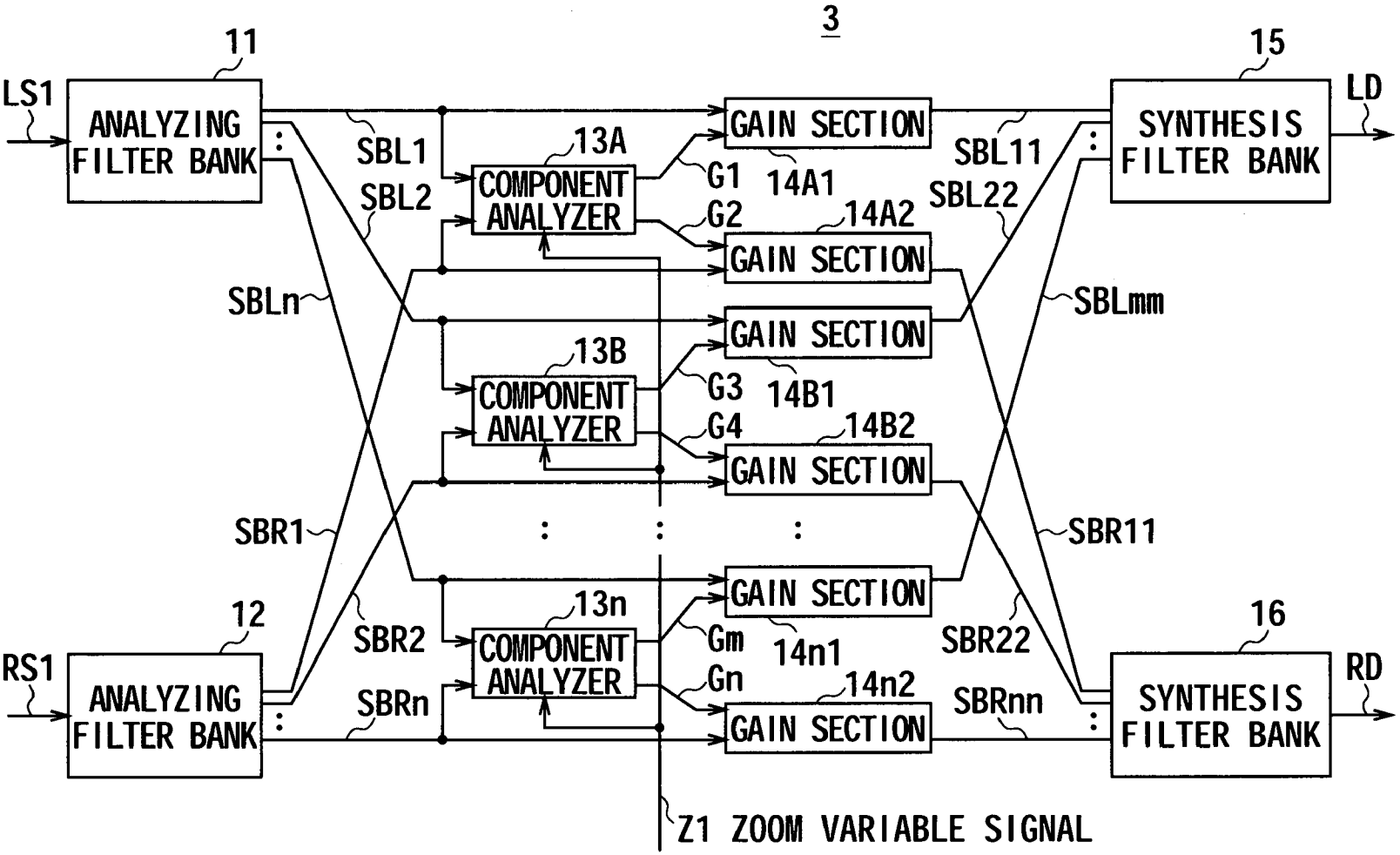
FIG. 2 is a schematic block diagram illustrating the circuit configuration of an audio signal processing section according to a first embodiment of the present invention.

As shown in FIG. 2, the audio signal processing section 3 includes: an analyzing filter bank 11, to which the Lch audio signal LS1 is input; and an analyzing filter bank 12, to which the Rch audio signal RS1 is input. The analyzing filter banks 11 and 12 separates the Lch audio signal LS1 and the Rch audio signal RS1 into a plurality of components, each one carrying an equivalent or non-equivalent frequency band of the audio signals. This generates a plurality of subband signals SBL1 to SBLn and SBR1 to SBRn. The subband signals SBL1 to SBLn and SBR1 to SBRn are supplied to component analyzers 13A, 13B, . . . , and 13*n* and gain sections 14A1, 14A2, 14B1, 14B2, . . . , 14*n*1, 14*n*2.

The method of the analyzing filter banks 11 and 12 to separate the audio signals LS1 and RS1 into a plurality of components may include Discrete Fourier Transform (DFT) filter bank, Wavelet filter bank, Quadrature Mirror Filter (QMF) and the like.

In this case, the Lch subband signal SBL1 and the Rch subband signal SBR1 are in the same frequency band. Both signals SBL1 and SBR1 are supplied to the component analyzer 13A. The subband signal SBL1 is supplied to the gain section 14A1 while the subband signal SBR1 is supplied to the gain section 14A2.

Moreover, the Lch subband signal SBL2 and the Rch subband signal SBR2 are in the same frequency band. Both signals SBL2 and SBR2 are supplied to the component analyzer 13B. The subband signal SBL2 is supplied to the gain section 14B1 while the subband signal SBR2 is supplied to the gain section 14B2.

Furthermore, the Lch subband signal SBLn and the Rch subband signal SBRn are in the same frequency band. Both signals SBLn and SBRn are supplied to the component analyzer 13Bn. The subband signal SBLn is supplied to the gain section 14*n*1 while the subband signal SBRn is supplied to the gain section 14*n*2.

The component analyzer 13A analyzes the phase difference between the Lch subband signal SBL1 and the Rch subband signal SBR1 and their level ratios to estimate the localization angle of sound images based on the subband signals SBL1 and SBR1. The component analyzer 13A then determines, based on the estimated localization angle and the zoom variable signal Z1 supplied from the system controller 5, gain values G1 and G2, and supplies the gain values G1 and G2 to the gain sections 14A1 and 14A2, respectively.

The gain section 14A1 multiplies the subband signal SBL1 supplied from the analyzing filter bank 11 by the gain value G1 supplied from the component analyzer 13A to generate a subband signal SBL11, and then supplies the subband signal SBL11 to a synthesis filter bank 15. The gain section 14A2 multiplies the subband signal SBR1 supplied from the analyzing filter bank 12 by the gain value G2 supplied from the component analyzer 13A to generate a subband signal SBR11, and then supplies the subband signal SBR11 to a synthesis filter bank 16.

In a similar way to that of the component analyzer 13A, the component analyzer 13B analyzes the phase difference between the Lch subband signal SBL2 and the Rch subband signal SBR2 and their level ratios to estimate the localization angle of sound images based on the subband signals SBL2 and SBR2. The component analyzer 13B then determines, based on the estimated localization angle and the zoom variable signal Z1 supplied from the system controller 5, gain values G3 and G4, and supplies the gain values G3 and G4 to the gain sections 14B1 and 14B2, respectively.

The gain section 14B1 multiplies the subband signal SBL2 supplied from the analyzing filter bank 11 by the gain value G3 supplied from the component analyzer 13B to generate a subband signal SBL22, and then supplies the subband signal SBL22 to the synthesis filter bank 15. The gain section 14B2 multiplies the subband signal SBR2 supplied from the analyzing filter bank 12 by the gain value G4 supplied from the component analyzer 13B to generate a subband signal SBR22, and then supplies the subband signal SBR22 to the synthesis filter bank 16.

In a similar way to that of the component analyzers 13A and 13B, the component analyzer 13*n* analyzes the phase difference between the Lch subband signal SBLn and the Rch subband signal SBRn and their level ratios to estimate the localization angle of sound images based on the subband signals SBLn and SBRn. The component analyzer 13*n* then determines, based on the estimated localization angle and the zoom variable signal Z1 supplied from the system controller 5, gain values Gm and Gn, and supplies the gain values Gm and Gn to the gain sections 14*n*1 and 14*n*2, respectively.

The gain section 14*n*1 multiplies the subband signal SBLn supplied from the analyzing filter bank 11 by the gain value Gm supplied from the component analyzer 13*n* to generate a subband signal SBLmm, and then supplies the subband signal SBLmm to the synthesis filter bank 15. The gain section 14*n*2 multiplies the subband signal SBRn supplied from the analyzing filter bank 12 by the gain value Gn supplied from the component analyzer 13*n* to generate a subband signal SBRnn, and then supplies the subband signal SBRnn to the synthesis filter bank 16.

The synthesis filter bank 15 synthesizes the subband signals SBL11, SBL22, . . . , SBLmm, which are supplied from the gain sections 14A1, 14B1, . . . , 14*n*1, to produce a Lch audio signal LD, and then supplies the Lch audio signal LD to the digital-to-analog converter 4 (FIG. 1). The synthesis filter bank 16 synthesizes the subband signals SBR11, SBR22, . . . , SBRnn, which are supplied from the gain sections 14A2, 14B2, . . . , 14*n*2, to produce a Rch audio signal RD, and then supplies the Rch audio signal RD to the digital-to-analog converter 4 (FIG. 1).

If a command signal that orders, based on the user's instruction, zoom-up or zoom-down of sound image is not supplied to the audio signal processing section 3, the system controller 5 does not supply the zoom variable signal Z1 to the component analyzers 13A1, 13A2, . . . , and 13*n*2. The subband signals SBL1, SBL2, and SBLn, which are supplied from the analyzing filter bank 11, are simply supplied to the synthesis filter bank 15 without gain adjustment. The subband signals SBR1, SBR2, . . . , and SBRn, which are supplied from the analyzing filter bank 12, are simply supplied to the synthesis filter bank 16 without gain adjustment.

(2-3) Circuit Configuration of Component Analyzer

The circuit configuration of the above component analyzers 13A, 13B, . . . , and 13*n* will be described. Their circuit configurations are all the same, and, therefore, only the circuit configuration of the component analyzer 13A will be described.

Figure 3:
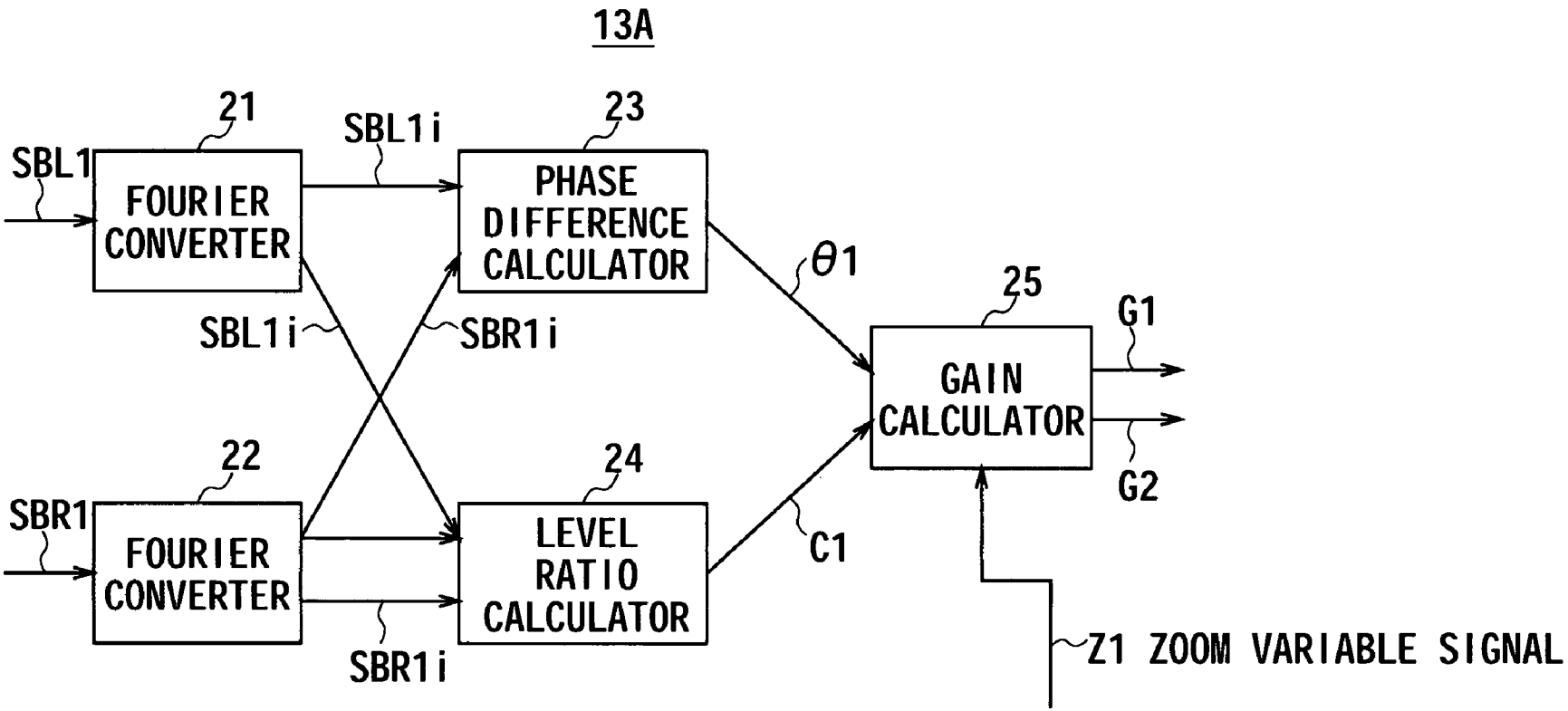
FIG. 3 is a schematic block diagram illustrating the circuit configuration of a component analyzer.

As shown in FIG. 3, the component analyzer 13A supplies the subband signal SBL1, which is supplied from the analyzing filter bank 11 (FIG. 2), to a Fourier converter 21, and the subband signal SBR1, which is supplied from the analyzing filter bank 12 (FIG. 2), to a Fourier converter 22.

The Fourier converters 21 and 22 perform a Fourier transformation process on the subband signals SBL1 and SBR1, respectively. The Fourier converters 21 and 22 then supplies resulting complex subband signals SBL1*i* and SBR1*i* to a phase difference calculator 23 and a level ratio calculator 24.

The phase difference calculator 23 calculates a phase difference θ1 which is a difference between the complex subband signal SBL1*i* supplied from the Fourier converter 21 and the complex subband signal SBR1*i* supplied from the Fourier converter 22. The phase difference calculator 23 then supplies the phase difference θ1 to a gain calculator 25.

The level ratio calculator 24 calculates a level ratio C1 which is a ratio of the complex subband signal SBL1*i* supplied from the Fourier converter 21 to the complex subband signal SBR1*i* supplied from the Fourier converter 22. The level ratio calculator 24 then supplies the level ratio C1 to the gain calculator 25.

The gain calculator 25 determines gain values G1 and G2 based on the phase difference θ1 supplied from the phase difference calculator 23, the level ratio C1 supplied from the level ratio calculator 24 and the zoom variable signal Z1 supplied from the system controller 5. The gain calculator 25 then outputs the gain values G1 and G2.

Accordingly, the audio signal processing section 3 can make the following data bigger or smaller than before the signal processing: the phase difference and level ratio between the subband signal SBL1 which is multiplied by the gain value G1 by the gain section 14A1 (FIG. 2) and the subband signal SBR1 which is multiplied by the gain value G2 by the gain section 14A2 (FIG. 2).

Therefore, the audio signal processing section 3 outputs the following sound through the left speaker SPL and the right speaker SPR: the sound of the audio signal LD included in the subband signal SBL1 generated by the synthesis filter bank 15 and the sound of the audio signal RD included in the subband signal SBR1 generated by the synthesis filter bank 16. At this time, it is easy for the audio signal processing section 3 to enlarge or narrow the sound image of audio sources corresponding to frequency bands of the subband signals SBL1 and SBR1.

In reality, to change the localization angle of sound image localization, the level ratio of left- and right-channels is controlled by a sound mixer at a recording studio and the like, for example. Accordingly, it is apparent that the localization angle of sound images can be changed by controlling the level ratio of the Lch audio signal to the Rch audio signal.

For example, when the localization angle of a sound image of the subband signal around 8000 Hz is changed by turning this sound image, which is currently tilted at 30 degrees to the right, to be tilted at 45 degrees to the right, the left- and right-channels level ratio is 1:2 as for the sound image whose localization angle is 30 degrees to the right. In this case, the above gain values G1 and G2 are determined such that the level ratio becomes 1:3. Adjusting an amplitude level of the left- and right-channels subband signals based on those gain values G1 and G2 can change the localization angle of the sound image to get the sound image, which was tilted at 30 degrees to the right, to be tilted at 45 degrees to the right.

Generally, it is well known that, as for the subband signals whose frequency bands are below about 3500 Hz, the phase differences are more important than the left- and right-channels level ratio to determine the localization angles. Accordingly, as for the signals below 3500 Hz, the phase differences of the subband signals are often adjusted, instead of the adjustment of the level ratio of the Lch and Rch subband signals. By the way, it is also possible to adjust both the level ratio and the phase differences to change the localization angles of sound images.

(2-4) Sound Images' Zoom-Up and Zoom-Down

There are various patterns about the localization angles of the sound image localization before or after zoom-up or zoom-down of the sound images by the audio signal processing section 3. The following describes several examples thereof.

Figure 4:
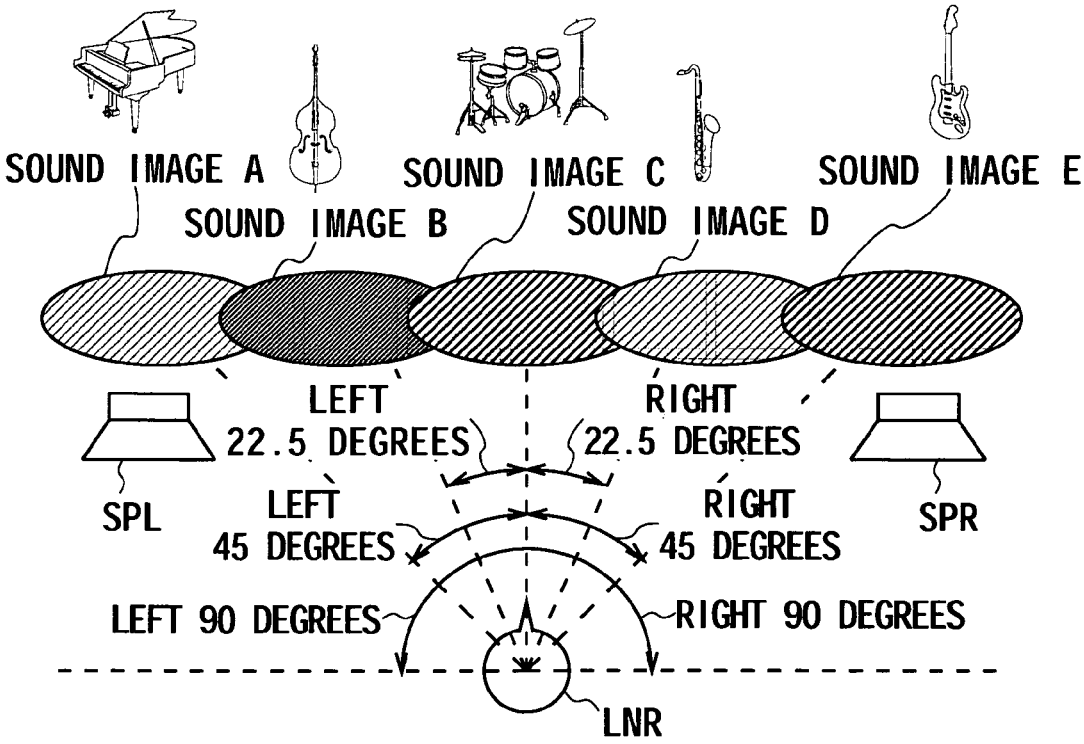
FIG. 4 is a schematic diagram illustrating sound image localization before re-mapping.

In FIG. 4, as for the sound image localization before the zoom-up or zoom-down signal processing of the audio signal processing section 3, there are five sound images A, B, C, D and E from the left to the right, with respect to a listener LNR who is sitting at the middle point between the left speaker SPL and the right speaker SPR, for example: an audio source of the sound image A is pianos; an audio source of the sound image B is bass guitars; an audio source of the sound image C is drums; an audio source of the sound image D is saxophones; and an audio source of the sound image E is guitars.

With respect to the listener LNR, the localization angle of the sound image C is 0 degrees because the sound image C is in front of the listener LNR. The localization angle of the sound image D is 22.5 degrees to the right. The localization angle of the sound image B is 22.5 degrees to the left. The localization angle of the sound image E is 45 degrees to the right. The localization angle of the sound image A is 45 degrees to the left.

(2-4-1) Even Enlargement

Figure 5:
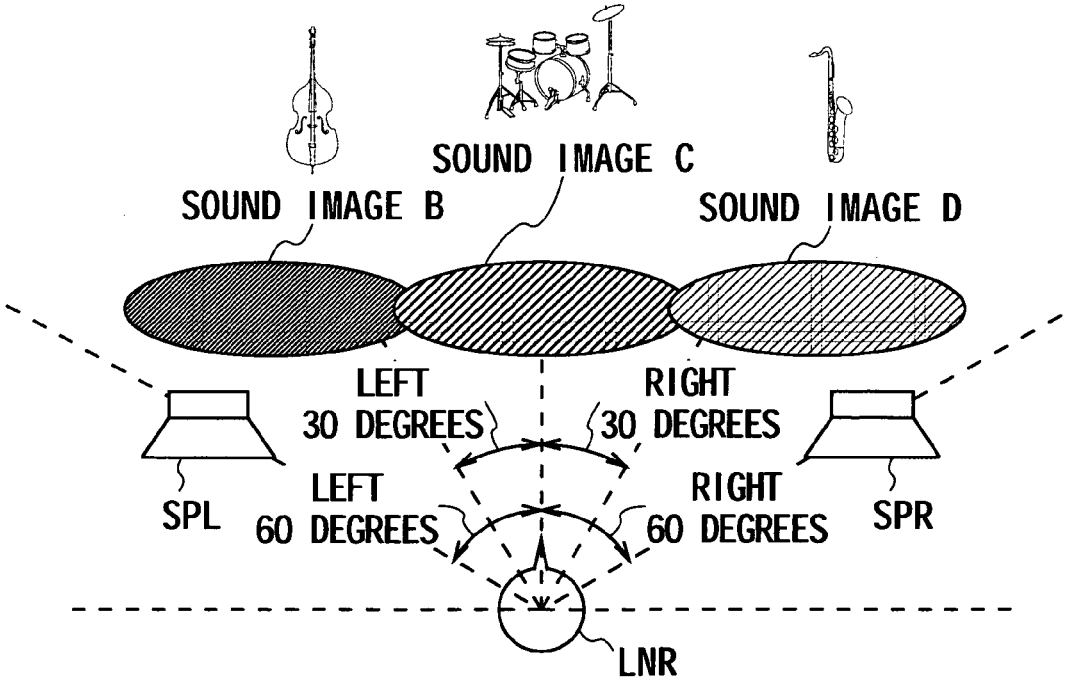
FIG. 5 is a schematic diagram illustrating sound image localization where sound images are evenly enlarged.

As shown in FIG. 5, when the audio signal processing section 3 evenly enlarges, or zooms up, the sound images A to E (FIG. 4) in response to the zoom variable signal Z1 supplied form the system controller 5 (FIG. 1), the position of the sound image C remains unchanged because it is at the center. However, the localization angle of the sound image D becomes 30 degrees to the right; the localization angle of the sound image B becomes 30 degrees to the left; the localization angle of the sound image E becomes 60 degrees to the right; and the localization angle of the sound image A becomes 60 degrees to the left.

From the listener LNR's point of view, the positions of the sound images A and E has moved beyond the left speaker SPL and the right speaker SPR. As that happens, the audio signal processing section 3 stops outputting the subband signals of the sound images A and E. This prevents the listener LNR from recognizing the audio sources of those sound images A and E, or pianos and guitars.

In this case, the audio signal processing section 3 stops outputting the subband signals of the sound images A and E. Alternatively, the audio signal processing section 3 may not stop outputting the subband signals of the sound images A and E, which are beyond the left speaker SPL and the right speaker SPR, in line with the user's preference.

Figure 6:
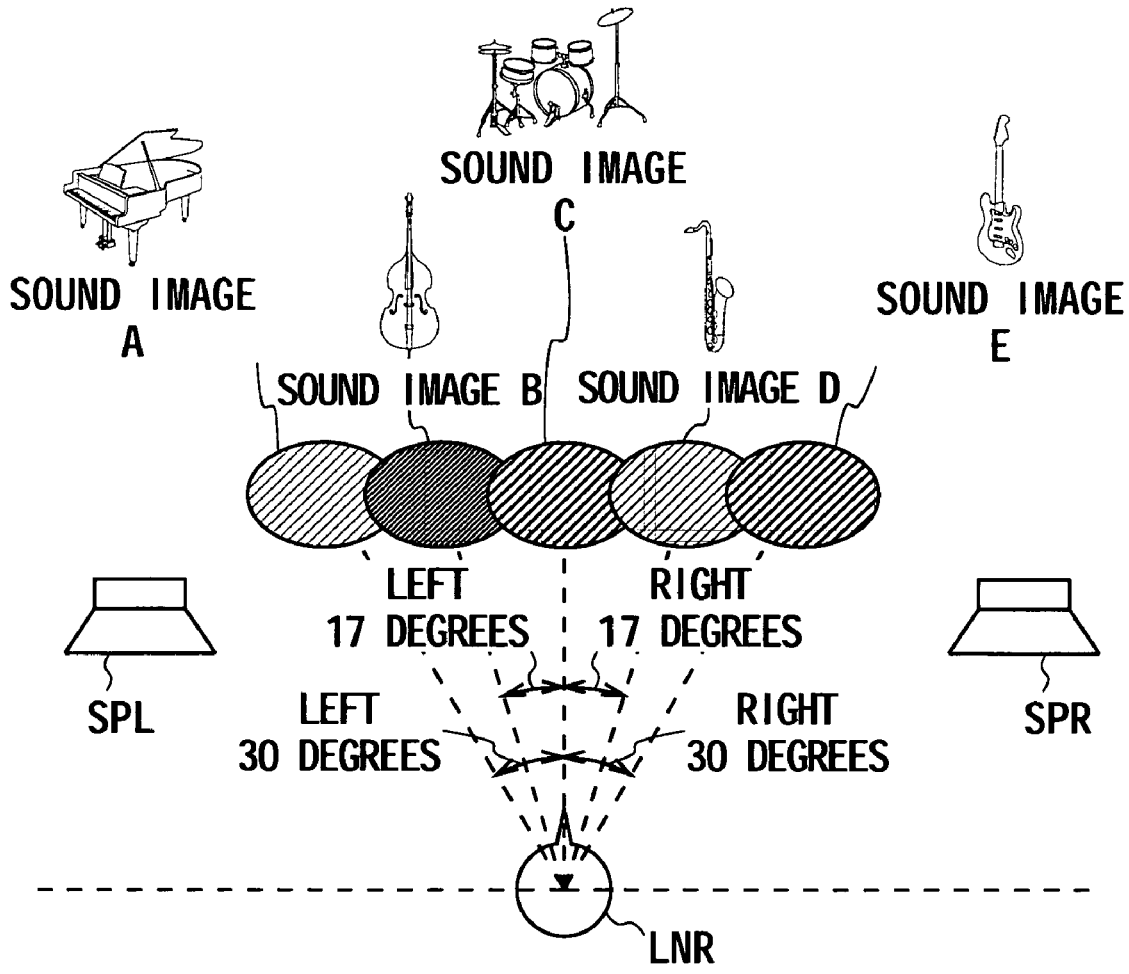
FIG. 6 is a schematic diagram illustrating sound image localization where sound images are evenly narrowed.

As shown in FIG. 6, when the audio signal processing section 3 evenly narrows, or zooms down, the sound images A to E in response to the zoom variable signal Z1 supplied form the system controller 5 (FIG. 1), the position of the sound image C remains unchanged because it is at the center. However, the localization angle of the sound image D becomes 17 degrees to the right; the localization angle of the sound image B becomes 17 degrees to the left; the localization angle of the sound image E becomes 30 degrees to the right; and the localization angle of the sound image A becomes 30 degrees to the left.

In this manner, all the sound images A to E gathers at the middle point between the left speaker SPL and the right speaker SPR. In this case, the audio signal processing section 3 does not stop outputting the subband signals of the sound images A and E.

Figure 7:
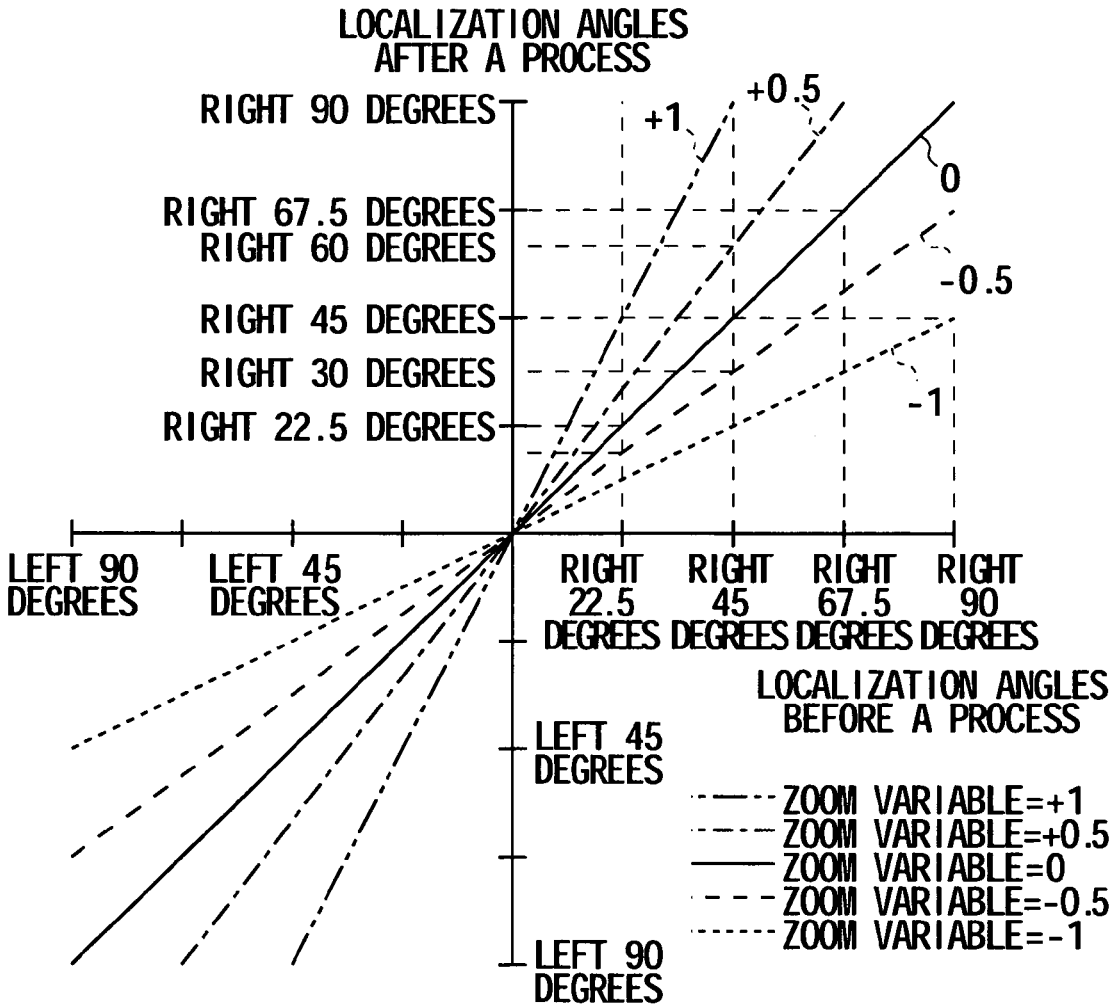
FIG. 7 is a schematic diagram illustrating the localization angles before and after re-mapping.

FIG. 7 shows the relationship between the localization angles which change in accordance with the zoom variables of the zoom variable signal Z1: the localization angles of the sound images A to E before or after the audio signal process (re-mapping) of the audio signal processing section 3. A horizontal axis represents the localization angles before the signal process while a vertical axis represents the localization angles after the signal process.

For example, when the system controller 5 (FIG. 2) supplies the zoom variable signal Z1 whose zoom variable is "0" to the audio signal processing section 3, the localization angles of the sound images A to E before the signal process of the audio signal processing section 3 is the same as that of the sound images A to E after the signal process of the audio signal processing section 3. Thus, the sound images A to E remain unchanged.

When the system controller 5 supplies the zoom variable signal Z1 whose zoom variable is "+0.5" or "+1" to the audio signal processing section 3, the localization angles of the sound images A to E after the signal process of the audio signal processing section 3 becomes bigger than that of the sound images A to E before the signal process of the audio signal processing section 3, as indicated by one-dot and two-dot chain lines. This means that the sound images A to E become enlarged due to the positive zoom variables, as shown in FIG. 5.

For example, when the zoom variable is set as "+1", the localization angle of the sound image E is changed from 45 degrees to the right (before the signal process) to 90 degrees to the right (after the signal process). By the way, if the localization angle is left 90 degrees before the signal process, the system controller 5 stops outputting its subband signals.

When the system controller 5 supplies the zoom variable signal Z1 whose zoom variable is "−0.5" or "−1" to the audio signal processing section 3, the localization angles of the sound images A to E after the signal process of the audio signal processing section 3 becomes smaller than that of the sound images A to E before the signal process of the audio signal processing section 3, as indicated by broken and dotted lines. This means that the sound images A to E become narrowed due to the negative zoom variables, as shown in FIG. 6.

For example, when the zoom variable is set as "−1", the localization angle is changed from 90 degrees to the right (before the signal process) to 45 degrees to the right (after the signal process). By the way, if the localization angle is left 90 degrees before the signal process, the system controller 5 stops outputting its subband signals.

(2-4-2) Put Importance on the Center

Figure 8:
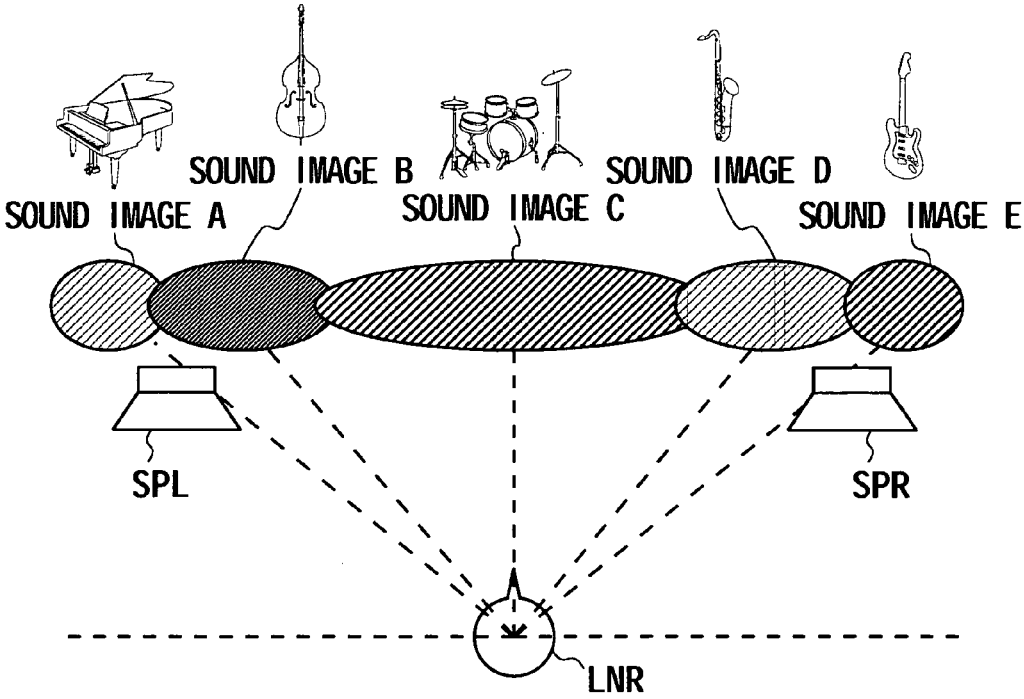
FIG. 8 is a schematic diagram illustrating sound image localization where a center sound image is enlarged with the sound images at both sides being narrowed.

In FIG. 8, in response to the zoom variable signal Z1 supplied from the system controller 5 (FIG. 1), the audio signal processing section 3 enlarges the sound image C at the center while narrowing the sound images A and E at the both ends. In this case, the sound image C becomes dominant in front of the listener LNR.

Accordingly, the position of the sound image C remains at the center while the sound images A, B, D and E moves outward due to the expansion of the sound image C. In this manner, the localization points of the sound images A, B, D and E change.

Figure 9:
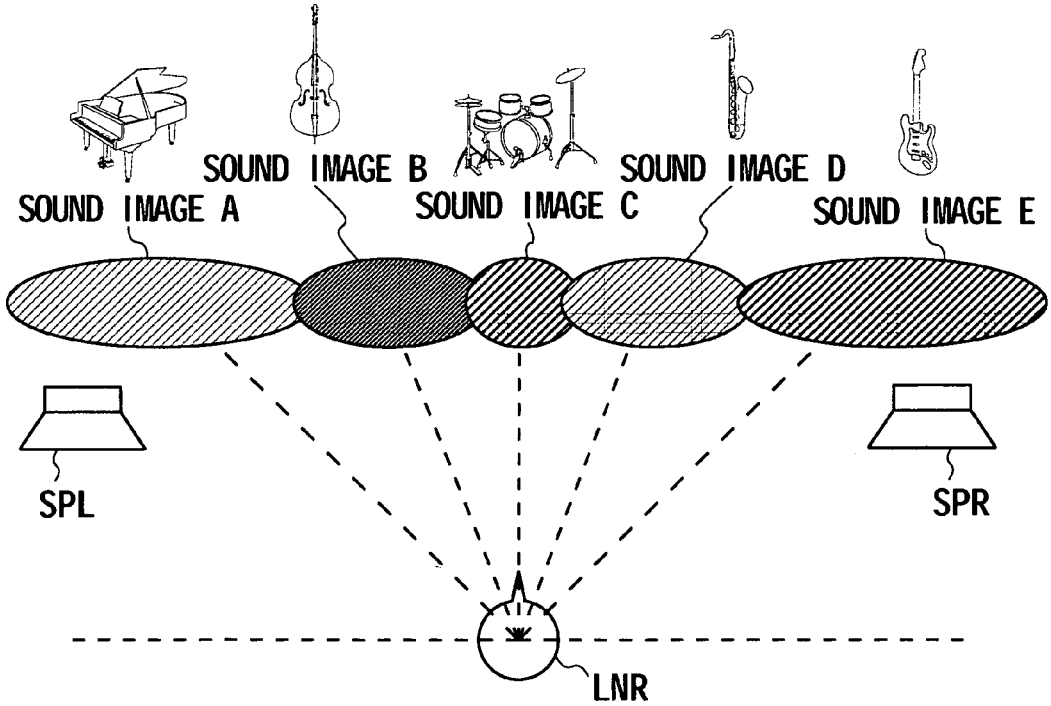
FIG. 9 is a schematic diagram illustrating sound image localization where a center sound image is narrowed with the sound images at both sides being enlarged.

In FIG. 9, in response to the zoom variable signal Z1 supplied from the system controller 5 (FIG. 1), the audio signal processing section 3 narrows the sound image C at the center while enlarging the sound images A and E at the both ends. In this case, the sound image C at the center and the adjacent sound images B and D move inward.

Figure 10:
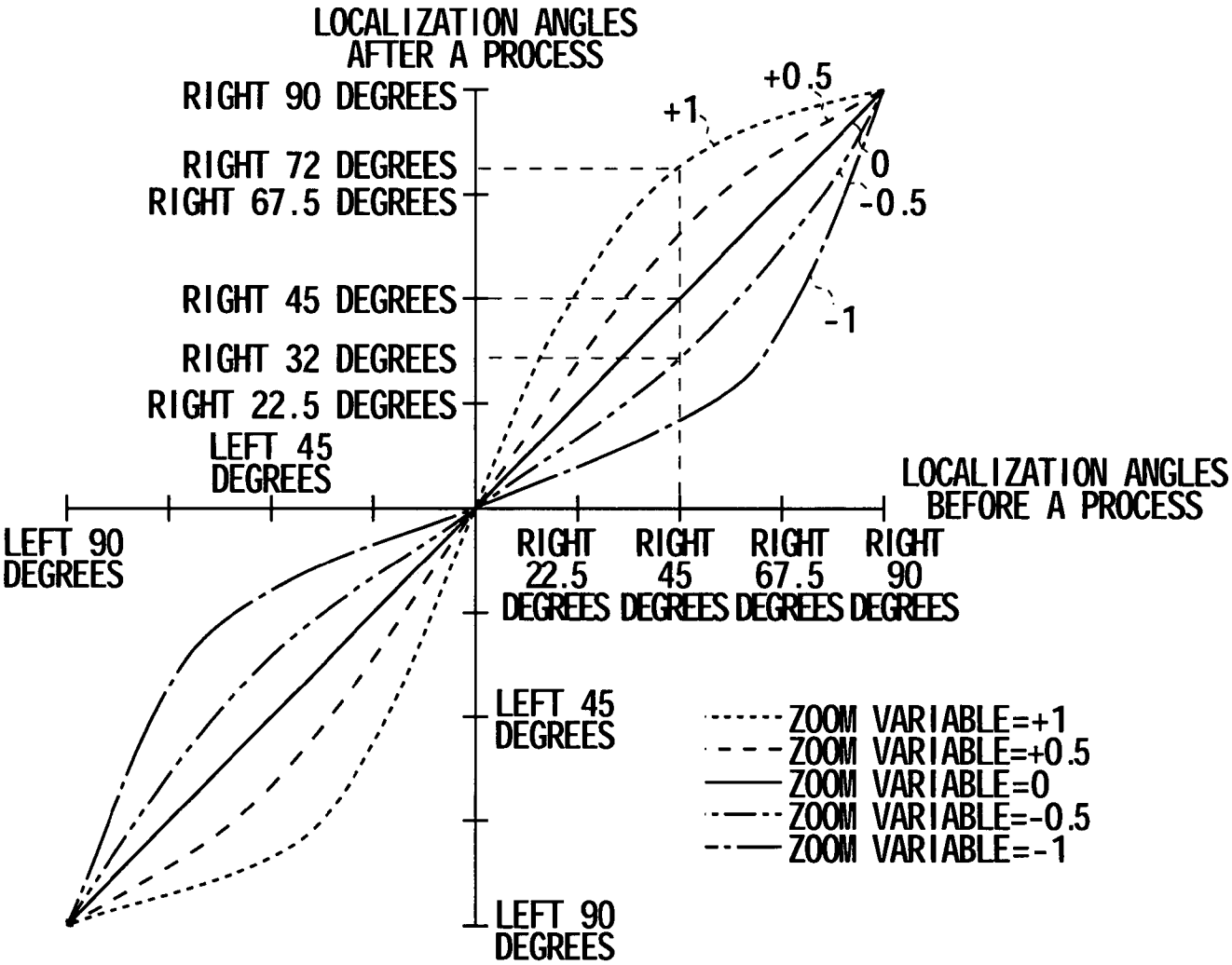
FIG. 10 is a schematic diagram illustrating the localization angles before and after re-mapping.

FIG. 10 shows the relationship between the localization angles which change in accordance with the zoom variables of the zoom variable signal Z1: the localization angles of the sound images A to E before or after the audio signal process of the audio signal processing section 3. A horizontal axis represents the localization angles before the signal process while a vertical axis represents the localization angles after the signal process.

For example, when the system controller 5 (FIG. 2) supplies the zoom variable signal Z1 whose zoom variable is "0" to the audio signal processing section 3, the localization angles of the sound images A to E before the signal process of the audio signal processing section 3 is the same as that of the sound images A to E after the signal process of the audio signal processing section 3. Thus, the sound images A to E remain unchanged.

When the system controller 5 supplies the zoom variable signal Z1 whose zoom variable is "+0.5" or "+1" to the audio signal processing section 3, the localization angles of the sound images A to E after the signal process of the audio signal processing section 3 becomes nonlinearly bigger than that of the sound images A to E before the signal process of the audio signal processing section 3, as indicated by broken and dotted lines. This means that the sound image C at the center becomes enlarged due to the positive zoom variables while the sound images A and E at the both ends become narrowed, as shown in FIG. 8.

For example, when the zoom variable is set as "+1", the localization angle is changed from 45 degrees to the right (before the signal process) to 72 degrees to the right (after the signal process). By the way, if the localization angle is left 90 degrees before the signal process, the system controller 5 does not change the localization angle.

When the system controller 5 supplies the zoom variable signal Z1 whose zoom variable is "−0.5" or "−1" to the audio signal processing section 3, the localization angles of the sound images A to E after the signal process of the audio signal processing section 3 becomes nonlinearly smaller than that of the sound images A to E before the signal process of the audio signal processing section 3, as indicated by one-dot and two-dot chain lines. This means that the sound image C at the center becomes narrowed due to the negative zoom variables while the sound images A and E at the both sides become enlarged, as shown in FIG. 9.

For example, when the zoom variable is set as "−1", the localization angle is changed from 45 degrees to the right (before the signal process) to 32 degrees to the right (after the signal process). By the way, if the localization angle is left 90 degrees before the signal process, the system controller 5 does not change the localization angle.

(2-5) Procedure of Localization Angle Change Process

Figure 11:
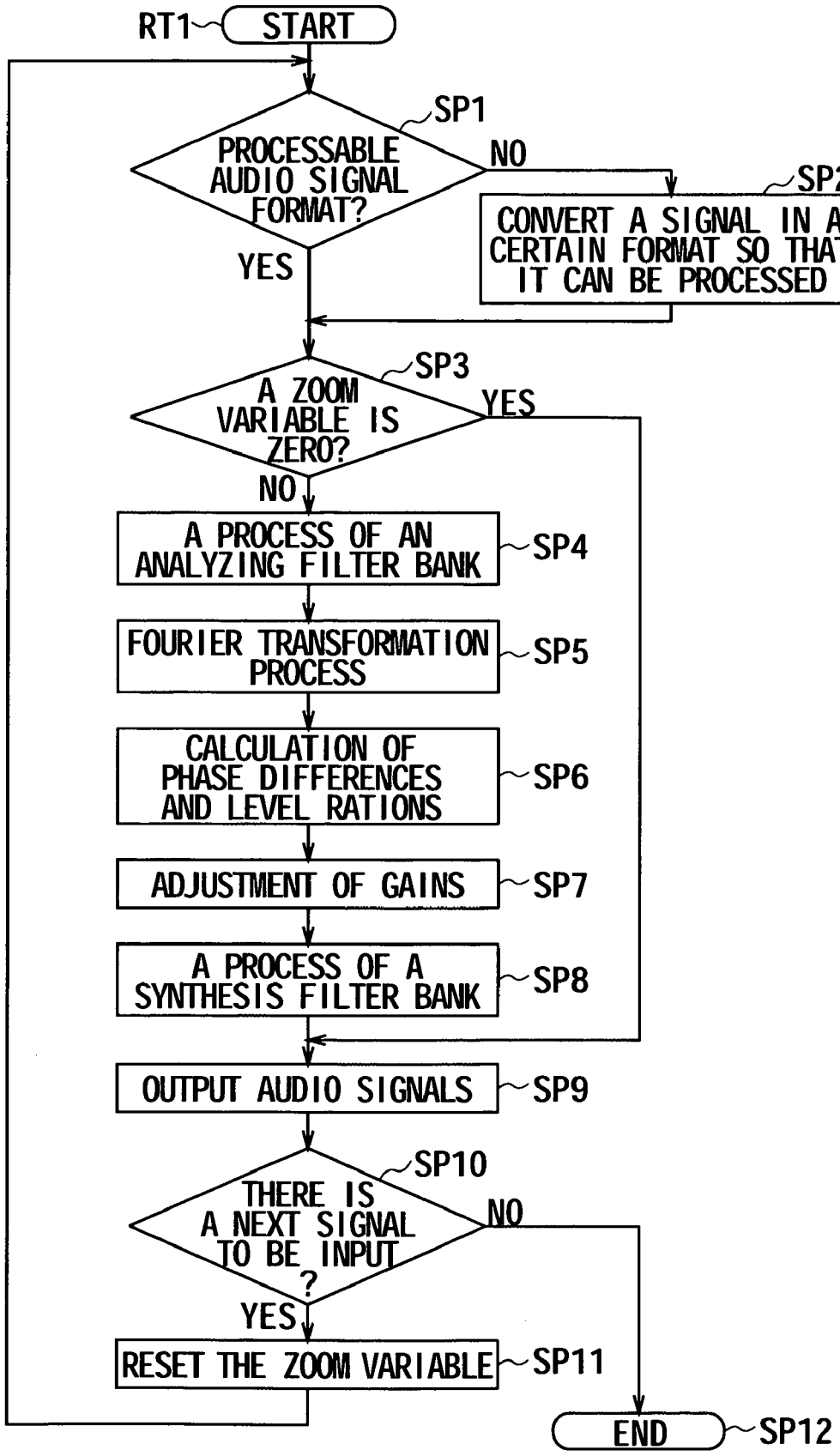
FIG. 11 is a flowchart illustrating a procedure of a localization angle change process according to a first embodiment of the present invention.

FIG. 11 is a flowchart illustrating a procedure of a process of changing the localization angles of the sound images A to E.

The system controller 5 of the playback device 1 starts a routine RT1 from start step, and then proceeds to next step SP1. At step SP1, the system controller 5 checks whether the Lch audio signal LS1 and Rch audio signals RS1, which will be input into the analyzing filter banks 11 and 12 of the audio signal processing section 3 via the media reproduction section 2, have been converted into a certain signal format that allows changing the localization angle.

For example, if the audio signals LS1 and RS1 have been compressed in the MPEG-1 Audio Layer 3 (MP3) format or the like or if their frequencies are different from a sampling frequency of an expected signal format, the system controller 5 may not be able to change their localization angle unless those signals are converted into a certain signal format that allows changing the localization angle.

Accordingly, when the affirmative result is obtained at step SP1 the system controller 5 proceeds to next step SP3. By contrast, the negative result at step SP1 means that the audio signal processing section 3 may not be able to change the localization angles of the sound image localization of the audio signals LS1 and RS1, and, therefore, the system controller 5 proceeds to next step SP2.

At step SP2, the system controller 5 converts the audio signals LS1 and RS1 in a certain signal format to change the localization angles, and then proceeds to next step SP3.

At step SP3, the system controller 5 checks whether the zoom variable signal Z1, which will be transmitted to the audio signal processing section 3 in response to the user's operation, is "0".

The affirmative result at step SP3 means that the zoom variable is "0". It means that the command signal that initiates the process of changing the localization angles is not supplied. In this case, the system controller 5 does not perform the process of changing the localization angles by the audio signal processing section 3, and then proceeds to step SP9.

The negative result at step SP3 means that the zoom variable is not "0". It means that the command signal that initiates the process of changing the localization angles is supplied. In this case, the system controller 5 proceeds to next step SP4 to perform the process of changing the localization angles by the audio signal processing section 3.

At step SP4, the system controller 5 controls the analyzing filter bank 11 of the audio signal processing section 3 to separate the Lch audio signal LS1 into a plurality of components with different frequency bands. The system controller 5 also controls the analyzing filter bank 12 of the audio signal processing section 3 to separate the Rch audio signal RS1 into a plurality of components with different frequency bands. The system controller 5 subsequently supplies the resulting subband signals SBL1 to SBLn and SBR1 to SBRn to the Fourier converters 21 and 22 of the component analyzers 13A to 13*n*, and then proceeds to next step SP5.

At step SP5, the system controller 5 controls the Fourier converters 21 and 22 of the component analyzers 13A to 13*n* to perform a Fourier transformation process to the subband signals SBL1 to SBLn and SBR1 to SBRn. The system controller 5 subsequently supplies the resulting complex subband signals SBL1*i* to SBLni and SBR1*i* to SBRni to the phase difference calculator 23 and the level ratio calculator 24, and then proceeds to next step SP6.

At step SP6, the system controller 5 calculates the phase difference G1 and the level ratio C1 by the phase difference calculator 23 and the level ratio calculator 24 of the component analyzers 13A to 13*n*, supplies the phase difference 91 and the level ratio C1 to the gain calculator 25, and then proceeds to next step SP7.

At step SP7, the system controller 5 determines the gain values G1 and G2 based on the phase difference θ1, the level ratio C1 and the zoom variable of the zoom variable signal Z1, and uses these gain values G1 and G2 to control the gains of the subband signals SBL1 to SBLn and SBR1 to SBRn by the gain sections 14A1 to 14*n*2 of the audio signal processing section 3. The system controller 5 supplies the resulting subband signals SBL11 to SBLmm and SBR11 to SBRnn to the synthesis filter banks 15 and 16, respectively. The system controller 5 then proceeds to next step SP8.

At step SP8, the system controller 5 synthesizes, by the synthesis filter bank 15, the subband signals SBL11, SBL22, . . . , and SBLmm, which are supplied form the gain sections 14A1, 14B1, 14*n*1, to generate the Lch audio signal LD. The system controller 5 also synthesizes, by the synthesis filter bank 16, the subband signals SBR11, SBR22, . . . , and SBRnn, which are supplied form the gain sections 14A2, 14B2, . . . , 14*n*2, to generate the Rch audio signal RD. The system controller 5 then proceeds to next step SP9.

At step SP9, the system controller 5 performs, by the digital-to-analog converter 4, a digital-to-analog conversion process on the audio signals LD and RD which are supplied from the synthesis filter banks 15 and 16 of the audio signal processing section 3. The left speaker SPL and the right speaker SPR then outputs sound based on the resulting signals. The system controller 5 then proceeds to next step SP10.

At this time, the following signals within the same frequency band are provided with the level ratio and phase difference in accordance with the zoom variables: the subband signals SBL11, SBL22, . . . , and SBLmm included in the audio signal LD for the left speaker SPL; and the subband signals SBR11, SBR22, and SBRnn included in the audio signal RD for the right speaker SPR. Therefore, the localization angles of the sound images A to E (FIG. 4) before the signal processing may be changed in line with the user's preference through the zoom variable signal Z1 when the left speaker SPL and the right speaker SPR output sound.

At step SP10, the system controller 5 checks whether there are the next Lch and Rch audio signals LS1 and RS1 to be inputted into the analyzing filter banks 11 and 12 of the audio signal processing section 3. The negative result at step SP10 means that there are no signals to be processed for localization angles changes. In this case, the system controller 5 proceeds to next step SP12 to end the process.

The affirmative result at SP10 means that there are the next audio signals LS1 and RS1 to be processed for localization angles changes. In this case, the system controller 5 at step SP11 resets the above zoom variable, and then returns to step SP1 to repeat the subsequent processes.

(2-6) Operation and Effect in the First Embodiment

With the playback device 1 with the above configuration, the audio signal processing section 3 evenly separates the Lch and Rch audio signals LS1 and RS1 into components with even frequency bands. As a result the subband signals SBL and SBR are obtained. The audio signal processing section 3 subsequently controls the gains of the level ratio C1 and phase difference θ1, which are calculated from the subband signals SBL and SBR of the same frequency band, by the gain values G1 and G2 corresponding to the zoom variable of the zoom variable signal Z1. This can arbitrarily change the localization angles of the sound images A to E.

Accordingly, the audio signal processing section 3 can evenly (or linearly) expand or narrow the sound images A to E, as shown in FIGS. 5 and 6. At the same time, the audio signal processing section 3 can nonlinearly enlarge and narrow the sound images A to E, as shown in FIGS. 8 and 9.

Especially, after evenly enlarging the sound images A to E as shown in FIG. 5, the expanded sound images B to D remains between the left speaker SPL and the right speaker SPR while the sound images A and E are diminished because they are beyond the left speaker SPL and the right speaker SPR.

In this case, the audio signal processing section 3 can provide the user with only the sound of the audio sources corresponding to the sound images B to D he/she desires, out of various audio sources included in the audio signals LS1 and RS1. This gives the listener LNR the effect of Virtual Surround in line with his/her preference without changing the quality of the original sound of the audio signals LS1 and RS1.

In addition, the audio signal processing section 3 can nonlinearly enlarge or narrow the sound images A to E, as shown in FIGS. 8 and 9. Therefore, the audio signal processing section 3 can, for example, enlarge the sound image C while narrowing the sound images A and E; or the audio signal processing section 3 can, for example, enlarge the sound images A and E while narrowing the sound image C. This provides the user with various kinds of acoustic spaces by changing the sound image localization of the sound images A to E in line with his/her preference.

The above configuration make this possible: the playback device 1 just performs the signal process by the audio signal processing section 3, and this changes the localization angles of the sound image localization; and, regardless of the location of the left speaker SPL and right speaker SPR, the shape of the room and the position of the listener LNR, the playback device 1 can sequentially change the range of the sound images based on the audio signals LS1 and RS1, without changing the quality of original sound.

In addition, the playback device 1 can change the ranges of the sound images A, B, D and E without changing the sound image C which is located at the middle point between the left speaker SPL and the right speaker SPR; and the playback device 1 can also provide a different feeling of the sound images A to E spreading in accordance with their localization angles. Thus, the expanded or narrowed acoustic spaces can be provided in line with the user's preference.

(3) Second Embodiment (3-1) Configuration of Image Pickup Device

Figure 12:
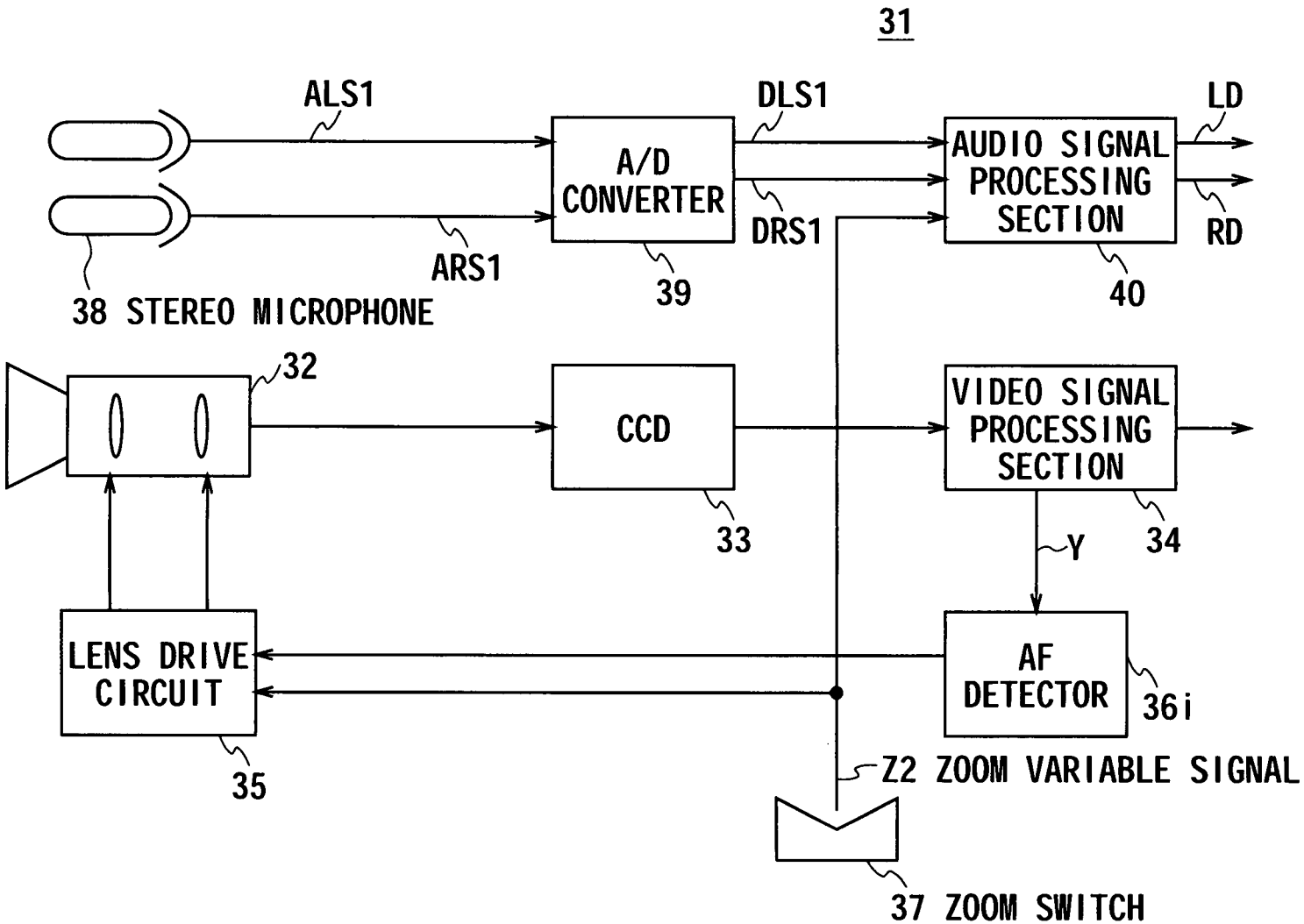
FIG. 12 is a schematic diagram illustrating the configuration of an image pickup device according to a second embodiment of the present invention.

In FIG. 12, the reference numeral 31 denotes an image pickup device according to a second embodiment of the present invention. A control section (not shown), or microcomputer, executes a predetermined audio signal processing program to take overall control of the device 31. Light from a photographic object led to a Charge Coupled Device (CCD) 33 (which is a main component of the image pickup device) to form an image via an internal lens of a lens block section 32.

The CCD 33 is an image sensor (so-called imager) including a plurality of light-sensitive elements. The light received by the CCD 33 is converted into electronic signals. The CCD 33 converts the light of the photographic object formed on an image pickup surface into an electronic signal, and then supplies the electronic signal to a video signal processing section 34.

The video signal processing section 34 performs a predetermined signal process to the electronic signal supplied form the CCD 33 to generate, for example, a standard color television signal, such as NTSC (NTSC: National Television System Committee) where a brightness signal Y and two color-difference signals R-Y and B-Y are multiplexed, or PAL (PAL: Phase Alternation by Line color television). The video signal processing section 34 subsequently supplies the standard color television signal to a monitor (not shown). By the way, the video signal processing section 34 supplies the brightness signal Y to an auto focus detector 36.

The lens block section 32 includes a zoom lens to change the depth of field while shooting the photographic object. The lens block section 32 also includes a focus lens to control a focus point of the photographic object. The lens block section 32 controls the zoom lens by a stepping motor that is controlled based on a control signal from a lens drive circuit 35. The lens block section 32 moves the zoom lens to change the depth of field.

In addition, the lens block section 32 controls the focus lens by a stepping motor that is controlled based on a control signal from the lens drive circuit 35. The lens block section 32 moves the focus lens to control the focus point of the photographic object.

The auto focus detector 36 detects, based on the brightness signal Y supplied from the video signal processing section 34, the distance the focus lens has traveled during the auto focus operation. The auto focus detector 36 supplies a resulting detection wave signal to the lens drive circuit 35.

The lens drive circuit 35 generates, based on a diaphragm value of the detection wave signal supplied form the auto focus detector 36, a focus lens movement signal to control the speed of the focus lens to be focused on a focus point of the photographic object, and then supplies it as a control signal to the lens block section 32.

In the image pickup device 31, when a user operates a zoom switch 37 to change the zoom amount, a zoom variable signal Z2 is supplied to the lens drive circuit 35 and the audio signal processing section 40.

The lens drive circuit 35 generates, based on the zoom variable signal Z2, a zoom lens movement signal to control the position of the zoom lens in the zoom block section 32, and then supplies it as a control signal to the stepping motor which then controls the zoom lens to adjust the depth of field.

The image pickup device 31 collects incoming sound through two stereo microphones 38 while shooting the object. The image pickup device 31 supplies a resulting Lch analog stereo audio signal ALS1 and Rch analog stereo audio signal ARS1 to an analog-to-digital converter 39.

The analog-to-digital converter 39 performs an analog-to-digital conversion process for the Lch analog stereo audio signal ALS1 and the Rch analog stereo audio signal ARS1 to generate a Lch digital stereo audio signal DLS1 and a Rch digital stereo audio signal DRS1, and then supplies the Lch digital stereo audio signal DLS1 and the Rch digital stereo audio signal DRS1 to the audio signal processing section 40.

The audio signal processing section 40 uses the zoom variable signal Z2 supplied from the zoom switch 37 as a zoom variable, and changes, based on the zoom variable, the area of the sound image based on the digital stereo audio signals DLS1 and DRS1 to generate audio signals LD and RD. The audio signal processing section 40 subsequently controls a digital-to-analog converter (not shown) to converts the audio signals LD and RD into analog signals, and then outputs them from the left and right speakers.

Figure 13:
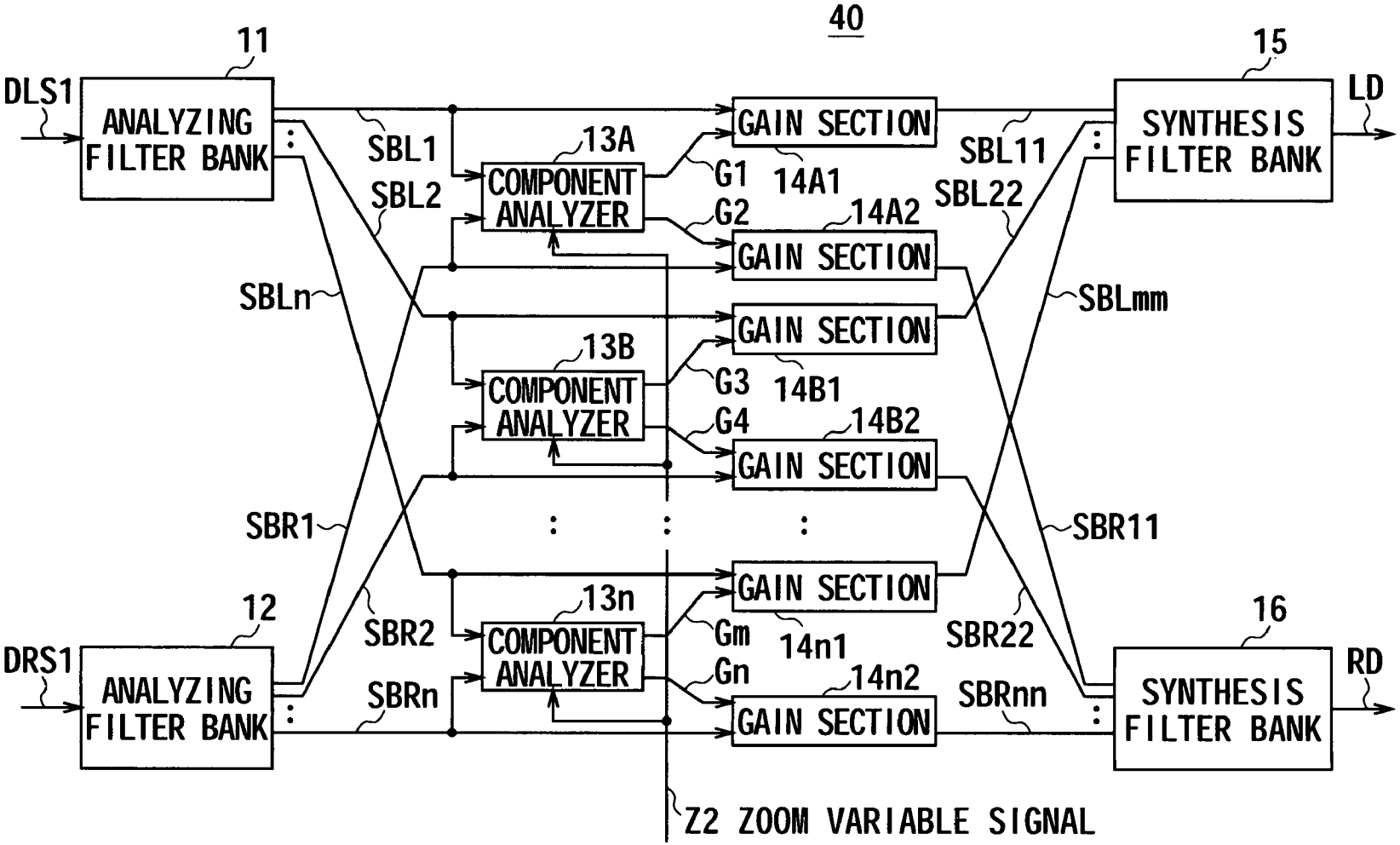
FIG. 13 is a schematic block diagram illustrating the circuit configuration of an audio signal processing section according to a second embodiment of the present invention.

(3-2) Circuit Configuration of Audio Signal Processing Section in Second Embodiment As shown in FIG. 13 (the parts of FIG. 13 have been designated by the same reference numerals and symbols as the corresponding parts of FIG. 2), the circuit configuration of the audio signal processing section 40 of the second embodiment is substantially the same as that of the audio signal processing section 3 (FIG. 2) of the first embodiment.

In this case, the audio signal processing section 40 inputs the Lch digital stereo audio signal DLSl into an analyzing filter bank 11 and the Rch digital stereo audio signal DRS1 into an analyzing filter bank 12. The analyzing filter banks 11 and 12 separates the digital stereo audio signals DLS1 and DRS1 into a plurality of components, each one carrying an equivalent or non-equivalent frequency band of the audio signals. This generates a plurality of subband signals SBL1 to SBLn and SBR1 to SBRn. The subband signals SBL1 to SBLn and SBR1 to SBRn are supplied to component analyzers 13A, 13B, . . . , and 13*n* and gain sections 14A1, 14A2, 14B1, 14B2, . . . , 14*n*1, 14*n*2.

In this case, the Lch subband signal SBL1 and the Rch subband signal SBR1 are in the same frequency band. Both signals SBL1 and SBR1 are supplied to the component analyzer 13A. The subband signal SBL1 is supplied to the gain section 14A1 while the subband signal SBR1 is supplied to the gain section 14A2.

Moreover, the Lch subband signal SBL2 and the Rch subband signal SBR2 are in the same frequency band. Both signals SBL2 and SBR2 are supplied to the component analyzer 13B. The subband signal SBL2 is supplied to the gain section 14B1 while the subband signal SBR2 is supplied to the gain section 14B2.

Furthermore, the Lch subband signal SBLn and the Rch subband signal SBRn are in the same frequency band. Both signals SBLn and SBRn are supplied to the component analyzer 13Bn. The subband signal SBLn is supplied to the gain section 14*n*1 while the subband signal SBRn is supplied to the gain section 14*n*2.

The component analyzer 13A analyzes the phase difference between the Lch subband signal SBL1 and the Rch subband signal SBR1 and their level ratios to estimate the localization angle of sound images based on the subband signals SBL1 and SBR1. The component analyzer 13A then determines, based on the estimated localization angle and the zoom variable signal Z2 supplied from the system controller 5, gain values G1 and G2, and supplies the gain values G1 and G2 to the gain sections 14A1 and 14A2, respectively.

The gain section 14A1 multiplies the subband signal SBL1 supplied from the analyzing filter bank 11 by the gain value G1 supplied from the component analyzer 13A to generate a subband signal SBL11, and then supplies the subband signal SBL11 to a synthesis filter bank 15. The gain section 14A2 multiplies the subband signal SBR1 supplied from the analyzing filter bank 12 by the gain value G2 supplied from the component analyzer 13A to generate a subband signal SBR11, and then supplies the subband signal SBR11 to a synthesis filter bank 16.

In a similar way to that of the component analyzer 13A, the component analyzer 13B analyzes the phase difference between the Lch subband signal SBL2 and the Rch subband signal SBR2 and their level ratios to estimate the localization angle of sound images based on the subband signals SBL2 and SBR2. The component analyzer 13B then determines, based on the estimated localization angle and the zoom variable signal Z2 supplied from the system controller 5, gain values G3 and G4, and supplies the gain values G3 and G4 to the gain sections 14B1 and 14B2, respectively.

The gain section 14B1 multiplies the subband signal SBL2 supplied from the analyzing filter bank 11 by the gain value G3 supplied from the component analyzer 13B to generate a subband signal SBL22, and then supplies the subband signal SBL22 to the synthesis filter bank 15. The gain section 14B2 multiplies the subband signal SBR2 supplied from the analyzing filter bank 12 by the gain value G4 supplied from the component analyzer 13B to generate a subband signal SBR22, and then supplies the subband signal SBR22 to the synthesis filter bank 16.

In a similar way to that of the component analyzers 13A and 13B, the component analyzer 13*n* analyzes the phase difference between the Lch subband signal SBLn and the Rch subband signal SBRn and their level ratios to estimate the localization angle of sound images based on the subband signals SBLn and SBRn. The component analyzer 13*n* then determines, based on the estimated localization angle and the zoom variable signal Z2 supplied from the system controller 5, gain values Gm and Gn, and supplies the gain values Gm and Gn to the gain sections 14*n*1 and 14*n*2, respectively.

The gain section 14*n*1 multiplies the subband signal SBLn supplied from the analyzing filter bank 11 by the gain value Gm supplied from the component analyzer 13*n* to generate a subband signal SBLmm, and then supplies the subband signal SBLmm to the synthesis filter bank 15. The gain section 14*n*2 multiplies the subband signal SBRn supplied from the analyzing filter bank 12 by the gain value Gn supplied from the component analyzer 13*n* to generate a subband signal SBRnn, and then supplies the subband signal SBRnn to the synthesis filter bank 16.

The synthesis filter bank 15 synthesizes the subband signals SBL11, SBL22, . . . , SBLmm, which are supplied from the gain sections 14A1, 14B1, . . . , 14*n*1, to produce a Lch audio signal LD, and then supplies the Lch audio signal LD to the subsequent digital-to-analog converter. The synthesis filter bank 16 synthesizes the subband signals SBR11, SBR22, . . . , SBRnn, which are supplied from the gain sections 14A2, 14B2, . . . , 14*n*2, to produce a Rch audio signal RD, and then supplies the Rch audio signal RD to the subsequent digital-to-analog converter.

In the audio signal processing section 40, while the user dose not operate the zoom switch 37 to change the zoom amount, the zoom variable signal Z2 is not supplied to the component analyzers 13A, 13B, . . . , and 13*n*. In this case, The subband signals SBL1, SBL2, . . . , and SBLn are directly supplied to the synthesis filter bank 15 from the analyzing filter bank 11 without adjusting their gains. In addition, the subband signals SBR1, SBR2, . . . , and SBRn are directly supplied to the synthesis filter bank 16 from the analyzing filter bank 12 without adjusting their gains.

By the way, the circuit configuration of the components analyzers 13A to 13*n* is the same as that of the component analyzers 13A to 13*n* (FIG. 3) of the audio signal processing section 3 of the first embodiment. Accordingly, the description thereof is omitted for ease of explanation.

(3-3) Areas of Sound Images Change According to Video Zoom Operation

In the image pickup device 31 with the above configuration, the area of sound images change according to operation of video zoom that enlarges a photographic object to be shot in accordance with the zoom switch 37. This point will be described.

Figure 14:
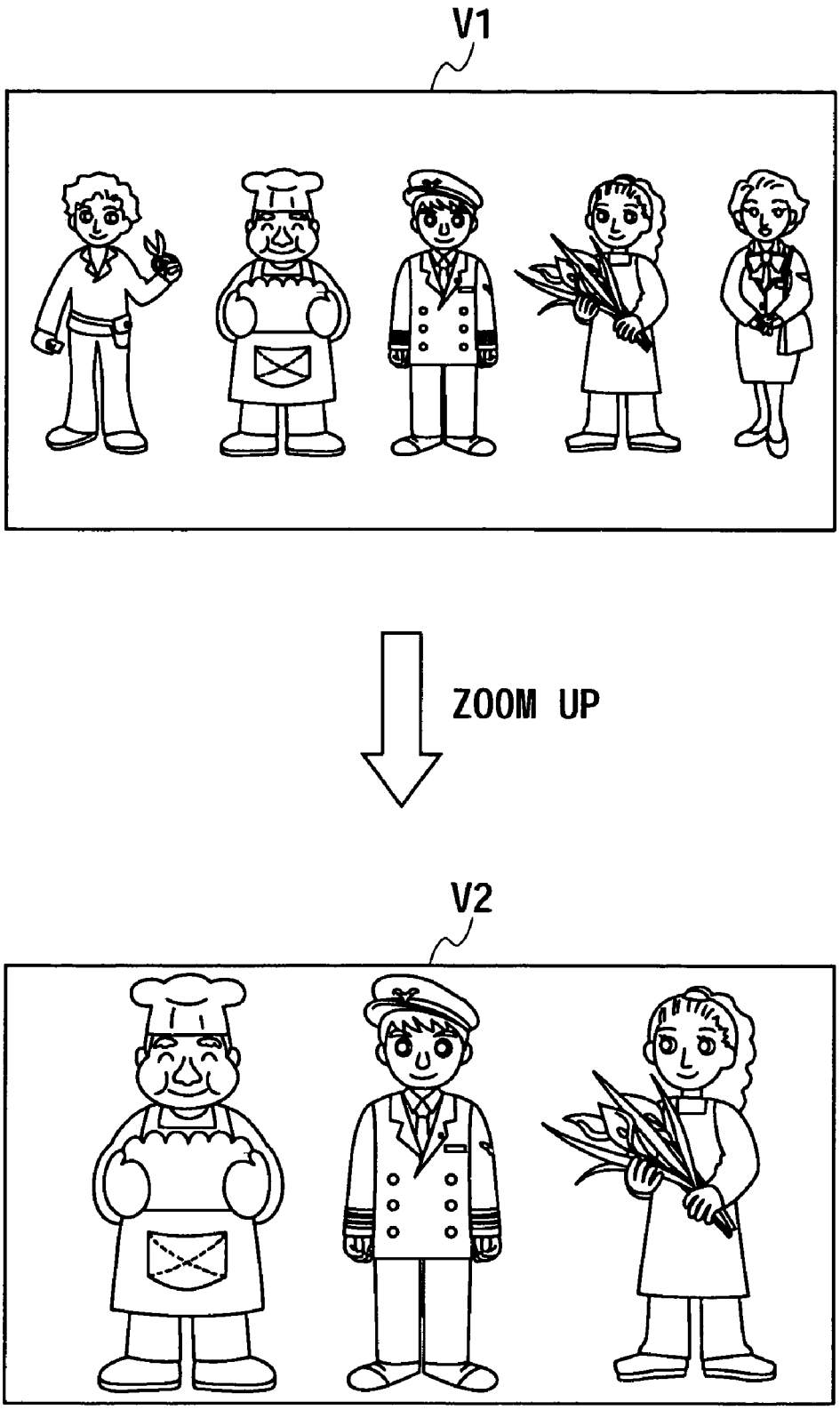
FIG. 14 is a schematic diagram illustrating a zoom operation of video zoom equipment.

For example, FIG. 14 shows a video image V1 where there are five persons. If the user operates the zoom switch 37 to enlarge, or focus on, only three persons around the center out of the five persons (like a video image V2), the area of sound images is changed in association with that operation of video zoom.

Figure 15A:
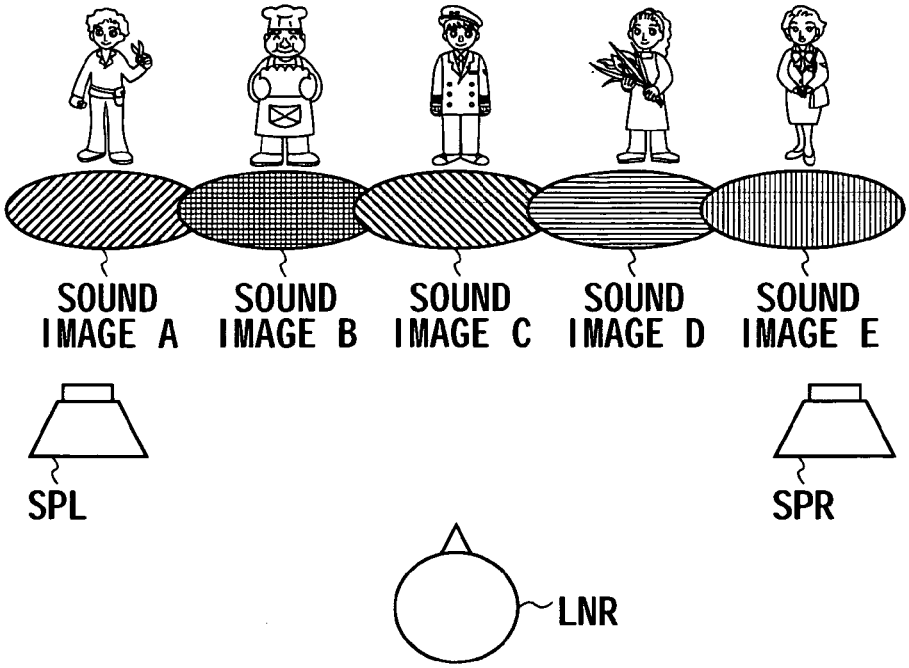
FIGS. 15A and 15B are schematic diagrams illustrating sound image localization before and after zoom change.
Figure 15B:
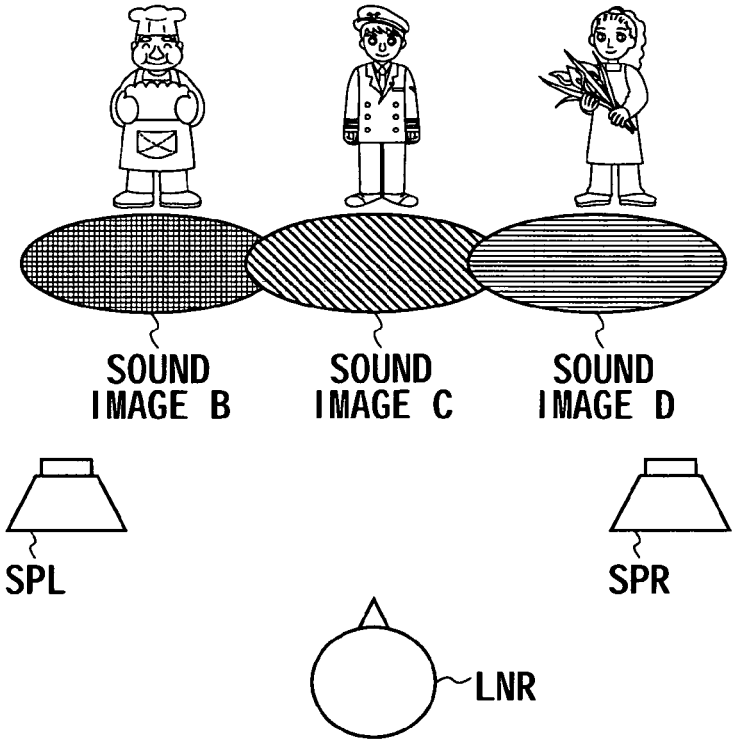

FIG. 15A shows the sound image localization when the video image V1 of the five persons is being obtained: There are sound images A to E between the left speaker SPL and the right speaker SPR as if they are associated with the five persons as audio sources.

After the video image V1 is switched to the video image V2 where only the three persons around the center are focused, the audio signal processing section 40 enlarges, in accordance with the zoom variable signal Z2, the sound images A to E. In particular, the audio signal processing section 40 determines, based on the zoom variable signal Z2, the gain values G1 to Gn for the component analyzers 13A to 13*n* to enlarge the sound images A to E. This changes their localization angles.

At this time, the audio signal processing section 40 leaves the sound images B to E corresponding to the audio sources of the three persons around the center, while the audio signal processing section 40 stops the sound images A and E corresponding to the audio sources of the two persons at the both ends.

Accordingly, the audio signal processing section 40 can change the localization angles of the sound images A to E while recording the video image where photographic objects are enlarged and focused in accordance with the user's zoom change operation of the zoom switch 37. In this manner, the areas of the sound images change according to the operation of video zoom on the photographic objects while the video images are being recorded.

Figure 16:
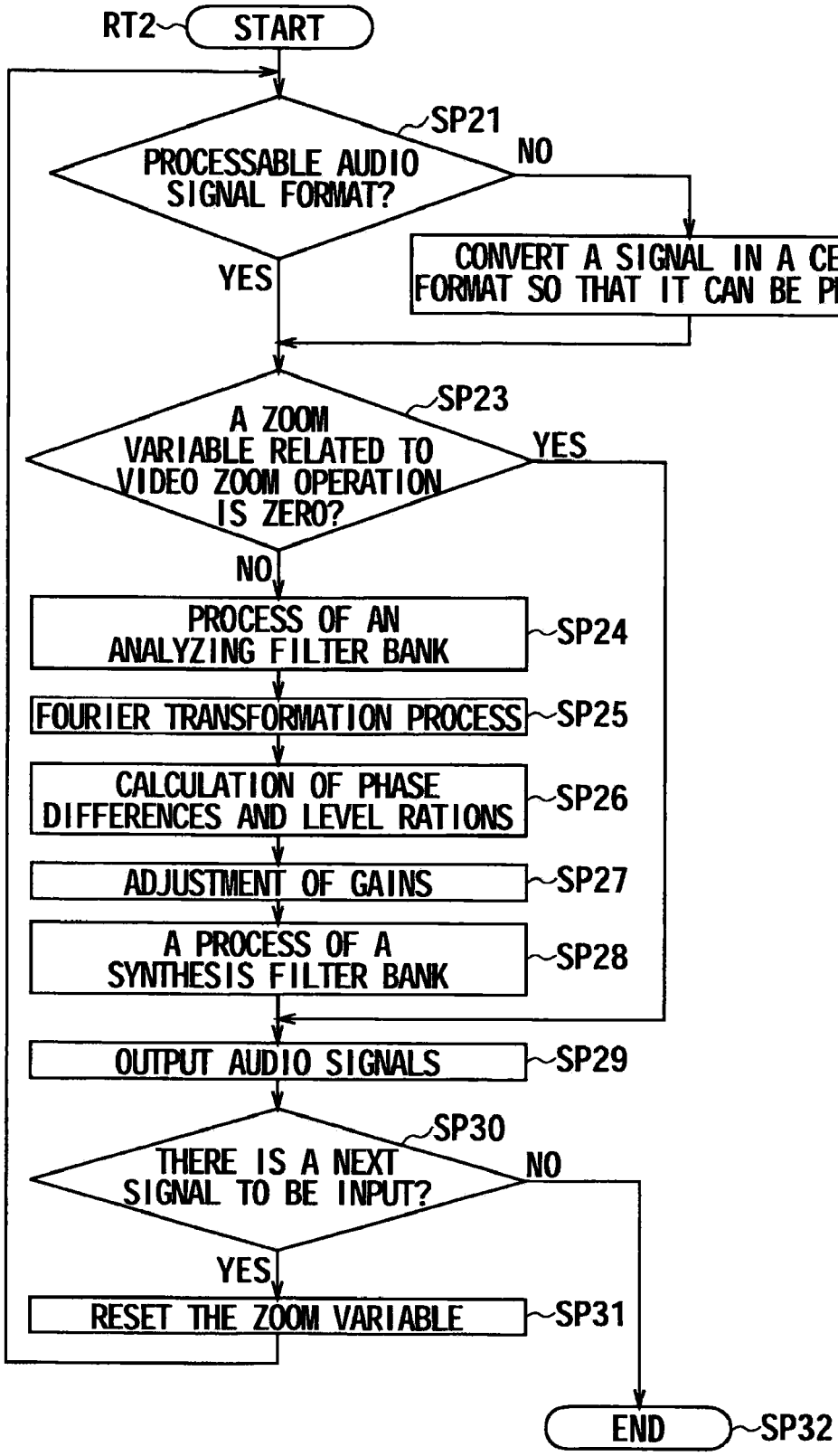
FIG. 16 is a flowchart illustrating a procedure of a sound image localization change process performed with video zoom operation according to a second embodiment of the present invention.

(3-4) Procedure of Localization Angle Switch Process with Video Zoom Operation With reference to FIG. 16, a procedure of a localization switch process will be described: the localization switch process of the image pickup device 31 changes the areas of the sound images A to E in accordance with the user's zoom switch operation.

The image pickup device 31 starts a routine RT2 from start step, and then proceeds to next step SP21. At step SP21, a control section (not shown), or microcomputer, checks whether the Lch digital stereo audio signal DLS1 and the Rch digital stereo audio signal DRS1 to be input into the analyzing filter banks 11 and 12 of the audio signal processing section 40 from the stereo microphone 38 have been converted in a certain format that allows the device 31 to change their localization angles.

For example, if the sampling frequency of the digital stereo audio signals DLS1 and DRS are different from expected one, or expected signal format on the audio signal processing section 40, the digital stereo audio signals DLS1 and DRS will be converted in a certain format that allows the device 31 to change their localization angles.

Accordingly, if the affirmative result is obtained at step SP21, the control section of the image pickup device 31 proceeds to step SP23. The negative result at step SP21 means that the current format of the digital stereo audio signals DLS1 and DRS1 does not allow the audio signal processing section 40 to change their localization angles. In this case, the control section of the image pickup device 31 proceeds to next step SP22.

At step SP22, the control section of the image pickup device 31 converts the digital stereo audio signals DLS1 and DRS1 in a certain format that allows the device 31 to change their localization angles, and then proceeds to next step SP23.

At step SP23, the control section of the image pickup device 31 checks whether the zoom variable of the zoom variable signal Z2, which is supplied from the zoom switch 37 (FIG. 12) in response to the user's zoom switch operation of the zoom switch 37, is zero.

The affirmative result at step SP23 means that the zoom variable is zero. It means that the image pickup device 31 is not zooming up any video image. In this case, the control section of the image pickup device 31 proceeds to step SP29 without changing the localization angles of the sound images.

The negative result at step SP23 means that the zoom variable is other than zero. It means that the image pickup device 31 is zooming up a video image. In this case, the control section of the image pickup device 31 proceeds to next step SP24 to change the localization angles of the sound images in accordance with the operation of video zoom.

At step SP24, the control section of the image pickup device 31 controls the analyzing filter bank 11 of the audio signal processing section 40 to separate the Lch digital stereo audio signal DLS1 into a plurality of components with different frequency bands. The control section also controls the analyzing filter bank 12 of the audio signal processing section 40 to separate the Rch digital stereo audio signal DRS1 into a plurality of components with different frequency bands. The control section subsequently supplies the resulting subband signals SBL1 to SBLn and SBR1 to SBRn to the component analyzers 13A to 13*n*, and then proceeds to next step SP25.

At step SP25, the control section of the image pickup device 31 controls the Fourier converters 21 and 22 (FIG. 3) of the component analyzers 13A to 13*n* to perform a Fourier transformation process to the subband signals SBL1 to SBLn and SBR1 to SBRn. The control section subsequently supplies the resulting complex subband signals SBL1*i* to SBLni and SBR1*i* to SBRni to the phase difference calculator 23 and the level ratio calculator 24, and then proceeds to next step SP26.

At step SP26, the control section of the image pickup device 31 calculates the phase difference el and the level ratio C1 by the phase difference calculator 23 and the level ratio calculator 24 of the component analyzers 13A to 13*n*, supplies the phase difference θ1 and the level ratio C1 to the gain calculator 25, and then proceeds to next step SP27.

At step SP27, the control section of the image pickup device 31 determines the gain values G1 and G2 based on the phase difference θ1, the level ratio C1 and the zoom variable of the zoom variable signal Z2, and uses these gain values G1 and G2 to control the gains of the subband signals SBL1 to SBLn and SBR1 to SBRn by the gain sections 14A1 to 14*n*2 of the audio signal processing section 40. The control section supplies the resulting subband signals SBL11 to SBLmm and SBR11 to SBRnn to the synthesis filter banks 15 and 16, respectively. The control section then proceeds to next step SP28.

At step SP28, the control section of the image pickup device 31 synthesizes, by the synthesis filter bank 15 of the audio signal processing section 40, the subband signals SBL11, SBL22, and SBLmm, which are supplied form the gain sections 14A1, 14B1, 14*n*1, to generate the Lch audio signal LD. The control section also synthesizes, by the synthesis filter bank 16, the subband signals SBR11, SBR22, . . . , and SBRnn, which are supplied form the gain sections 14A2, 14B2, . . . , 14*n*2, to generate the Rch audio signal RD. The control section then proceeds to next step SP29.

At step SP29, the control section of the image pickup device 31 performs, by the subsequent digital-to-analog converter, a digital-to-analog conversion process on the audio signals LD and RD which are supplied from the synthesis filter banks 15 and 16. The left speaker SPL and the right speaker SPR then outputs sound based on the resulting signals. The control section then proceeds to next step SP30.

At this time, the following signals within the same frequency band are provided with the level ratio and phase difference in accordance with the zoom variables: the subband signals SBL11, SBL22, . . . , and SBLmm included in the audio signal LD for the left speaker SPL; and the subband signals SBR11, SBR22, and SBRnn included in the audio signal RD for the right speaker SPR. Therefore, the localization angles of the sound images A to E (FIG. 15A) before the signal processing may be changed in line with the user's preference through the zoom variable signal Z2 when the left speaker SPL and the right speaker SPR output sound.

At step SP30, the control section of the image pickup device 31 checks whether there are the next Lch and Rch digital stereo audio signals DLS1 and DRS1 to be inputted into the analyzing filter banks 11 and 12. The negative result at step SP30 means that there are no signals to be processed for localization angles changes. In this case, the control section proceeds to next step SP32 to end the process.

The affirmative result at step SP30 means that there are the next digital stereo audio signals DLS1 and DRS1 to be processed for localization angles changes. In this case, the control section of the image pickup device 31 at step SP31 resets the above zoom variable, and then returns to step SP21 to repeat the subsequent processes.

(3-5) Operation and Effect in Second Embodiment

The image pickup device 31 with the above configuration has previously recognized the localization positions of the sound images A to E whose audio sources are associated with the five photographic objects in the video image V1 (FIG. 14). The image pickup device 31 changes, in accordance with the zoom variable signal Z2, the extent of the sound images A to E, as the video image V1 is switched to the video image V2 where only the three persons around the center are zoomed up out of the five photographic objects in accordance with the user's zoom switch operation of the zoom switch 37.

Especially, the audio signal processing section 40 performs the following processes as the video image V1 is switched to the video image V2 (FIG. 14) where the three persons out of the five photographic objects are displayed, or zoomed in: the audio signal processing section 40 enlarges the sound images A to E, outputs the sound images B to D whose audio sources are associated with these three photographic objects, and stops outputting the sound images A and E whose audio sources are associated with the two persons at the both sides, those outside the video image V2. In this manner, the audio signal processing section 40 can only record sound from those three photographic objects displayed on the video image V2. This relates the video image to the sound.

The above configuration makes this possible: the signal process of the audio signal processing section 40 of the image pickup device 31 can change the localization angles of the sound images A to E as the video image is zoomed. This can change the extent of the sound images to be recorded without changing the quality of the original sound as the video image is zoomed.

(4) Third Embodiment

(4-1) Configuration of Video and Sound Processing Device

Figure 17:
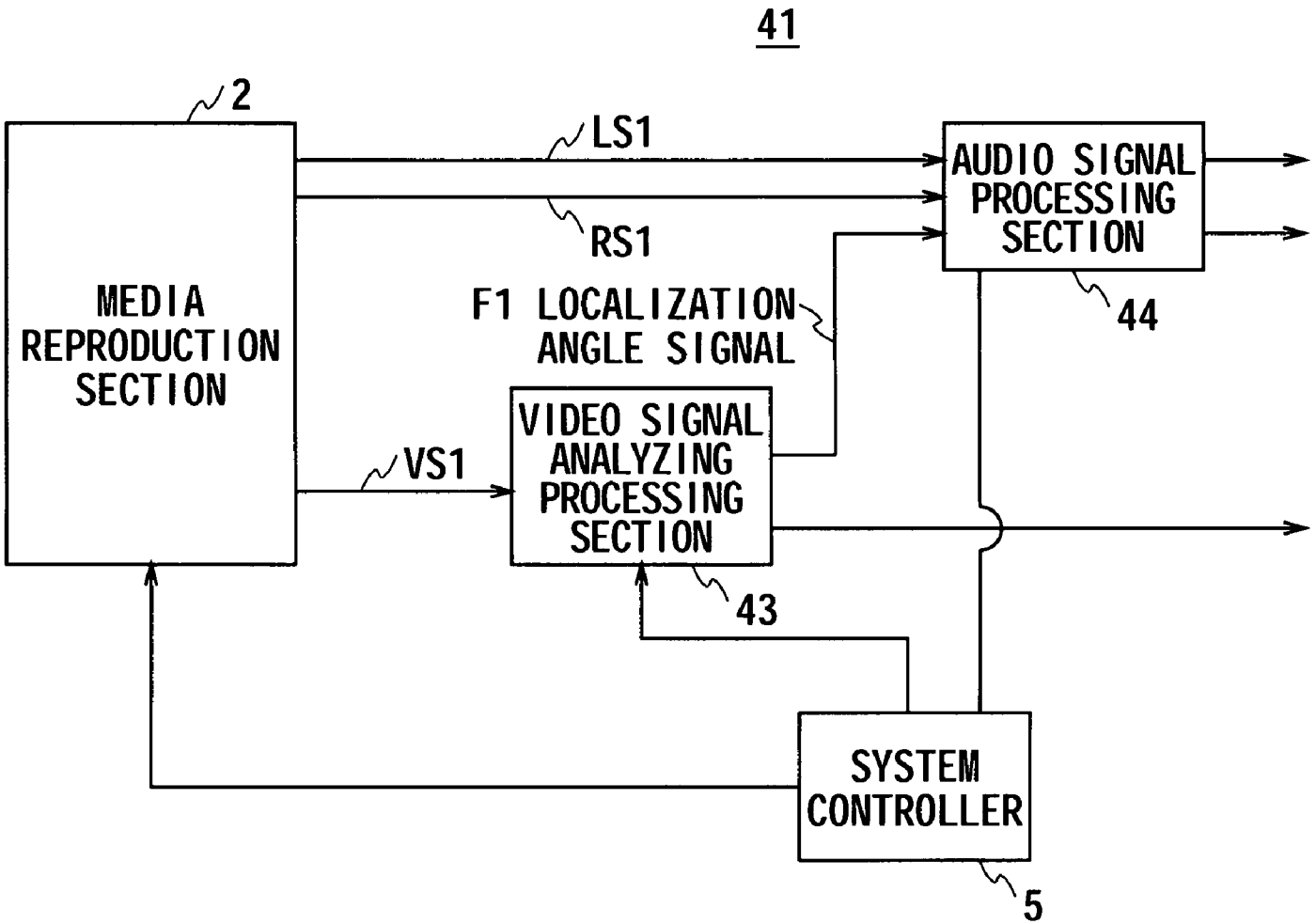
FIG. 17 is a schematic diagram illustrating the configuration of a video and sound processing device according to a third embodiment of the present invention.

In FIG. 17 (the parts of FIG. 17 have been designated by the same reference numerals and marks as the corresponding parts of FIG. 1, the reference numeral 41 denotes a video and sound processing device according to a third embodiment of the present invention. A system controller 5, or microcomputer, executes a predetermined audio signal processing program to take overall control of the video and sound processing device 41.

A media reproduction section 2 reproduces, under the control of the system controller 5, a video signal VS1, Lch audio signal LS1 and Rch audio signal RS1 of video content from media. The media reproduction section 2 subsequently supplies the video signal VS1 to a video signal analyzing processing section 43, and the Lch audio signal LS1 and the Rch audio signal RS1 to an audio signal processing section 44.

Under the control of the system controller 5, the video signal analyzing processing section 43 analyzes the video signal VS1 to detect an image of a face from the video, and, based on the position of the face image on the video (two-dimensional coordinate system), determines a relative position of the face image with respect to the center of the video as a localization angle. The video signal analyzing processing section 43 subsequently supplies that localization angle, as a localization angle signal F1, to the audio signal processing section 44. At the same time, the video signal analyzing processing section 43 performs a predetermined signal process for the video signal VS1, and then supplies it to a monitor (not shown); alternatively, the video signal analyzing processing section 43 supplies the video signal VS1 to the monitor without performing any signal process for that.

By the way, there are many ways to detect the face image, one of them is performed by the video signal analyzing processing section 43. For example, it is disclosed in Jpn. Pat. Laid-open Publication No. H9-251534 that the relative positions of eyes, noses and mouths are detected, and, based on the detected positions, a front face shading pattern is obtained. This allows detecting the position of the face image on the video. In addition to that, there are many other methods to detect the face images, and some of them may be applied to the video signal analyzing processing section 43.

The audio signal processing section 44 generates, based on the localization angle signal F1 from the video signal analyzing processing section 43, a zoom variable signal Z3 (described below), and, based on the zoom variable signal Z3, moves the sound image of the face image such that this sound image is associated with the position of the face image on the video. In this manner, the audio signal processing section 44 changes the sound image localization.

Figure 18:
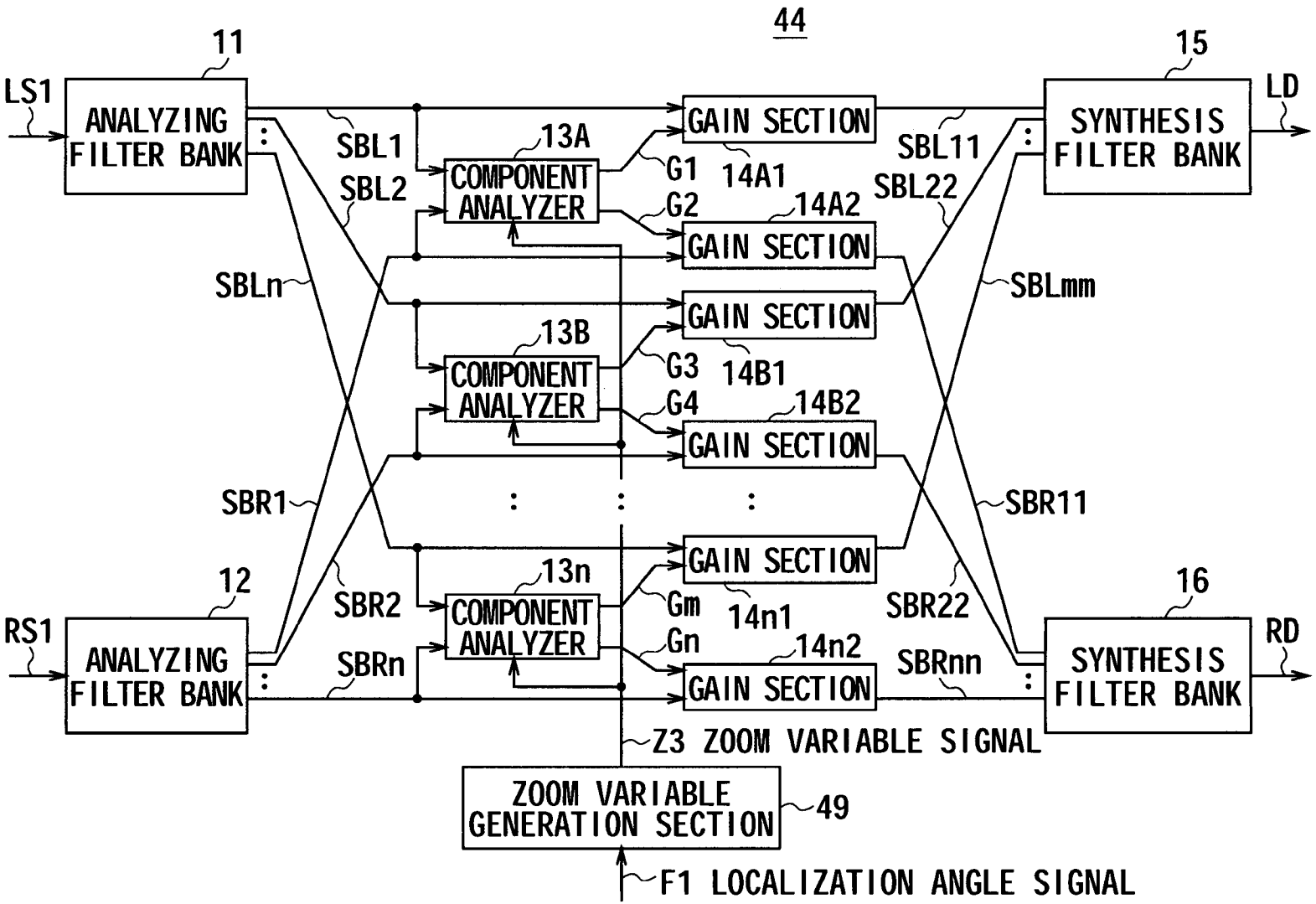
FIG. 18 is a schematic block diagram illustrating the circuit configuration of an audio signal processing section according to a third embodiment of the present invention.

(4-2) Circuit Configuration of Audio Signal Processing Section in Third Embodiment As shown in FIG. 18 (the parts of FIG. 18 have been designated by the same reference numerals and symbols as the corresponding parts of FIG. 2), the circuit configuration of the audio signal processing section 44 of the third embodiment is substantially the same as that of the audio signal processing section 3 (FIG. 2) of the first embodiment, except a zoom variable generation section 49 installed in the audio signal processing section 44.

The zoom variable generation section 49 generates, based on the localization angle signal F1 from the video signal analyzing processing section 43, the zoom variable signal Z3 which varies according to the relative position of the face image with respect to the center of the screen. The zoom variable generation section 49 subsequently supplies the zoom variable signal Z3 to the component analyzers 13A to 13*n*.

The audio signal processing section 44 inputs the Lch audio signal LS1 and Rch audio signal RS1, which are supplied from the media reproduction section 2, into analyzing filter banks 11 and 12, respectively. The analyzing filter banks 11 and 12 separates the audio signals LS1 and RS1 into a plurality of components, each one carrying an equivalent or non-equivalent frequency band of the audio signals. This generates a plurality of subband signals SBL1 to SBLn and SBR1 to SBRn. The subband signals SBL1 to SBLn and SBR1 to SBRn are supplied to component analyzers 13A, 13B, . . . , and 13*n* and gain sections 14A1, 14A2, 14B1, 14B2, . . . , 14*n*1, 14*n*2.

In this case, the Lch subband signal SBL1 and the Rch subband signal SBR1 are in the same frequency band. Both signals SBL1 and SBR1 are supplied to the component analyzer 13A. The subband signal SBL1 is supplied to the gain section 14A1 while the subband signal SBR1 is supplied to the gain section 14A2.

Moreover, the Lch subband signal SBL2 and the Rch subband signal SBR2 are in the same frequency band. Both signals SBL2 and SBR2 are supplied to the component analyzer 13B. The subband signal SBL2 is supplied to the gain section 14B1 while the subband signal SBR2 is supplied to the gain section 14B2.

Furthermore, the Lch subband signal SBLn and the Rch subband signal SBRn are in the same frequency band. Both signals SBLn and SBRn are supplied to the component analyzer 13*n*. The subband signal SBLn is supplied to the gain section 14*n*1 while the subband signal SBRn is supplied to the gain section 14*n*2.

The component analyzer 13A analyzes the phase difference between the Lch subband signal SBL1 and the Rch subband signal SBR1 and their level ratios to estimate the localization angle of sound images based on the subband signals SBL1 and SBR1. The component analyzer 13A then determines, based on the estimated localization angle and the zoom variable signal Z3 supplied from the zoom variable generation section 49, gain values G1 and G2, and supplies the gain values G1 and G2 to the gain sections 14A1 and 14A2, respectively.

The gain section 14A1 multiplies the subband signal SBL1 supplied from the analyzing filter bank 11 by the gain value G1 supplied from the component analyzer 13A to generate a subband signal SBL11, and then supplies the subband signal SBL11 to a synthesis filter bank 15. The gain section 14A2 multiplies the subband signal SBR1 supplied from the analyzing filter bank 12 by the gain value G2 supplied from the component analyzer 13A to generate a subband signal SBR11, and then supplies the subband signal SBR11 to a synthesis filter bank 16.

In a similar way to that of the component analyzer 13A, the component analyzer 13B analyzes the phase difference between the Lch subband signal SBL2 and the Rch subband signal SBR2 and their level ratios to estimate the localization angle of sound images based on the subband signals SBL2 and SBR2. The component analyzer 13B then determines, based on the estimated localization angle and the zoom variable signal Z3 supplied from the zoom variable generation section 49, gain values G3 and G4, and supplies the gain values G3 and G4 to the gain sections 14B1 and 14B2, respectively.

The gain section 14B1 multiplies the subband signal SBL2 supplied from the analyzing filter bank 11 by the gain value G3 supplied from the component analyzer 13B to generate a subband signal SBL22, and then supplies the subband signal SBL22 to the synthesis filter bank 15. The gain section 14B2 multiplies the subband signal SBR2 supplied from the analyzing filter bank 12 by the gain value G4 supplied from the component analyzer 13B to generate a subband signal SBR22, and then supplies the subband signal SBR22 to the synthesis filter bank 16.

In a similar way to that of the component analyzers 13A and 13B, the component analyzer 13*n* analyzes the phase difference between the Lch subband signal SBLn and the Rch subband signal SBRn and their level ratios to estimate the localization angle of sound images based on the subband signals SBLn and SBRn. The component analyzer 13*n* then determines, based on the estimated localization angle and the zoom variable signal Z3 supplied from the system controller 49, gain values Gm and Gn, and supplies the gain values Gm and Gn to the gain sections 14*n*1 and 14*n*2, respectively.

The gain section 14*n*1 multiplies the subband signal SBLn supplied from the analyzing filter bank 11 by the gain value Gm supplied from the component analyzer 13*n* to generate a subband signal SBLmm, and then supplies the subband signal SBLmm to the synthesis filter bank 15. The gain section 14*n*2 multiplies the subband signal SBRn supplied from the analyzing filter bank 12 by the gain value Gn supplied from the component analyzer 13*n* to generate a subband signal SBRnn, and then supplies the subband signal SBRnn to the synthesis filter bank 16.

The synthesis filter bank 15 synthesizes the subband signals SBL11, SBL22, . . . , SBLmm, which are supplied from the gain sections 14A1, 14B1, . . . , 14*n*1, to produce a Lch audio signal LD, and then supplies the Lch audio signal LD to the subsequent digital-to-analog converter. The synthesis filter bank 16 synthesizes the subband signals SBR11, SBR22, . . . , SBRnn, which are supplied from the gain sections 14A2, 14B2, . . . , 14*n*2, to produce a Rch audio signal RD, and then supplies the Rch audio signal RD to the subsequent digital-to-analog converter.

In the audio signal processing section 44, while the localization angle signal F1 is not being supplied from the video signal analyzing processing section 43, the zoom variable signal Z3 is not supplied to the component analyzers 13A, 13B, . . . , and 13*n* from the zoom variable generation section 49. In this case, The subband signals SBL1, SBL2, . . . , and SBLn are directly supplied to the synthesis filter bank 15 from the analyzing filter bank 11 without adjusting their gains. In addition, the subband signals SBR1, SBR2, . . . , and SBRn are directly supplied to the synthesis filter bank 16 from the analyzing filter bank 12 without adjusting their gains.

That is to say, not supplying the localization angle signal F1 from the video signal analyzing processing section 43 means that the face image is at the center of the screen. This means that the device 41 does not have to move the sound image whose audio source is associated with the face image because this sound image is substantially at the middle point between the left speaker SPL and the right speaker SPR.

By the way, the circuit configuration of the components analyzers 13A to 13*n* is the same as that of the component analyzers 13A to 13*n* of the audio signal processing section 3 of the first embodiment. Accordingly, the description thereof is omitted for ease of explanation.

(4-3) Areas of Sound Images Change According to Face Image Position

In the video and sound processing device 41 with the above configuration, the localization position of the sound image localization whose audio source is associated with the face image changes according to the relative position of the face image with respect to the center of the screen, or the video image of the video signal VS of content reproduced by the media reproduction section 2. This point will be described.

Figure 19B:
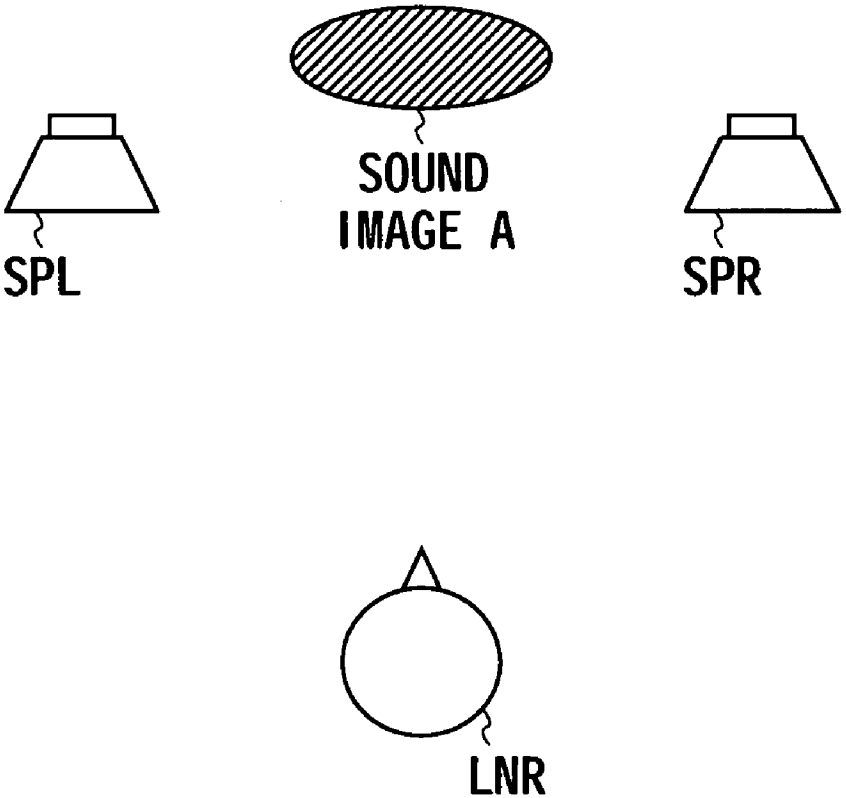
FIGS. 19A and 19B are schematic diagrams illustrating sound image localization when a face image is located at the center of a screen.
Figure 19A:
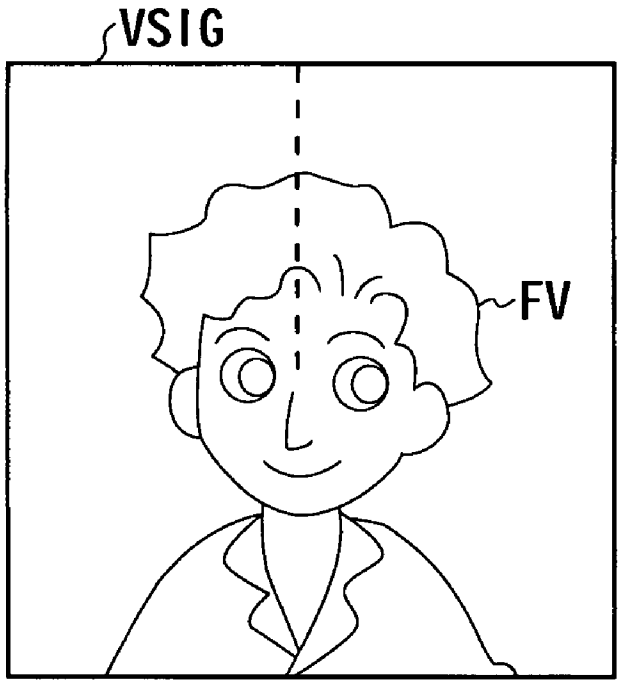

If there is the face image FV at the center of the video image VSLG based on the video signal VS1 which is supplied from the media reproduction section 2 to the video signal analyzing processing section 43 as shown in FIG. 19A, the sound image A whose audio source is associated with the face image FV is located at the middle point between the left speaker SPL and the right speaker SPR as shown in FIG. 19B.

Figure 20B:
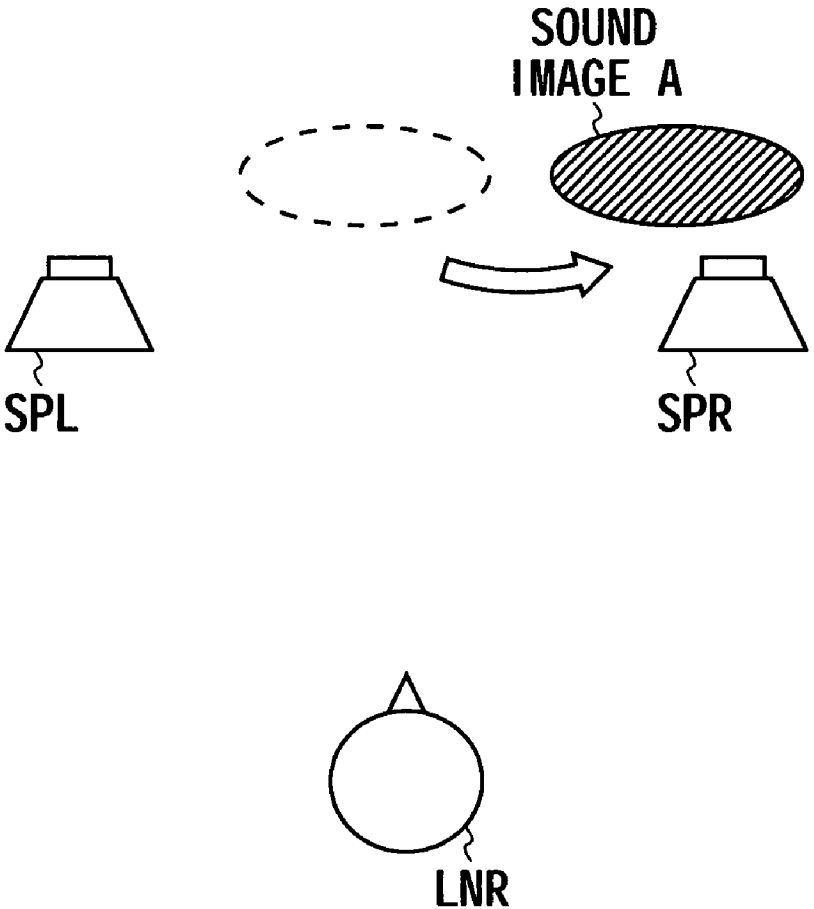
FIGS. 20A and 20B are schematic diagrams illustrating sound image localization when a face image is not located at the center of a screen.
Figure 20A:
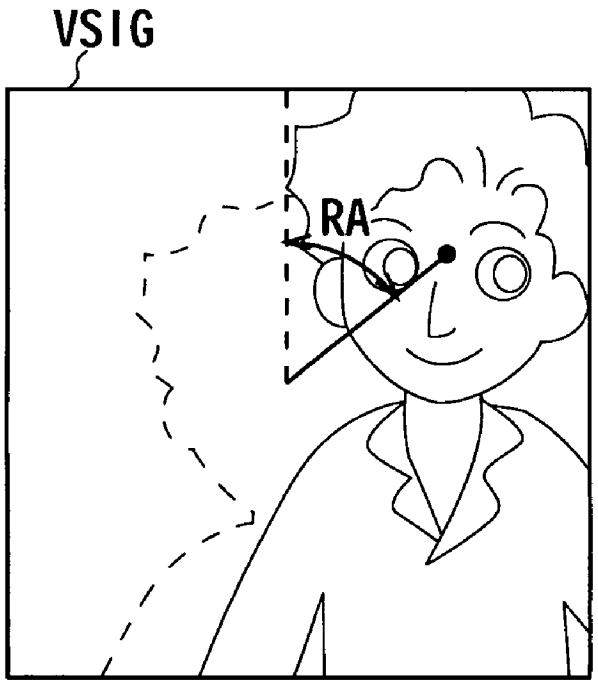

After that, as shown in FIG. 20A, if the face image FV moves from the center of the video image VSlG of the video signal VS1 to the upper right side, the video and sound processing device 41 determines the localization angle PA in accordance with the relative position of the face image FV with respect to the center of the video, and supplies it to the audio signal processing section 44 as the localization angle signal F1.

The audio signal processing section 44 determines the gain value G based on the zoom variable signal Z3 calculated from the localization angle signal F1. The audio signal processing section 44 subsequently adjusts the gains of the subband signals SBL and SBR using the gain value G. This moves the sound image A, which is associated with the face image FV, such that this sound image A is close to the right speaker SPR, as shown in FIG. 20B.

In this manner, the video and sound processing device 41 moves the sound image A whose audio source is associated with the face image FV, as the face image FV moves away from the center of the video.

In this manner, the video and sound processing device 41 maintain the association of the face image FV and the sound image A by moving the sound image A in accordance with the movement of the face image FV, or video content. This prevents the listener LNR who is viewing the video image VSG1 of the video signal VS1 from feeling discomfort.

In addition to the association between the face image FV on the video image VSlG and the sound image A, the video and sound processing device 41 may perform a volume control process: the video and sound processing device 41 turns down the volume of the sound image A when the face image FV approaches the bottom side of the video screen, while the video and sound processing device 41 turns up the volume of the sound image A when face image FV approaches the upper side of the video screen. This gives the listener LNR the feeling of being at a live performance.

By the way, to control the volume of the sound image A, a gain adjustment process is performed so that the amplitude levels of the Lch subband signals SBL and Rch subband signals SBR increase. At this time, if the level ratios remain unchanged, the sound image localization of the sound image A continues to be the same while the volume of the sound image A increases.

(4-4) Sound Image Localization Change Process with Movement of Face Images

Figure 21:
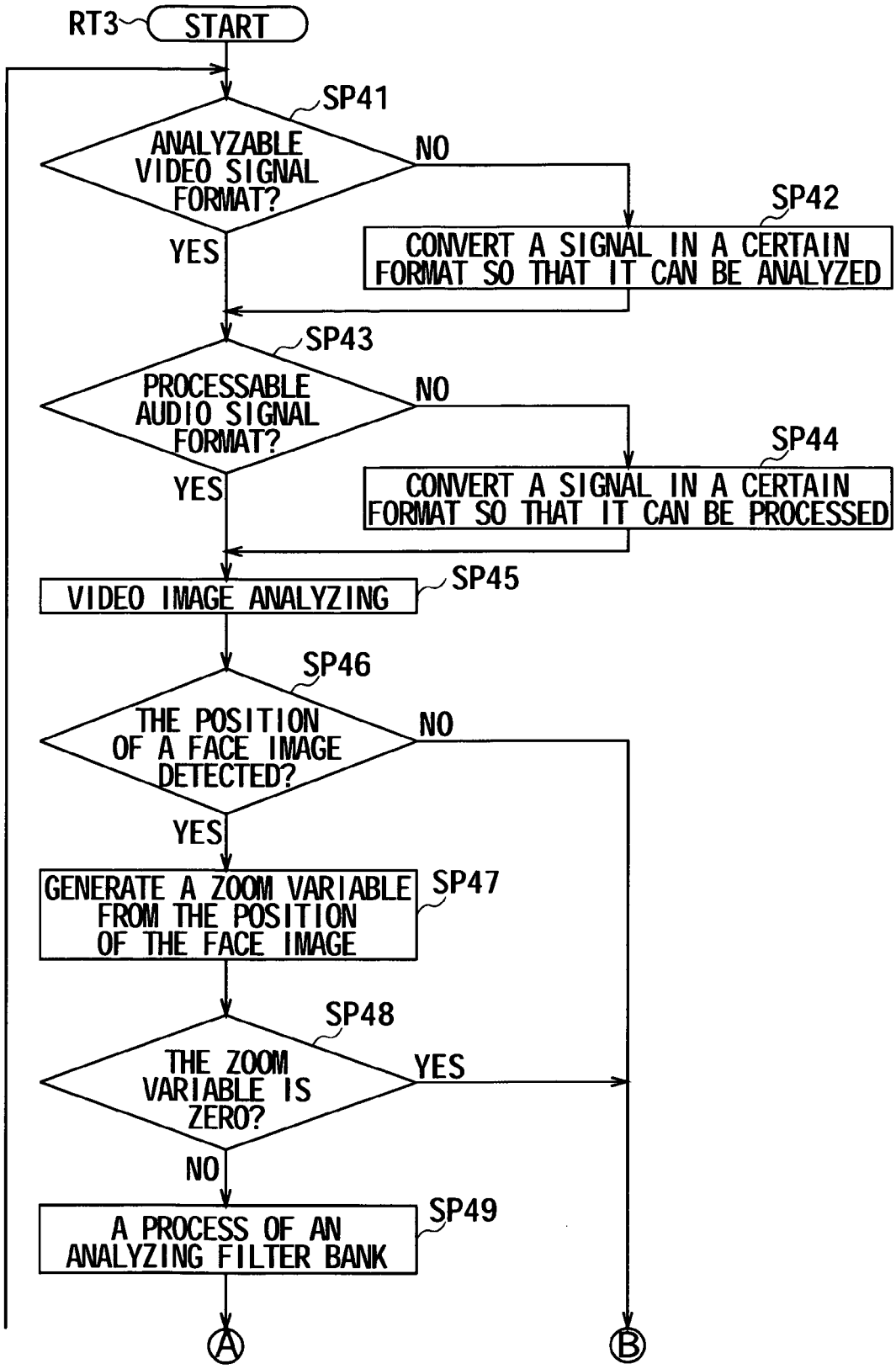
FIG. 21 is a flowchart illustrating a procedure of a sound image localization change process according to a third embodiment of the present invention.
Figure 22:
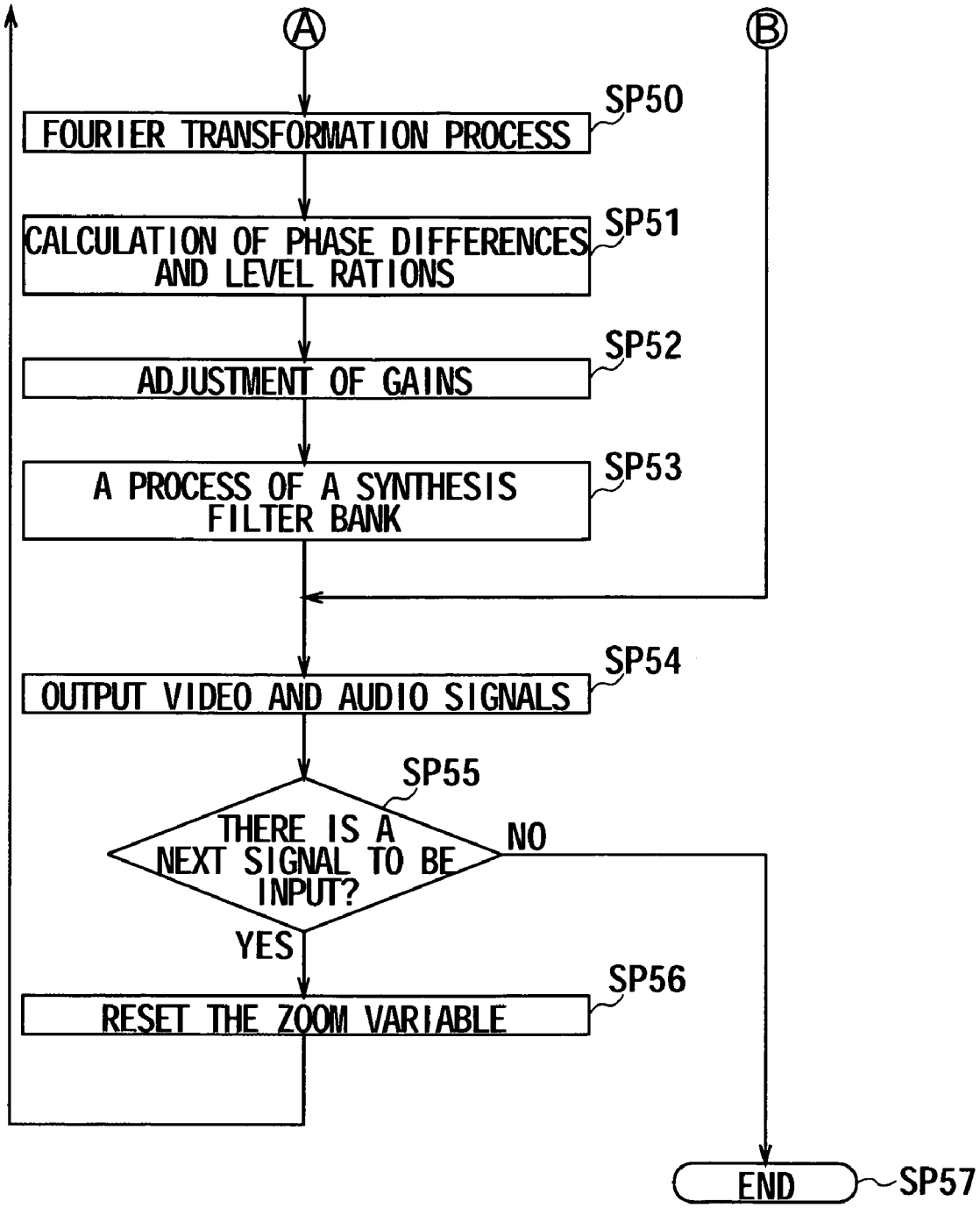
FIG. 22 is a flowchart illustrating a procedure of a sound image localization change process according to a third embodiment of the present invention.

With reference to FIGS. 21 and 22, a procedure of a process to change the sound image localization will be described. This process moves the sound image A, which corresponds to the face image FV, to change its sound image localization in accordance with the movement of the face image FV on the video image VSlG based on the video signal VS of the above video and sound processing device 41.

The system controller 5 of the video and sound processing device 41 starts a routine RT3 from start step and then proceeds to next step SP41. At step SP41, the system controller 5 checks whether the video signal VS1 from the media reproduction section 2 can be analyzed by the video signal analyzing processing section 43. When the negative result is obtained at step SP41 the system controller 5 proceeds to next step SP42. Whereas when the affirmative result is obtained at step SP41 the system controller 5 proceeds to next step SP43.

At step SP42, the system controller 5 transforms the video signal VS1 in a certain format that can be analyzed by the video signal analyzing processing section 43, and then proceeds to next step SP43.

At step SP43, the system controller 5 checks whether the Lch audio signal LS1 and the Rch audio signal RS1 has been converted in a certain format that can be processed for change of sound image localization: these Lch and Rch audio signals LS1 and RS1 are those input into the analyzing filter banks 11 and 12 of the audio signal processing section 44 from the media reproduction section 2.

If the sampling frequencies of the audio signals LS1 and RS1 are different from the expected sampling frequencies of the signal format of the audio signal processing section 44, these signals LS1 and RS1 will be converted in a certain signal format that allows the device 41 to change the sound image localization.

When the affirmative result is obtained at step SP43 the system controller 5 proceeds to step SP45. Whereas when the negative result is obtained at step SP43 the system controller 5 proceeds to next step SP44 because it means that the audio signals LS1 and RS1 have not been converted in a certain format that allows the audio signal processing section 44 to change the sound image localization.

At step SP44, the system controller 5 converts the audio signals LS1 and RS1 in a certain format that allows the audio signal processing section 44 to change the sound image localization, and then proceeds to next step SP45.

At step SP45, the system controller 5 analyzes, by the video signal analyzing processing section 43, the video signal VS1 from the media reproduction section 2 to detect the position of the face image FV inside the video image VS1G based on the video signal VS1, and then proceeds to next step SP46.

At step SP46, the system controller 5 checks whether to detect the position of the face image FV. The negative result at step SP46 means that the system controller 5 does not have to change the sound image localization of the sound image A because the face image FV can not be detected. In this case, the system controller 5 proceeds to step SP54 (FIG. 22).

The affirmative result at step SP46 means that the system controller 5 will change the sound image localization of the sound image A in accordance with the movement of the face image FV because the face image FV can be detected. In this case, the system controller 5 proceeds to next step SP47.

At step SP47, the system controller 5 generates, based on the localization angle signal F1 calculated from the relative position of the face image FV with respect to the center of the screen, the zoom variable signal Z3 by the zoom variable generation section 49 of the audio signal processing section 44, and then proceeds to next step SP48.

At step SP48, the system controller 5 checks whether the zoom variable of the zoom variable signal Z3 is zero.

The affirmative result at step SP48 means that the face image FV is located at the center of the screen because the zoom variable is zero. It means that the system controller 5 does not have to change the sound image localization of the sound image A. In this case, the system controller 5 proceeds to step SP54 (FIG. 22) without performing a process of changing the sound image localization.

The negative result at step SP48 means that the face image FV is away from the center of the screen because the zoom variable is not zero. It means that the system controller 5 will change the sound image localization of the sound image A in accordance with the movement of the face image FV. In this case, the system controller 5 proceeds to next step SP49 to change the sound image localization.

At step SP49, the system controller 5 separates, by the analyzing filter bank 11 of the audio signal processing section 44, the Lch audio signal LS1, which is supplied from the media reproduction section 2, into a plurality of components with different frequency bands. The system controller 5 also separates, by the analyzing filter bank 12 of the audio signal processing section 44, the Rch audio signal RS1, which is supplied from the media reproduction section 2, into a plurality of components with different frequency bands. All this generates a plurality of subband signals SBL1 to SBLn and SBR1 and SBRn which then are supplied to the component analyzers 13A to 13*n*. The system controller 5 subsequently proceeds to next step SP50.

At step SP50, the system controller 5 controls the Fourier converters 21 and 22 of the component analyzers 13A and 13*n* (FIG. 3) to perform a Fourier transformation process on the subband signals SBL1 to SBLn and SBR1 and SBRn. The system controller 5 subsequently supplies the resulting complex subband signals SBL1*i* to SBLni and SBR1*i* to SBRni to the phase difference calculator 23 and the level ratio calculator 24, and then proceeds to next step SP51.

At step SP51, the system controller 5 controls the phase difference calculator 23 and the level ratio calculator 24 of the component analyzers 13A to 13*n* to calculate the phase difference θ1 and the level ratio C1, supplies the phase difference θ1 and the level ratio C1 to the gain calculator 25, and then proceeds to next step SP52.

At step SP52, the system controller 5 determines the gain values G1 and G2 based on the phase difference θ1, the level ratio C1 and the zoom variable of the zoom variable signal Z3, and uses these gain values G1 and G2 to control the gains of the subband signals SBL1 to SBLn and SBR1 to SBRn by the gain sections 14A1 to 14*n*2 of the audio signal processing section 44. The system controller 5 supplies the resulting subband signals SBL11 to SBLmm and SBR11 to SBRnn to the synthesis filter banks 15 and 16, respectively. The system controller 5 then proceeds to next step SP53.

At step SP53, the system controller 5 synthesizes, by the synthesis filter bank 15, the subband signals SBL11, SBL22, . . . , and SBLmm, which are supplied form the gain sections 14A1, 14B1, and 14*n*1, to generate the Lch audio signal LD. The system controller 5 also synthesizes, by the synthesis filter bank 16, the subband signals SBR11, SBR22, . . . , and SBRnn, which are supplied form the gain sections 14A2, 14B2, . . . , and 14*n*2, to generate the Rch audio signal RD. The system controller 5 then proceeds to next step SP54.

At step SP54, the system controller 5 performs, by the subsequent digital-to-analog converter, a digital-to-analog conversion process on the audio signals LD and RD, which are supplied from the synthesis filter banks 15 and 16. The left speaker SPL and the right speaker SPR then outputs sound based on the resulting signals. The system controller 5 then proceeds to next step SP55. By the way, during that process, the system controller 5 also controls the video signal analyzing processing section 43 to supply the video signal VS1 corresponding to the audio signals LD and RD to a subsequent monitor (not shown).

At this time, the following signals within the same frequency band are provided with the level ratio and phase difference in accordance with the zoom variables: the subband signals SBL11, SBL22, . . . , and SBLmm included in the audio signal LD for the left speaker SPL; and the subband signals SBR11, SBR22, and SBRnn included in the audio signal RD for the right speaker SPR. Therefore, the sound image localization changes in the following manner while the left speaker SPL and the right speaker SPR are outputting sound: the position of the sound image A changes according to the movement of the face image FV.

At step SP55, the system controller 5 checks whether there are the next Lch and Rch audio signals LS1 and RS1 to be inputted into the analyzing filter banks 11 and 12 from the media reproduction section 2. The negative result at step SP55 means that there is no signal to be processed for change of the sound image localization of the sound image A. In this case, the system controller 5 proceeds to next step SP57 to end the process.

The affirmative result at step SP55 means that there are the next audio signals LS1 and RS1 to be processed for change of the sound image localization of the sound image A. In this case, the system controller 5 resets the above zoom variable at step SP56, and then returns to step SP41 to repeat the subsequent processes.

(4-5) Operation and Effect in Third Embodiment

The video and sound processing device 41 with the above configuration changes the sound image localization of the sound image A corresponding to the face image FV, in accordance with the relative position of the face image FV with respect to the center of the screen. In this case, the face image FV is a part of a moving picture. Accordingly, if the face image FV is located at the center of the screen, the sound image A is located at almost the middle point between the left speaker SPL and the right speaker SPR, as shown in FIG. 19B. If the face image FV moves to the upper right side of the screen, the sound image A also moves such that it is located close to the right speaker SPR, as shown in FIG. 20B.

In this manner, the video and sound processing device 41 can change the sound image localization of the sound image A, or the position of the sound image A, in accordance with the movement of the face image FV within a moving picture. This associates the movement of the face image FV with the position of the sound image A, and therefore gives the listener LNR the feeling of being at a live performance.

In addition to the change of the sound image localization, the video and sound processing device 41 controls the volume in accordance with the movement of the face image FV: the video and sound processing device 41 for example turns down the volume of the sound image A when the face image FV gets close to the bottom side of the screen, while the video and sound processing device 41 turns up the volume of the sound image A when the face image FV gets close to the upper side of the screen. This gives the listener LNR the feeling of being at a live performance.

The above configuration makes this possible: the video and sound processing device 41 changes, in accordance with the relative position of the face image FV in a moving picture with respect to the center of the screen, the sound image localization of the sound image A corresponding to the face image FV. Accordingly, this can not change the quality of the original sound while the position of the sound image A is changing according to the movement of the face image FV. This gives the listener LNR the feeling of being at a live performance.

(5) Fourth Embodiment

(5-1) Configuration of Disk Playback Device

Figure 23:
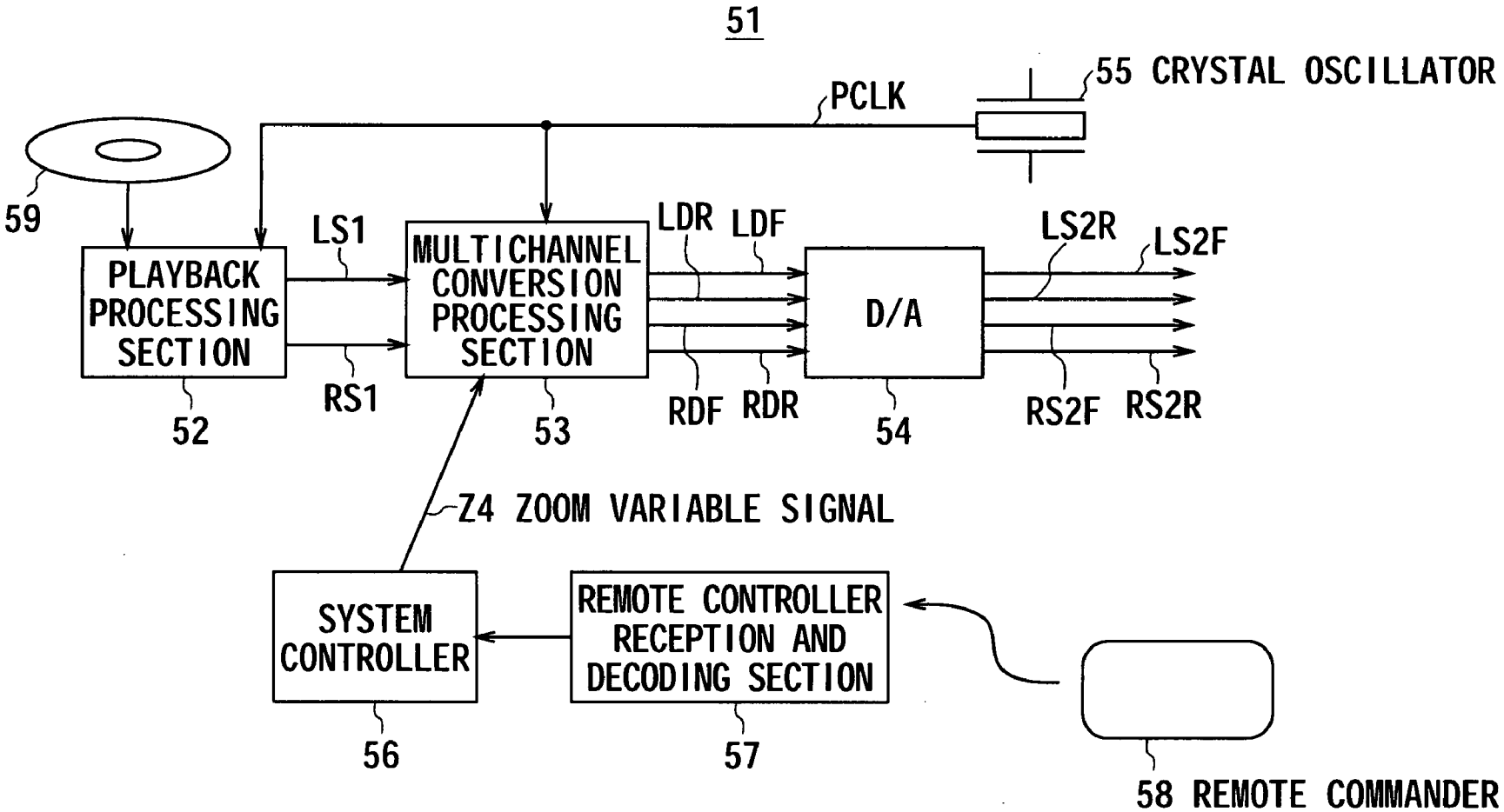
FIG. 23 is a schematic diagram illustrating the configuration of a disk playback device according to a fourth embodiment of the present invention.

In FIG. 23, the reference numeral 51 denotes a disk playback device according to a fourth embodiment of the present invention. A system controller 56, or microcomputer, executes a predetermined audio signal processing program to take overall control of the device 51. For example, the system controller 56 converts 2-channel audio signals LS1 and RS1, which are reproduced from an optical disc 59 by a playback processing section 52, into 4-channel multichannel audio signals LS2F, LS2R, RS2F and RS2R and then outputs them.

The disk playback device 51 controls the playback processing section 52 to rotate the optical disc 59 and read out the 2-channel audio signals LS1 and RS1 from the optical disc 59. The disk playback device 51 supplies, in accordance with a system clock PCLK supplied from a crystal oscillator 55, the audio signals LS1 and RS1 to a multichannel conversion processing section 53.

The multichannel conversion processing section 53 converts the audio signals LS1 and RS1, which are supplied from the playback processing section 52, into the 4-channel signals, or the multichannel audio signals LDF, LDR, RDF and RDR which are then supplied to a digital-to-analog converter 54: the multichannel audio signals LDF, LDR, RDF and RDR have sound images expanded in accordance with the zoom variable signal Z4 supplied from the system controller 56.

The digital-to-analog converter 54 converts the multichannel audio signals LDF, LDR, RDF and RDR, which are supplied from the multichannel conversion processing section 53, into analog audio signals LS2F, LS2R, RS2F and RS2R which then are supplied to two front speakers and two rear speakers.

When the user controls a remote commander 58, or remote controller, a remote controller reception and decoding section 57 of the disk playback device 51 receives an infrared remote controller signal from the remote commander 58, decodes the remote controller signal and supplies a resulting signal to the system controller 56.

Based on the remote control signal supplied from the remote controller reception and decoding section 57, the system controller 56 executes a program to perform processes in accordance with the user's operation of the remote controller. If the user operates the remote commander 58 to change the number of channels, the system controller 56 generates a zoom variable signal Z4 accordingly, and then supplies the zoom variable signal Z4 to the multichannel conversion processing section 53.

(5-2) Circuit Configuration of Multichannel Conversion Processing Section

Figure 24:
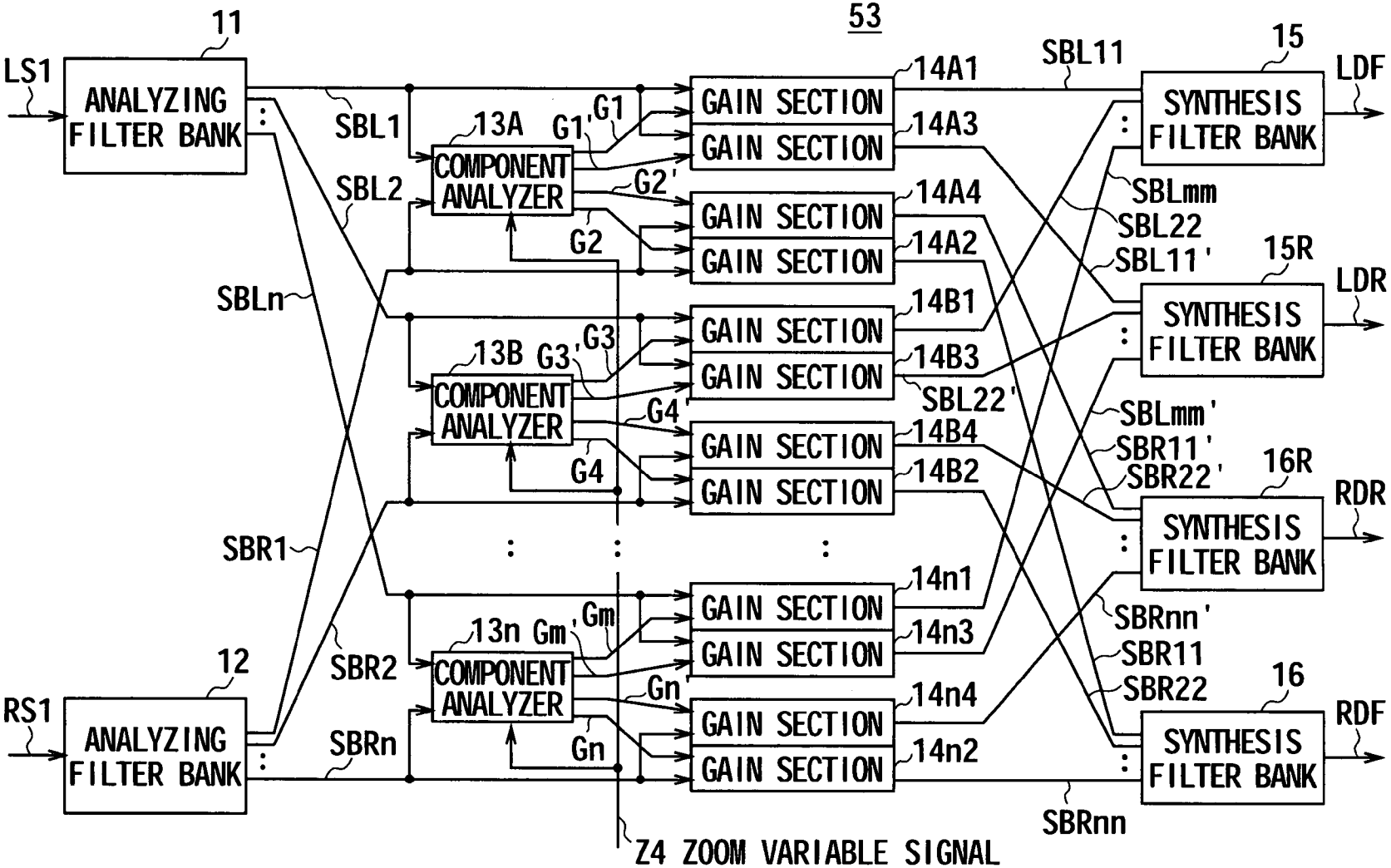
FIG. 24 is a schematic block diagram illustrating the circuit configuration of a multichannel conversion processing section according to a fourth embodiment of the present invention.

As shown in FIG. 24 (the parts of FIG. 24 have been designated by the same reference numerals and symbols as the corresponding parts of FIG. 2), the circuit configuration of the multichannel conversion processing section 51 is almost the same as that of the audio signal processing section 3 (FIG. 2) of the first embodiment, except the following points: the multichannel conversion processing section 51 further includes, for the two rear speakers, the gain sections 14A3, 14A4, 14B3, 14B4, . . . , 14*n*3 and 14*n*4, and the synthesis filter banks 15R and 16R to convert the 2-channel audio signals LS1 and RS1, which are reproduced from the optical disc 59, into the 4-channel signals, or the multichannel audio signals LDF, LDR, RDF and RDR for the two front speakers and two rear speakers.

In this case, the gain sections 14A3, 14A4, 14B3, 14B4, 14*n*3, and 14*n*4 are used to generate the multichannel audio signals LDR and RDR for the two rear speakers. The synthesis filter banks 15R and 16R are used to supply the audio signals LS2R and RS2R to the two rear speakers via the digital-to-analog converter 54.

The multichannel conversion processing section 53 inputs the Lch audio signal LS1 into an analyzing filter bank 11 and the Rch audio signal RS1 into an analyzing filter bank 12. The analyzing filter banks 11 and 12 separates the audio signals LS1 and RS1 into a plurality of components, each one carrying an equivalent or non-equivalent frequency band of the audio signals. This generates a plurality of subband signals SBL1 to SBLn and SBR1 to SBRn. The subband signals SBL1 to SBLn and SBR1 to SBRn are supplied to component analyzers 13A, 13B, . . . , and 13*n*.

At this time, the multichannel conversion processing section 53 supplies the subband signal SBL1, which is generated by the analyzing filter bank 11, to the gain sections 14A1 and 14A3; the multichannel conversion processing section 53 supplies the subband signal SBL2 to the gain sections 14B1 and 14B3; the multichannel conversion processing section 53 supplies the subband signal SBLn to the gain sections 14*n*1 and 14*n*3; the multichannel conversion processing section 53 supplies the subband signal SBR1, which is generated by the analyzing filter bank 12, to the gain sections 14A2 and 14A4; the multichannel conversion processing section 53 supplies the subband signal SBR2 to the gain sections 14B2 and 14B4; and the multichannel conversion processing section 53 supplies the subband signal SBRn to the gain sections 14*n*2 and 14*n*4.

By the way, the method of the analyzing filter banks 11 and 12 to separate the audio signals LS1 and RS1 into a plurality of components may include the DFT filter bank, the Wavelet filter bank, the QMF and the like.

In this case, the Lch subband signal SBL1 and the Rch subband signal SBR1 are in the same frequency band. Both signals SBL1 and SBR1 are supplied to the component analyzer 13A. In a similar way, the Lch subband signal SBL2 and the Rch subband signal SBR2 are in the same frequency band. Both signals SBL2 and SBR2 are supplied to the component analyzer 13B. Moreover, the Lch subband signal SBLn and the Rch subband signal SBRn are in the same frequency band. Both signals SBLn and SBRn are supplied to the component analyzer 13*n*.

The component analyzer 13A analyzes the phase difference between the Lch subband signal SBL1 and the Rch subband signal SBR1 and their level ratios to estimate the localization angle of sound images based on the subband signals SBL1 and SBR1. The component analyzer 13A then determines, based on the estimated localization angle and the zoom variable signal Z4 supplied from the system controller 56, gain values G1, G1', G2 and G2', and supplies the gain values G1, G1', G2 and G2' to the gain sections 14A1, 14A3, 14A2 and 14A4, respectively.

The gain section 14A1 multiplies the subband signal SBL1 supplied from the analyzing filter bank 11 by the gain value G1 supplied from the component analyzer 13A to generate a subband signal SBL11, and then supplies the subband signal SBL11 to a synthesis filter bank 15. The gain section 14A2 multiplies the subband signal SBR1 supplied from the analyzing filter bank 12 by the gain value G2 supplied from the component analyzer 13A to generate a subband signal SBR11, and then supplies the subband signal SBR11 to a synthesis filter bank 16.

In a similar way, the gain section 14A3 multiplies the subband signal SBL1 supplied from the analyzing filter bank 11 by the gain value G1' supplied from the component analyzer 13A to generate a subband signal SBL11', and then supplies the subband signal SBL11' to a synthesis filter bank 15R. The gain section 14A4 multiplies the subband signal SBR1 supplied from the analyzing filter bank 12 by the gain value G2' supplied from the component analyzer 13A to generate a subband signal SBR11', and then supplies the subband signal SBR11' to a synthesis filter bank 16R.

In a similar way to that of the component analyzer 13A, the component analyzer 13B analyzes the phase difference between the Lch subband signal SBL2 and the Rch subband signal SBR2 and their level ratios to estimate the localization angle of sound images based on the subband signals SBL2 and SBR2. The component analyzer 13B then determines, based on the estimated localization angle and the zoom variable signal Z4 supplied from the system controller 56, gain values G3, G3', G4 and G4', and supplies the gain values G3, G3', G4 and G4' to the gain sections 14B1, 14B3, 14B2 and 14B4, respectively.

The gain section 14B1 multiplies the subband signal SBL2 supplied from the analyzing filter bank 11 by the gain value G3 supplied from the component analyzer 13B to generate a subband signal SBL22, and then supplies the subband signal SBL22 to the synthesis filter bank 15. The gain section 14B2 multiplies the subband signal SBR2 supplied from the analyzing filter bank 12 by the gain value G4 supplied from the component analyzer 13B to generate a subband signal SBR22, and then supplies the subband signal SBR22 to the synthesis filter bank 16.

In a similar way, the gain section 14B3 multiplies the subband signal SBL2 supplied from the analyzing filter bank 11 by the gain value G3' supplied from the component analyzer 13B to generate a subband signal SBL22', and then supplies the subband signal SBL22' to the synthesis filter bank 15R. The gain section 14B4 multiplies the subband signal SBR2 supplied from the analyzing filter bank 12 by the gain value G4' supplied from the component analyzer 13B to generate a subband signal SBR22', and then supplies the subband signal SBR22' to the synthesis filter bank 16R.

In a similar way to that of the component analyzers 13A and 13B, the component analyzer 13*n* analyzes the phase difference between the Lch subband signal SBLn and the Rch subband signal SBRn and their level ratios to estimate the localization angle of sound images based on the subband signals SBLn and SBRn. The component analyzer 13*n* then determines, based on the estimated localization angle and the zoom variable signal Z4 supplied from the system controller 56, gain values Gm, Gm', Gn and Gn', and supplies the gain values Gm, Gm', Gn and Gn' to the gain sections 14*n*1, 14*n*3, 14*n*2 and 14*n*4, respectively.

The gain section 14*n*1 multiplies the subband signal SBLn supplied from the analyzing filter bank 11 by the gain value Gm supplied from the component analyzer 13*n* to generate a subband signal SBLmm, and then supplies the subband signal SBLmm to the synthesis filter bank 15. The gain section 14*n*2 multiplies the subband signal SBRn supplied from the analyzing filter bank 12 by the gain value Gn supplied from the component analyzer 13*n* to generate a subband signal SBRnn, and then supplies the subband signal SBRnn to the synthesis filter bank 16.

In a similar way, the gain section 14*n*3 multiplies the subband signal SBLn supplied from the analyzing filter bank 11 by the gain value Gm' supplied from the component analyzer 13*n* to generate a subband signal SBLmm', and then supplies the subband signal SBLmm' to the synthesis filter bank 15R. The gain section 14*n*4 multiplies the subband signal SBRn supplied from the analyzing filter bank 12 by the gain value Gn' supplied from the component analyzer 13*n* to generate a subband signal SBRnn', and then supplies the subband signal SBRnn' to the synthesis filter bank 16R.

The synthesis filter bank 15 synthesizes the subband signals SBL11, SBL22, . . . , and SBLmm, which are supplied from the gain sections 14A1, 14B1, . . . , and 14*n*1, to generate an audio signal LDF for a left front speaker, and supplies the audio signal LDF to a next section of the digital-to-analog converter 54. Similarly, the synthesis filter bank 16 synthesizes the subband signals SBR11, SBR22, . . . , and SBRnn, which are supplied from the gain sections 14A2, 14B2, . . . , and 14*n*2, to generate an audio signal RDF for a right front speaker, and supplies the audio signal RDF to a next section of the digital-to-analog converter 54.

Similarly, the synthesis filter bank 15R synthesizes the subband signals SBL11', SBL22', . . . , and SBLmm', which are supplied from the gain sections 14A3, 14B3, . . . , and 14*n*3, to generate an audio signal LDR for a left rear speaker, and supplies the audio signal LDR to a next section of the digital-to-analog converter 54. Similarly, the synthesis filter bank 16R synthesizes the subband signals SBR11', SBR22', . . . , and SBRnn', which are supplied from the gain sections 14A4, 14B4, . . . , and 14*n*4, to generate an audio signal RDR for a right rear speaker, and supplies the audio signal RDR to a next section of the digital-to-analog converter 54.

In this manner, the multichannel conversion processing section 53 converts, in accordance with the zoom variable signal Z4 supplied from the system controller 56, the 2-channel audio signals LS1 and RS1, which are supplied from the media reproduction section 2, into the 4-channel signals LDF, LDR, RDF and RDR, or the multichannel audio signals LDF, LDR, RDF and RDR where the extent of sound images is changed. The multichannel conversion processing section 53 subsequently supplies the signals LDF, LDR, RDF and RDR to the digital-to-analog converter 54.

If the user does not operates the remote controller 58 to change the number of channels, the command signal is not supplied from that; the system controller 56 therefore does not supply the zoom variable signal Z4 to the multichannel conversion processing section 53. In this case, the multichannel conversion processing section 53 supplies the subband signals SBL1, SBL2, . . . , and SBLn, which are supplied from the analyzing filter bank 11, to the synthesis filter bank 15 without adjusting their gains. In addition, the multichannel conversion processing section 53 supplies the subband signals SBR1, SBR2, . . . , and SBRn, which are supplied from the analyzing filter bank 12, to the synthesis filter bank 16 without adjusting their gains.

That means that the multichannel conversion processing section 53 just supplies the 2-channel audio signals LS1 and RS1, which are supplied from the media reproduction section 2, to the digital-to-analog converter 53 without change, as the audio signals LDF and RDF. After that, those signals are input into the left and right front speakers which then output sound.

(5-3) Circuit Configuration of Component Analyzers

The circuit configuration of the above component analyzers 13A, 13B, . . . , and 13*n* will be described. Their circuit configurations are all the same except the following point: The gain calculator 25 of the component analyzer 13A calculates four types of gain values G1, G1', G2 and G2' based on the zoom variable signal Z4. For ease of explanation, only the circuit configuration of the component analyzer 13A of the fourth embodiment will be described.

Figure 25:
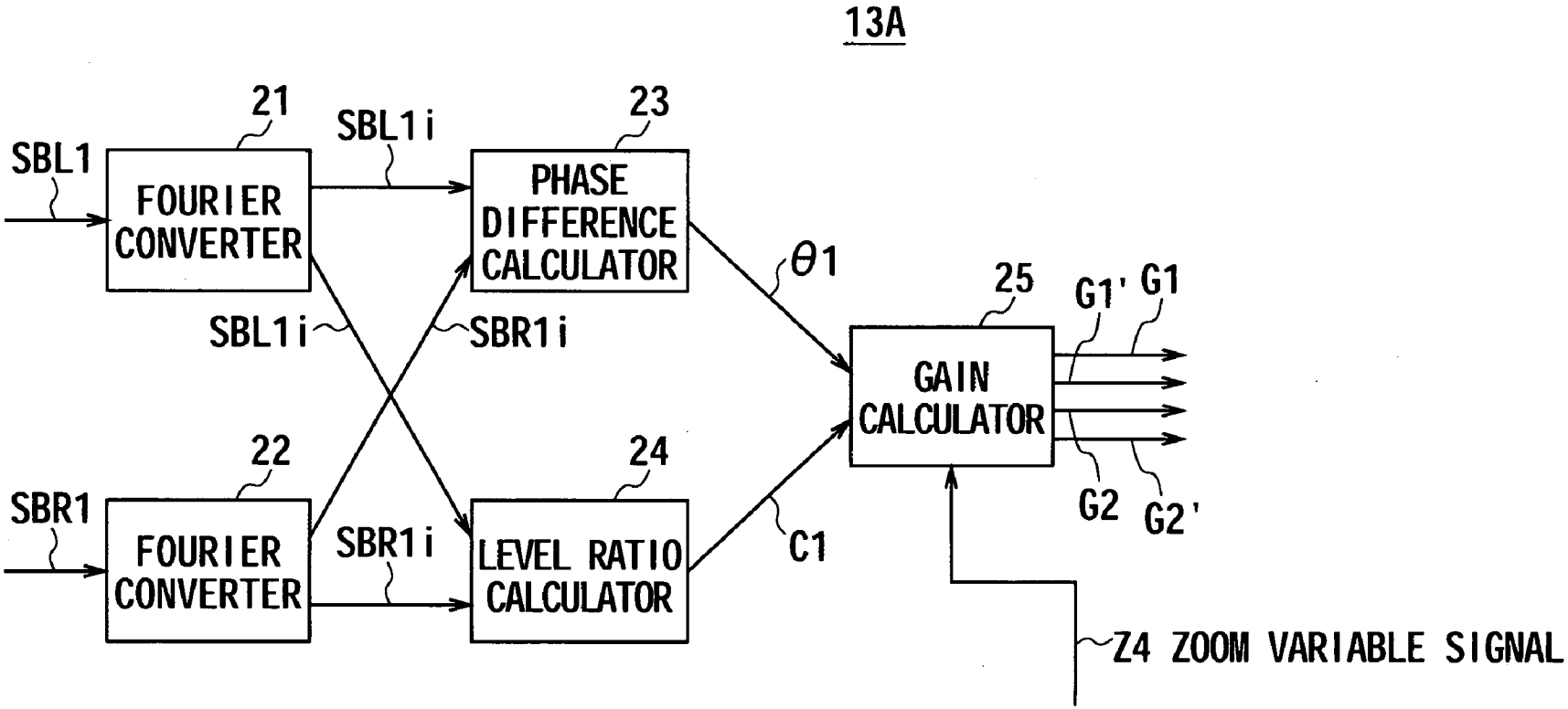
FIG. 25 is a schematic block diagram illustrating the circuit configuration of a component analyzer according to a fourth embodiment of the present invention.

As shown in FIG. 25, the component analyzer 13A supplies the subband signal SBL1, which is supplied from the analyzing filter bank 11, to a Fourier converter 21, and the subband signal SBR1, which is supplied from the analyzing filter bank 12, to a Fourier converter 22.

The Fourier converters 21 and 22 perform a Fourier transformation process on the subband signals SBL1 and SBR2, respectively. The Fourier converters 21 and 22 then supplies resulting complex subband signals SBL1*i* and SBR1*i* to a phase difference calculator 23 and a level ratio calculator 24.

The phase difference calculator 23 calculates a phase difference θ1 which is a difference between the complex subband signal SBL1*i* supplied from the Fourier converter 21 and the complex subband signal SBR1*i* supplied from the Fourier converter 22. The phase difference calculator 23 then supplies the phase difference θ1 to a gain calculator 25.

The level ratio calculator 24 calculates a level ratio C1 which is a ratio of the complex subband signal SBL1*i* supplied from the Fourier converter 21 to the complex subband signal SBR1*i* supplied from the Fourier converter 22. The level ratio calculator 24 then supplies the level ratio C1 to the gain calculator 25.

The gain calculator 25 determines gain values G1, G1', G2 and G2' based on the phase difference θ1 supplied from the phase difference calculator 23, the level ratio C1 supplied from the level ratio calculator 24 and the zoom variable signal Z4 supplied from the system controller 56 (FIG. 23). The gain calculator 25 then outputs the gain values G1, G1', G2 and G2'.

Accordingly, the component analyzer 13A can make the following data bigger or smaller than before the signal processing: the phase difference and level ratio between the subband signal SBL11 which is multiplied by the gain value G1 by the gain section 14A1 (FIG. 24) and the subband signal SBR11 which is multiplied by the gain value G2 by the gain section 14A2 (FIG. 24).

Similarly, the component analyzer 13A can make the following data bigger or smaller than before the signal processing: the phase difference and level ratio between the subband signal SBL11' which is multiplied by the gain value G1' by the gain section 14A3 (FIG. 24) and the subband signal SBR11' which is multiplied by the gain value G2' by the gain section 14A4 (FIG. 24).

Therefore, the multichannel conversion processing section 53 outputs the following sound through the left and right front speaker: the sound of the audio signal LDF included in the subband signal SBL11 generated by the synthesis filter bank 15 and the sound of the audio signal RDF included in the subband signal SBR11 generated by the synthesis filter bank 16. At this time, it is easy for the multichannel conversion processing section 53 to enlarge or narrow the sound images corresponding to the frequency bands of the subband signals SBL11 and SBR11.

In addition, the multichannel conversion processing section 53 outputs the following sound through the left and right rear speaker: the sound of the audio signal LDR included in the subband signal SBL11' generated by the synthesis filter bank 15R and the sound of the audio signal RDR included in the subband signal SBR11' generated by the synthesis filter bank 16R. At this time, it is easy for the multichannel conversion processing section 53 to enlarge or narrow the sound images corresponding to the frequency bands of the subband signals SBL11' and SBR11'.

(5-4) Sound Image Localization (Multichannel)

Figure 26:
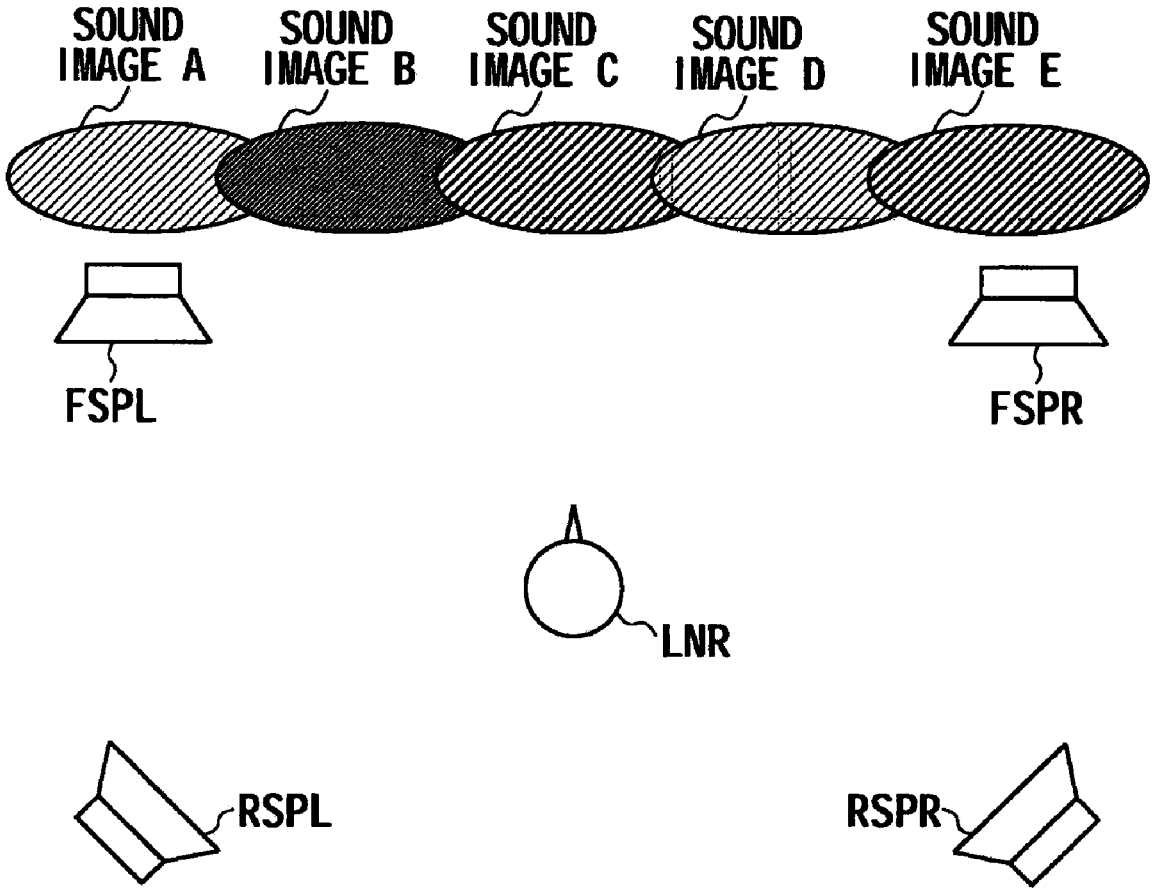
FIG. 26 is a schematic diagram illustrating the sound image localization before multichannel.

As shown in FIG. 26, the disk playback device 51 may output the 2-channel audio signals LS1 and RS1, which are reproduced from the optical disc 59, through the front left speaker FSPL and the front right speaker FSPR, and set the sound images A to E between the front left speaker FSPL and the front right speaker FSPR. This situation will be referred to as "not-multichannelized".

When the disk playback device 51 increases the number of channels from two (2-channel audio signals LS1 and RS1) to four the rear left speaker RSPL and rear right speaker RSPR will be used.

In this case, the multichannel conversion processing section 53 of the disk playback device 51 converts the 2-channel audio signals LS1 and RS1 into the four-channel signals, or the multichannel audio signals LS2F, LS2R, RS2F and RS2R, which are then output through the front left speaker FSPL, the front right speaker FSPR, the rear left speaker RSPL and the rear right speaker RSPR, respectively.

Figure 27:
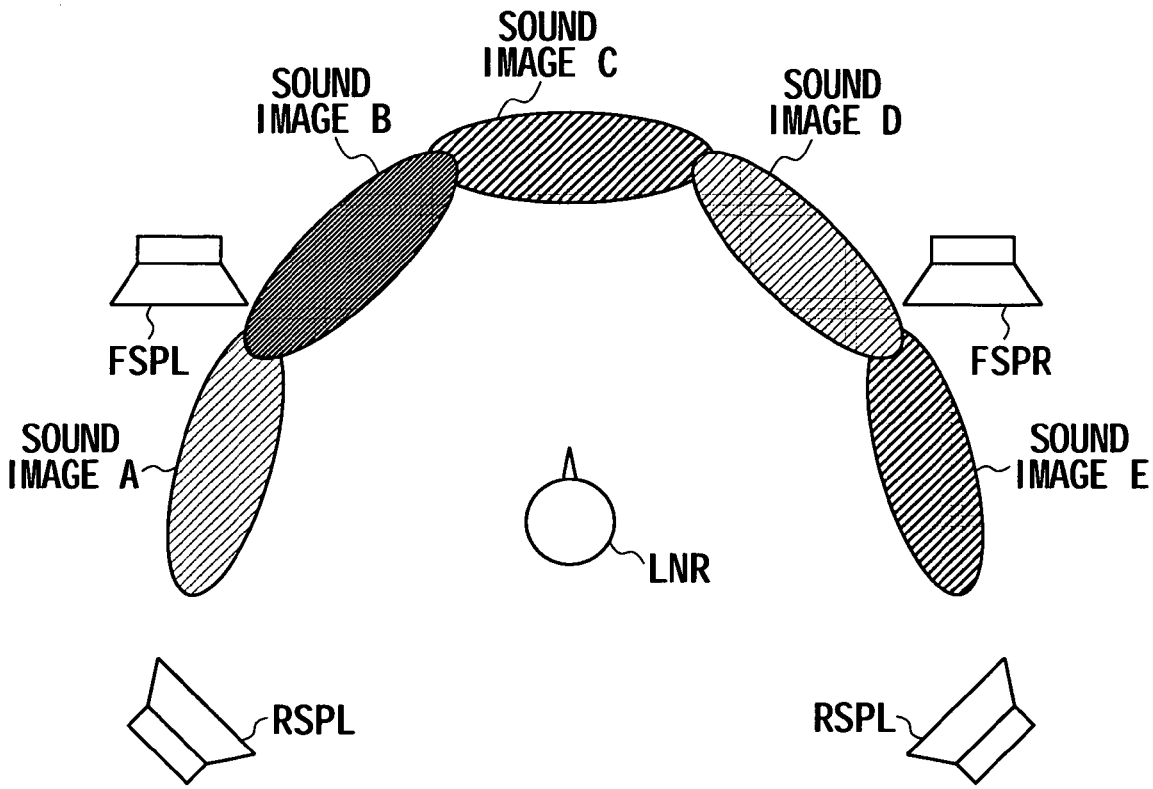
FIG. 27 is a schematic diagram illustrating sound image localization where sound images are evenly enlarged.
Figure 28:
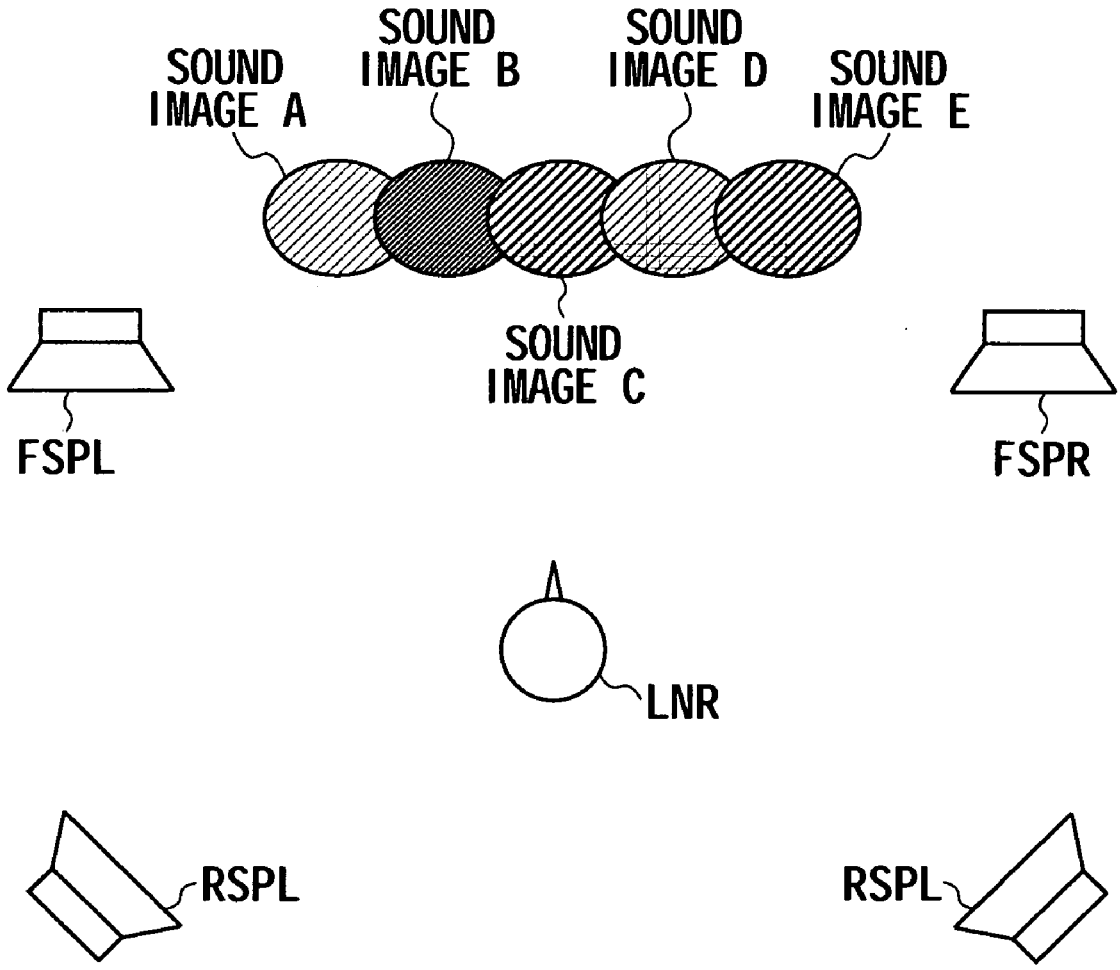
FIG. 28 is a schematic diagram illustrating sound image localization where sound images are evenly narrowed.

The gains of the multichannel audio signals LS2F, LS2R, RS2F and RS2R have respectively been adjusted by the gain values G1, G1', G2 and G2' by the multichannel conversion processing section 53. Accordingly, as shown in FIG. 27, when the front left speaker FSPL, the front right speaker FSPR, the rear left speaker RSPL and the rear right speaker RSPR output sound, those sound images A to E become enlarged by surrounding the listener LNR.

If the disk playback device 51 outputs only the 2-channel audio signals LS1 and RS1, the listener LNR would have the sound images A to E located in front of him/her. This probably does not give the listener LNR the feeling of being at a live performance. On the contrary, in this embodiment, the front left speaker FSPL, the front right speaker FSPR, the rear left speaker RSPL and the rear right speaker RSPR output sound based on the multichannel audio signals LS2F, LS2R, RS2F and RS2R. This for example provides the listener LNR with the sound image A on his/her left side and the sound image E on his/her right side. In this manner, the sound images A to E get enlarged compared to the not-multichannelized sound images, giving the listener LNR the feeling of being at a live performance.

In addition, the disk playback device 51 may perform processes in the following manner when converting the 2-channel audio signals LS1 and RS1 into the 4-channel signals: the disk playback device 51 keeps the gains of the audio signals LS2R and RS2R, which are to be supplied to the rear left speaker RSPL and the rear right speaker RSPR, at zero, and controls the level ratio and phase difference of the audio signals LS2F and RS2F, which are to be supplied to the front left speaker FSPL and the front right speaker FSPR. This allows the disk playback device 51 to narrow the extent of sound images A to E between the front left speaker FSPL and the front right speaker FSPR, regardless of the four speakers the disk playback device 5 has.

(5-5) Sound Image Localization Change Process with Multichannel

Figure 29:
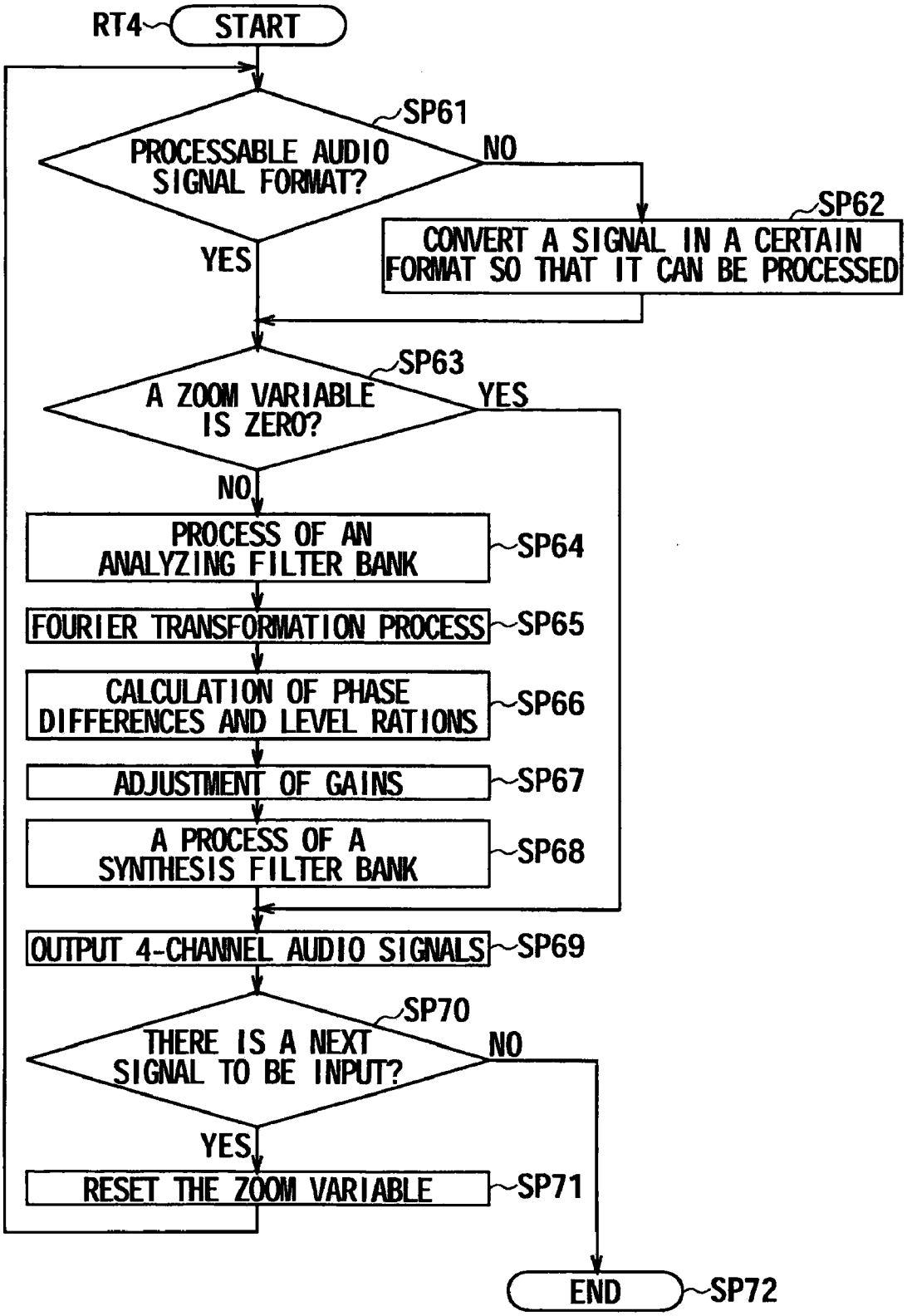
FIG. 29 is a flowchart illustrating a procedure of a sound image localization change process according to a fourth embodiment of the present invention.

With reference to FIG. 29, the following describes a procedure of a process of changing the sound image localization of the sound images A to E when converting the 2-channel signals into the 4-channel signals.

The system controller 56 of the disk playback device 51 starts a routine RT4 from start step, and then proceeds to next step SP61. At step SP61, the system controller 56 checks whether the Lch audio signal LS1 and Rch audio signals RS1, which have been reproduced from the optical disc 59, have been converted into a certain signal format that allows the multichannel conversion processing section 53 to change the sound image localization.

For example, if the audio signals LS1 and RS1 have been compressed in the MP3 format or the like or if their frequencies are different from a sampling frequency of an expected signal format, the system controller 56 may not be able to change their localization angle unless those signals are converted into a certain signal format that allows changing the localization angle.

Accordingly, when the affirmative result is obtained at step SP61 the system controller 56 proceeds to next step SP63. By contrast, the negative result at step SP61 means that the multichannel conversion processing section 53 may not be able to change the localization angles of the sound image localization of the audio signals LS1 and RS1, and, therefore, the system controller 56 proceeds to next step SP62.

At step SP62, the system controller 56 converts the audio signals LS1 and RS1 in a certain signal format to change the localization angles, and then proceeds to next step SP63.

At step SP63, the system controller 56 checks whether the zoom variable signal Z4, which will be supplied in response to the user's operation of the remote commander 58 (FIG. 23) to the multichannel conversion processing section 53, is "0".

The affirmative result at step SP63 means that the zoom variable is "0". It means that the command signal that initiates the process of changing the localization angles is not supplied from the remote commander 58 due to multichannelized operation. In this case, the system controller 56 does not perform the process of changing the localization angles by the multichannel conversion processing section 53, and then proceeds to step SP69.

The negative result at step SP63 means that the zoom variable is not "0". It means that the command signal that initiates the process of changing the localization angles is supplied from the remote commander 58. In this case, the system controller 56 proceeds to next step SP64 to perform the process of changing the localization angles and the multichannel process of converting the 2-channel signals into the 4-channel signals by the multichannel conversion processing section 53.

At step SP64, the system controller 56 controls the analyzing filter bank 11 of the multichannel conversion processing section 53 to separate the Lch audio signal LS1 into a plurality of components with different frequency bands. The system controller 56 also controls the analyzing filter bank 12 of the multichannel conversion processing section 53 to separate the Rch audio signal RS1 into a plurality of components with different frequency bands. The system controller 56 subsequently supplies the resulting subband signals SBL1 to SBLn and SBR1 to SBRn to the Fourier converters 21 and 22 of the component analyzers 13A to 13*n*, and then proceeds to next step SP65.

At step SP65, the system controller 56 controls the Fourier converters 21 and 22 of the component analyzers 13A to 13*n* to perform a Fourier transformation process to the subband signals SBL1 to SBLn and SBR1 to SBRn. The system controller 56 subsequently supplies the resulting complex subband signals SBL1*i* to SBLni and SBR1*i* to SBRni to the phase difference calculator 23 and the level ratio calculator 24, and then proceeds to next step SP66.

At step SP66, the system controller 56 calculates the phase difference θ1 and the level ratio C1 by the phase difference calculator 23 and the level ratio calculator 24 of the component analyzers 13A to 13*n*, supplies the phase difference θ1 and the level ratio C1 to the gain calculator 25, and then proceeds to next step SP67.

At step SP67, the system controller 56 controls the gain calculator 25 of the component analyzers 13A to 13*n* to determine the four gain values based on the phase difference θ1, the level ratio C1 and the zoom variable of the zoom variable signal Z4, and uses these gain values to control the gains of the subband signals SBL1 to SBLn and SBR1 to SBRn by the gain sections 14 of the multichannel conversion processing section 53. The system controller 56 supplies the resulting subband signals SBL11 to SBLmm, SBL11' to SBLmm', SBR11 to SBRnn and SBR11' to SBRnn' to the synthesis filter banks 15, 15R, 16 and 16R, respectively. The system controller 56 subsequently proceeds to next step SP68.

At step SP68, the system controller 56 synthesizes, by the synthesis filter bank 15, the subband signals SBL11, SBL22, . . . , and SBLmm, which are supplied form the gain sections 14A1, 14B1, 14*n*1, to generate the Lch audio signal LDF for the front left speaker FSPL. The system controller 56 also synthesizes, by the synthesis filter bank 16, the subband signals SBR11, SBR22, . . . , and SBRnn, which are supplied form the gain sections 14A2, 14B2, 14*n*2, to generate the Rch audio signal RDF for the front right speaker FSPR. The system controller 56 also synthesizes, by the synthesis filter bank 15R, the subband signals SBL11', SBL22', and SBLmm', which are supplied form the gain sections 14A3, 14B3, 14*n*3, to generate the Lch audio signal LDR for the rear left speaker RSPL. The system controller 56 also synthesizes, by the synthesis filter bank 16R, the subband signals SBR11', SBR22', and SBRnn', which are supplied form the gain sections 14A4, 14B4, 14*n*4, to generate the Rch audio signal RDR for the rear right speaker RSPR. The system controller 56 subsequently proceeds to next step SP69.

At step SP69, the system controller 56 performs, by the digital-to-analog converter 54, a digital-to-analog conversion process on the audio signals LDF, LDR, RDF and RDR which are supplied from the synthesis filter banks 15, 15R, 16 and 16R of the multichannel conversion processing section 53. The front left speaker FSPL, the front right speaker FSPR, the rear left speaker RSPL and the rear right speaker RSPR then outputs sound based on the resulting signals. The system controller 56 subsequently proceeds to next step SP70.

At step SP70, the system controller 56 checks whether there are the next Lch and Rch audio signals LS1 and RS1 to be inputted into the analyzing filter banks 11 and 12 of the multichannel conversion processing section 53. The negative result at step SP70 means that there are no signals to be processed for localization angles changes. In this case, the system controller 56 proceeds to next step SP72 to end the process.

The affirmative result at SP70 means that there are the next audio signals LS1 and RS1 to be processed for localization angles changes. In this case, the system controller 56 at step SP71 resets the above zoom variable, and then returns to step SP61 to repeat the subsequent processes.

(5-6) Operation and Effect in the Fourth Embodiment

The disk playback device 51 with the above configuration converts the 2-channel audio signals LS1 and RS1 into the 4-channel signals. This produces the multichannel audio signals LS2F, LS2R, RS2F and RS2R, whose gains have been adjusted by the gain values G1, G1', G2 and G2'. The front left speaker FSPL, the front right speaker FSPR, the rear left speaker RSPL and the rear right speaker RSPR outputs sound based on the multichannel audio signals LS2F, LS2R, RS2F and RS2R. In this manner, using these four speakers makes the sound images A to E larger than when using only the two speakers (the front left speaker FSPL and the front right speaker FSPR, for example).

In this manner, the disk playback device 51 can evenly spread the sound images A to E between not only the front left speaker FSPL and the front right speaker FSPR but also the rear left speaker RSPL and the rear right speaker RSPR. This provides the listener LNR the feeling of being surrounded by the sound images A to E in all directions, and also provides a stereoscopic acoustic space to him/her.

The above configuration makes this possible: the disk playback device 51 adjusts, using the four gain values based on the zoom variable, the gains of the 2-channel audio signals LS1 and RS1 to produce the multichannel audio signals LS2F, LS2R, RS2F and RS2R which are then output from the front left speaker FSPL, the front right speaker FSPR, the rear left speaker RSPL and the rear right speaker RSPR. This makes the sound images A to E larger, improving the surround effect accordingly.

(6) Other Embodiments

In the above-noted first to fourth embodiments, to change the position of the sound images, or the sound image localization, the audio signals of less than 3500 Hz are processed to adjust their phase differences, while the audio signals of more than 3500 Hz are processed to adjust their level ratios. However the present invention is not limited to this. Both the phase differences and level ratios may be adjusted to change the sound image localization.

In addition, in the above-noted first embodiment, if the sound images A to E exist in an arc of 90 degrees from left to right, the subband signals corresponding to these sound images A to E are output. However the present invention is not limited to this. The other subband signals corresponding to the sound images outside the arc may be output. In addition, the arc can be larger or smaller than 90 degrees.

Furthermore, in the above-noted first embodiment, the localization angles are changed, before the signal process, in accordance with the five patterns corresponding to the zoom variables "−1", "−0.5", "0", "+0.5", and "+1". However the present invention is not limited to this. The extent of sound images A to E can be evenly enlarged or narrowed. In addition, the localization angles can be changed in accordance with various patterns, or various sequential zoom variables.

Furthermore, in the above-noted second embodiments, the image pickup device 31 includes two stereo microphones 38. However the present invention is not limited to this. The image pickup device 31 may include two or more monophonic microphones.

Furthermore, in the above-noted second embodiment, the image pickup device 31 is designed for 2-channel audio signals, with the two stereo microphones 38. However the present invention is not limited to this. The image pickup device 31 may be designed for 2 or more channel audio signals.

Furthermore, in the above-noted second embodiment, the image pickup device 31 collects sound through the two stereo microphones 38 to obtain the analog stereo audio signals ALS1 and ARS1, and then converts, by the analog-to-digital converter 39, them into the digital stereo audio signals DLS and DRS1 for the process of the audio signal processing section 40. However the present invention is not limited to this. The image pickup device 31 may directly supply the analog audio signals ALS1 and ARS1 to the audio signal processing section 40 without performing the process of the analog-to-digital converter 39.

Furthermore, in the above-noted second embodiments, the sound images A to E become enlarged as the video images are zoomed in in accordance with the operation of the zoom switch 37. However the present invention is not limited to this. The sound images A to E get narrowed as the video images are zoomed out in accordance with the operation of the zoom switch 37.

Furthermore, in the above-noted third embodiment, the 2-channel audio signals LS1 and RS1 are applied. However the present invention is not limited to this. The 5.1-channel and more channel signals may be applied.

Furthermore, in the above-noted third embodiment, the face image FV is detected from the video image and the sound image A moves in accordance with the movement of the detected face image FV. However the present invention is not limited to this. A vehicle image or other image, which is one of audio sources appearing in a video image (movie content), may be detected, and the corresponding sound image may move in accordance with the movement of the detected image.

Furthermore, in the above-noted third embodiment, the face image FV is detected from the video image and the sound image A moves in accordance with the movement of the detected face image FV. However the present invention is not limited to this. The change of scenes, or the switch of screens, may be detected to generate patterns of sound images that fit the scene change, and the sound images may move to make the generated patterns.

Figure 30:
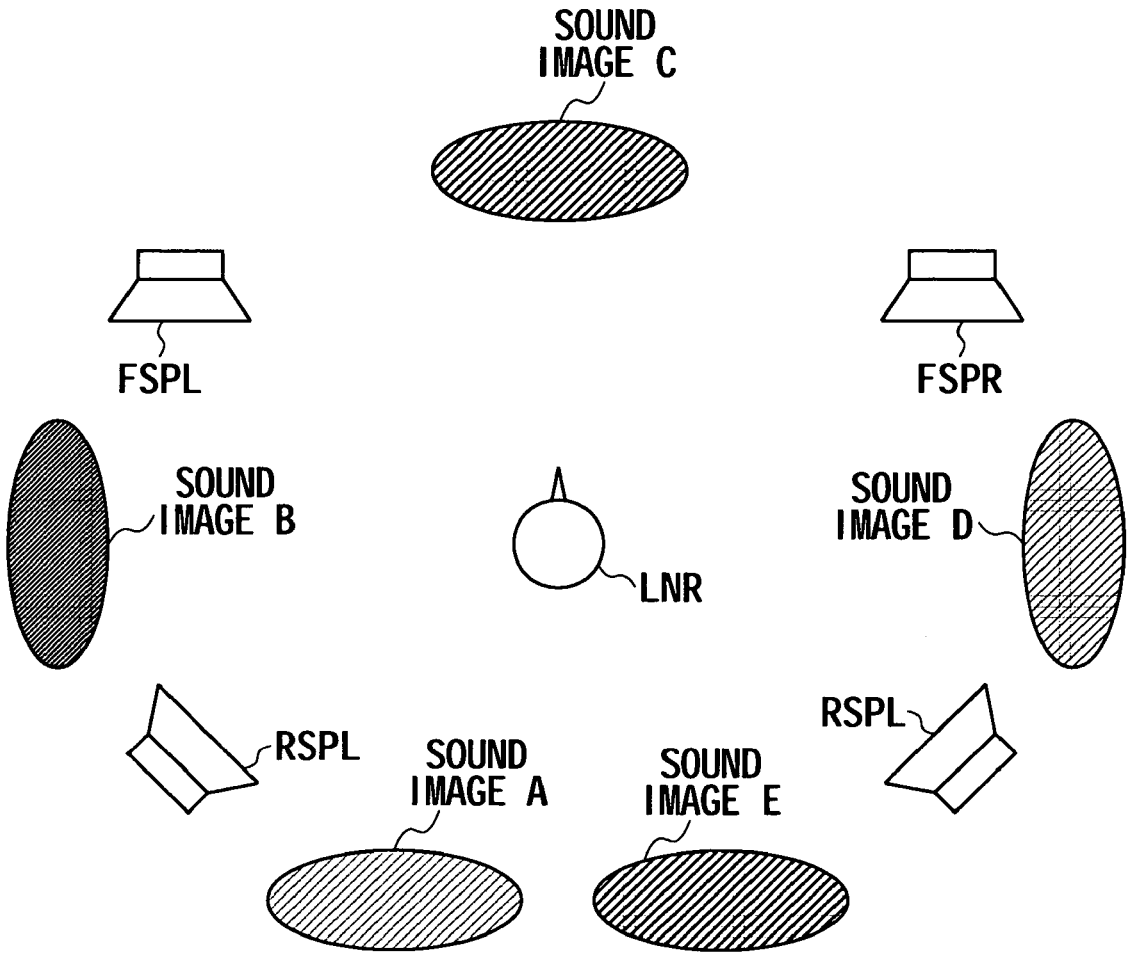
FIG. 30 is a schematic diagram illustrating sound image localization after signals are converted into 4-channel signals according to another embodiment of the present invention.

Furthermore, in the above-noted fourth embodiment, an acoustic space is formed such that the sound images A to E surround the listener LNR from all directions. However, the present invention is not limited to this. For example, as shown in FIG. 30, a different acoustic space may be formed: the sound images A and E may be placed behind the listener LNR; and the sound images B and D may be placed at the listener LNR's sides.

Figure 31:
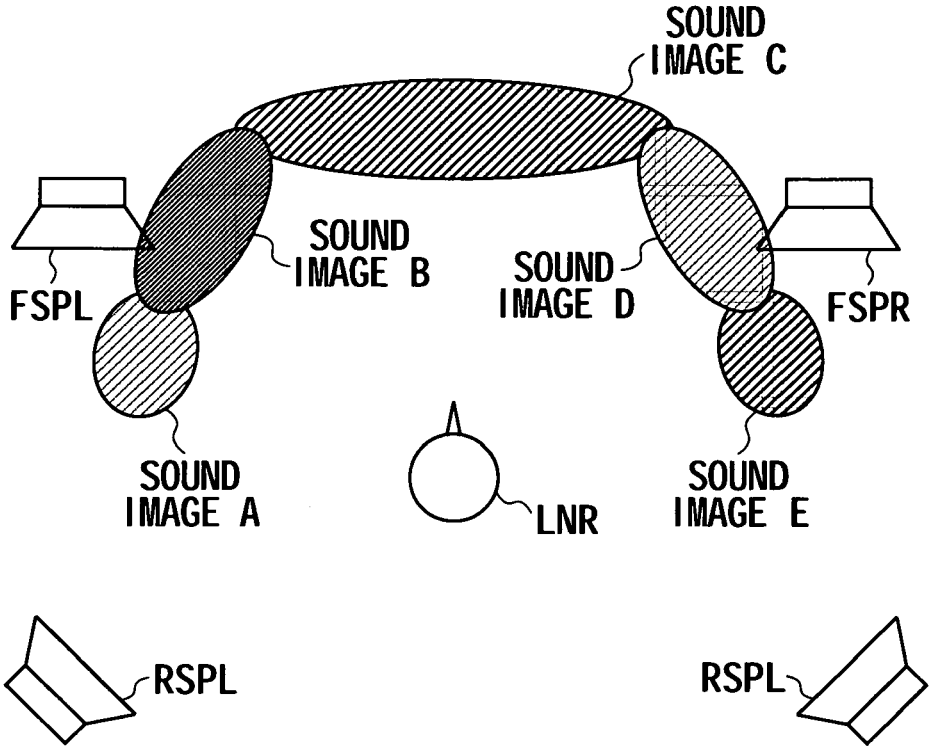
FIG. 31 is a schematic diagram illustrating sound image localization after signals are converted into 4-channel signals according to another embodiment of the present invention.
Figure 32:
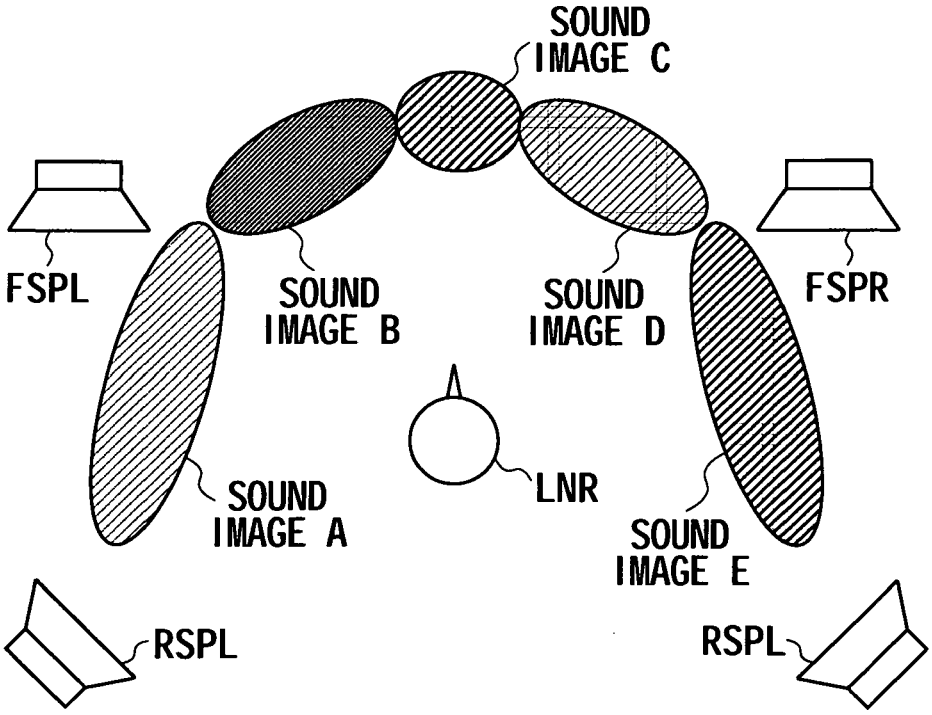
FIG. 32 is a schematic diagram illustrating sound image localization after signals are converted into 4-channel signals according to another embodiment of the present invention.

Furthermore, in the above-noted fourth embodiment, the sound images A to E become enlarged or narrowed evenly. However the present invention is not limited to this. For example, as shown in FIG. 31, the center sound image C may be enlarged with the sound images A and E at the both sides being narrowed. Alternatively, as shown in FIG. 32, the center sound image C may become narrowed with the sound images A and E at the both sides being enlarged.

Furthermore, in the above-noted fourth embodiment, the two-channel signals are converted into the four-channel signals. However the present invention is not limited to this. The original two-channel signals may be converted into other types of multichannel signals, such as 5.1 or 9.1 channel, which have more than two channels. In this case, one channel can be generated from two channels. In addition, three channels can be generated from one channel.

Furthermore, in the above-noted first to fourth embodiments, the localization position of the sound image localization, which the listener feels is located at a predetermined angle with respect to him/her, is changed in an acoustic space such as a room to control the extent of the sound images. However the present invention is not limited to this. The extent of the sound images may be controlled in an acoustic space such as a car or vehicle.

Furthermore, in the above-noted first to fourth embodiments, the audio signal processing apparatus includes: the analyzing filter banks 11 and 12, which are equivalent to division means; the phase difference calculator 23, which is equivalent to phase difference calculation means; the level ratio calculator 24, which is equivalent to level ratio calculation means; the system controller 5, which is equivalent to sound image localization estimation means; and the system controller 5 and the audio signal processing section 3, which are equivalent to control means. However the present invention is not limited to this. The audio signal processing apparatus may include other components which are equivalent to the division means, the phase difference calculation means, the level ration calculation means, the sound image localization estimation means and the control means.

The audio signal processing apparatus, audio signal processing method and audio signal processing program according to an embodiment of the present invention can be applied to an audio device capable of controlling the extent of the sound image indoors and outdoors.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus comprising:

division means for dividing at least two or more channel audio signals into components in a plurality of frequency bands;

phase difference calculation means for calculating a phase difference between said two or more channel audio signals at each said frequency band;

level ratio calculation means for calculating a level ratio between said two or more channel audio signals at each said frequency band;

zoom variable generation means for generating, based on a relative position of an object in a video image, a zoom variable;

sound image localization estimation means for estimating, based on said level ratio or said phase difference, sound image localization at each said frequency band; and control means for controlling said estimated sound image localization at each said frequency band by adjusting said level ratio or said phase difference, based on said zoom variable.

2. An audio signal processing apparatus comprising:

a division circuit that divides at least two or more channel audio signals into components in a plurality of frequency bands;

a phase difference calculation circuit that calculates a phase difference between said two or more channel audio signals at each said frequency band;

a level ratio calculation circuit that calculates a level ratio between said two or more channel audio signals at each said frequency band;

a zoom variable generation circuit that generates, based on a relative position of an object in a video image, a zoom variable;

a sound image localization estimation circuit that estimates, based on said level ratio or said phase difference, sound image localization at each said frequency band; and a control circuit that controls said estimated sound image localization at each said frequency band by adjusting said level ratio or said phase difference, based on said zoom variable.

3. The audio signal processing apparatus according to claim 2, further comprising a zoom circuit for evenly enlarging or narrowing, by said control circuit, the sound image localization at each said frequency band.

4. The audio signal processing apparatus according to claim 2, further comprising a zoom circuit for unevenly enlarging or narrowing, by said control circuit, the sound image localization at each said frequency band.

5. The audio signal processing apparatus according to claim 4, wherein said zoom circuit places the sound image localization at each said frequency band at a predetermined angle with respect to a listener.

6. The audio signal processing apparatus according to claim 4, wherein said zoom circuit enlarges a predetermined central area of the sound image localization at each said frequency band.

7. The audio signal processing apparatus according to claim 4, wherein said zoom circuit narrows a predetermined central area of the sound image localization at each said frequency band.

8. The audio signal processing apparatus according to claim 2, wherein said control circuit adjusts, in accordance with an operation of changing a zoom ratio of a video image being in synchronization with said audio signal, said level ratio or said phase difference.

9. The audio signal processing apparatus according to claim 2, wherein said control circuit adjusts, in accordance with a relative position of a certain audio source image with respect to center of a screen, said level ratio or said phase difference, said certain audio source image existing in a video image being in synchronization with said audio signal.

10. The audio signal processing apparatus according to claim 2, further including a multichannel conversion circuit for converting said two or more channel audio signals into multichannel audio signals, wherein the number of channels of the multichannel audio signals is more than the number of channels of said two or more channel audio signals, and wherein said control circuit adjusts said level ratio or said phase difference of said multichannel audio signals.

11. The audio signal processing apparatus according to claim 2, wherein the sound image localization estimation circuit estimates, based on said level ratio and said phase difference, the sound image localization at each said frequency band; and wherein the control circuit controls the estimated sound image localization at each said frequency band by adjusting said level ratio and said phase difference.

12. The audio signal processing apparatus according to claim 2, wherein the control circuit controls the estimated sound image localization at each said frequency band by adjusting by user said level ratio and said phase difference.

13. The audio signal processing apparatus according to claim 2, wherein the control circuit controls the estimated sound image localization at each said frequency band by adjusting said level ratio and said phase difference in accordance with movement of a video image being synchronized with said audio signal.

14. An audio signal processing method comprising:

a division step of dividing at least two or more channel audio signals into components in a plurality of frequency bands;

a phase difference calculation step of calculating a phase difference between said two or more channel audio signals at each said frequency band;

a level ratio calculation step of calculating a level ratio between said two or more channel audio signals at each said frequency band;

a zoom variable generation step of generating, based on a relative position of an object in a video image, a zoom variable;

a sound image localization estimation step of estimating, based on said level ratio or said phase difference, sound image localization at each said frequency band; and a control step of controlling said estimated sound image localization at each said frequency band by adjusting said level ratio or said phase difference, based on said zoom variable.

15. A non-transitory, computer-readable storage medium storing an audio signal processing program that, when executed by a processor, causes an audio signal processing apparatus to perform a method, the method comprising:

a division step of dividing at least two or more channel audio signals into components in a plurality of frequency bands;

a phase difference calculation step of calculating a phase difference between said two or more channel audio signals at each said frequency band;

a level ratio calculation step of calculating a level ratio between said two or more channel audio signals at each said frequency band;

a zoom variable generation step of generating, based on a relative position of an object in a video image, a zoom variable;

a sound image localization estimation step of estimating, based on said level ratio or said phase difference, sound image localization at each said frequency band; and a control step of controlling said estimated sound image localization at each said frequency band by adjusting said level ratio or said phase difference, based on said zoom variable.

* * * * *